US009336726B2

(12) United States Patent
Kim

(10) Patent No.: US 9,336,726 B2
(45) Date of Patent: May 10, 2016

(54) LIQUID CRYSTAL DISPLAY DEVICE INCLUDING BACKLIGHT UNIT AND METHOD OF DRIVING THE SAME

(75) Inventor: Sun-Ung Kim, Jeollanam-do (KR)

(73) Assignee: LG Display Co., Ltd., Seoul (KR)

( * ) Notice: Subject to any disclaimer, the term of this patent is extended or adjusted under 35 U.S.C. 154(b) by 1199 days.

(21) Appl. No.: 12/285,704

(22) Filed: Oct. 10, 2008

(65) Prior Publication Data

US 2009/0096741 A1 Apr. 16, 2009

(30) Foreign Application Priority Data

Oct. 11, 2007 (KR) ..... 10-2007-0102500
Apr. 24, 2008 (KR) ..... 10-2008-0038197

(51) Int. Cl.
*G09G 3/36* (2006.01)
*G09G 3/34* (2006.01)

(52) U.S. Cl.
CPC ..... *G09G 3/342* (2013.01); *G09G 2310/06* (2013.01); *G09G 2310/08* (2013.01); *G09G 2320/0233* (2013.01); *G09G 2320/064* (2013.01)

(58) Field of Classification Search
USPC ..... 345/102
See application file for complete search history.

(56) References Cited

U.S. PATENT DOCUMENTS

2005/0007516 A1* 1/2005 Hong ..... G02F 1/133603 349/64
2006/0256049 A1* 11/2006 Schou ..... G09G 3/32 345/82
2007/0080911 A1* 4/2007 Liu ..... G09G 3/342 345/82
2007/0091056 A1* 4/2007 Okita ..... G09G 3/342 345/102
2007/0091057 A1* 4/2007 Lee ..... G09G 3/3413 345/102
2007/0152951 A1* 7/2007 Ahn ..... G09G 3/342 345/102
2007/0176883 A1* 8/2007 Hsu ..... G09G 3/342 345/102
2010/0225670 A1* 9/2010 Groot Hulze ..... G09G 3/342 345/690

FOREIGN PATENT DOCUMENTS

| | | | |
|---|---|---|---|
| CN | 1909754 | | 2/2007 |
| CN | 101017645 | A | 8/2007 |
| JP | 11-223805 | * | 8/1999 |
| JP | 11-223805 | A | 8/1999 |
| JP | 2005-116298 | * | 4/2005 |
| JP | 2005-116298 | A | 4/2005 |
| JP | 2008-198430 | A | 8/2008 |

OTHER PUBLICATIONS

Extended European Search Report issued Sep. 1, 2009 in corresponding European Application No. 08165643.1.

(Continued)

*Primary Examiner* — Kathy Wang-Hurst
*Assistant Examiner* — Douglas M Wilson
(74) *Attorney, Agent, or Firm* — Morgan, Lewis & Bockius LLP

(57) ABSTRACT

A liquid crystal display device includes: a light emitting diode array unit including at least two groups of light emitting diode arrays for emitting light; a light emitting diode driving unit for supplying at least two pulse width modulation signals having different phases from each other to the at least two groups of light emitting diode arrays, respectively; a liquid crystal display panel for displaying images using the light from the light emitting diode array unit; and a timing controller for controlling the light emitting diode driving unit and the liquid crystal display panel.

10 Claims, 34 Drawing Sheets

(56) References Cited

OTHER PUBLICATIONS

European Office Action dated Oct. 25, 2011, issued in a corresponding European patent application.

China—English Translation of Second Office Action dated Feb. 13, 2012 for Chinese Patent Application No. 200810126802.1 in the name of LG Display Co., Ltd.

* cited by examiner

LIQUID CRYSTAL DISPLAY DEVICE INCLUDING BACKLIGHT UNIT AND METHOD OF DRIVING THE SAME

This application claims the benefit of Korean Patent Application No. 2007-0102500, filed on Oct. 11, 2007 and Korean Patent Application No. 2008-0038197, filed on Apr. 24, 2008, which are both hereby incorporated by references in their entirety.

BACKGROUND OF THE INVENTION

1. Field of the Invention

The embodiments of the invention relate to a liquid crystal display device, and more particularly, to a liquid crystal display device including a backlight unit and a method of driving the liquid crystal display device.

2. Discussion of the Related Art

A liquid crystal display (LCD) device includes a liquid crystal display panel and a backlight unit. The liquid crystal display panel includes a plurality of liquid crystal cells disposed in matrix and a plurality of thin film transistors (TFTs) through which image signals are supplied. Rotation angles of liquid crystal molecules in each liquid crystal cell as well as transmittance through each liquid crystal cell are controlled according to the image signals so as to display images on the liquid crystal display panel.

A cold cathode fluorescent lamp (CCFL) is used as a light source for the backlight unit of an LCD device. The backlight unit should be designed to have a thin profile and light weight while providing a large amount of light to the liquid crystal display panel. Accordingly, a light emitting diode (LED) has been suggested for use in a backlight due to an LED having the characteristics of low power consumption, light weight and high brightness compared to a CCFL.

FIG. 1 is a view showing an edge type backlight unit according to the related art. As shown in FIG. 1, a backlight unit includes a plurality of LED arrays 10 each having a plurality of LEDs 12 and an LED driving unit 20. A pulse width modulation (PWM) signal is supplied to the LED driving unit 20 from an external circuit unit (not shown). The plurality of LED arrays 10 are turned ON/OFF according to a power supplied synchronous with an ON time period of the PWM signal while the liquid crystal display panel displays images. The plurality of LED arrays 10 driven by the PWM signal (PWM driving) has advantages in power consumption and in color rendering over a plurality of LED arrays that are always turned ON by driving with a constant direct current (DC) voltage, otherwise known as DC driving.

Since the single PWM signal is supplied to the LED driving unit 20 and the plurality of LED arrays 10 are controlled by the single PWM signal, the plurality of LED arrays are simultaneously turned ON/OFF. Each TFT in the liquid crystal display panel is formed of amorphous silicon. When light enters the amorphous silicon, a photo leakage current corresponding to the intensity of the light from the LED arrays 10 is generated in the amorphous silicon so as to affect the OFF current in each TFT. Accordingly, when the plurality of LED arrays 10 is switched ON and OFF by the PWM signal, each TFT of the liquid crystal display panel will have variations in their OFF current. For example, the OFF current of each TFT when the plurality of LED arrays 10 are turned ON will vary to be greater than the OFF current of each TFT when the plurality of LED arrays 10 are turned OFF. The variations in the OFF current in the TFTs cause deterioration in the image display quality of the liquid crystal display panel. For example, the deterioration can be waviness or noise in portions of the liquid crystal display panel displaying darker images and/or in other portions of the liquid crystal display panel displaying brighter images.

SUMMARY OF THE INVENTION

Accordingly, embodiments of the invention are directed to a liquid crystal display device including a backlight unit and a method of driving the liquid crystal display device that substantially obviates one or more of the problems due to limitations and disadvantages of the related art.

An object of embodiments of the invention is to provide a liquid crystal display device and a method of driving the liquid crystal display device that prevents deteriorations in display quality, such as wavy noise.

Another object of embodiments of the invention is to provide a liquid crystal display device and a method of driving the liquid crystal display device by PWM driving of a backlight without reducing luminance of the backlight unit.

Additional features and advantages of embodiments of the invention will be set forth in the description which follows, and in part will be apparent from the description, or may be learned by practice of embodiments of the invention. The objectives and other advantages of the embodiments of the invention will be realized and attained by the structure particularly pointed out in the written description and claims hereof as well as the appended drawings.

To achieve these and other advantages and in accordance with the purpose of embodiments of the invention, as embodied and broadly described, a liquid crystal display device includes: a light emitting diode array unit including at least two groups of light emitting diode arrays for emitting light; a light emitting diode driving unit for supplying at least two pulse width modulation signals having different phases from each other to the at least two groups of light emitting diode arrays, respectively; a liquid crystal display panel for displaying images using the light from the light emitting diode array unit; and a timing controller for controlling the light emitting diode driving unit and the liquid crystal display panel.

In another aspect, a method of driving a liquid crystal display device includes: supplying at least two pulse width modulation signals having different phases from each other to at least two groups of light emitting diode arrays, respectively; providing light from the at least two groups of light emitting diode arrays according to the at least two pulse width modulation signals into liquid crystal display panel; and displaying images on the liquid crystal display panel using the light from the at least two groups of light emitting diode arrays.

It is to be understood that both the foregoing general description and the following detailed description are exemplary and explanatory and are intended to provide further explanation of embodiments of the invention as claimed.

BRIEF DESCRIPTION OF THE DRAWINGS

The accompanying drawings, which are included to provide a further understanding of embodiments of the invention and are incorporated in and constitute a part of this specification, illustrate embodiments of the invention and together with the description serve to explain the principles of embodiments of the invention.

The accompanying drawings, which are included to provide a further understanding of the invention and are incorporated in and constitute a part of this specification, illustrate embodiments of the invention.

DETAILED DESCRIPTION OF THE PREFERRED EMBODIMENTS

Reference will now be made in detail to embodiments which are illustrated in the accompanying drawings. Wherever possible, similar reference numbers will be used to refer to the same or similar parts.

Figure 2:
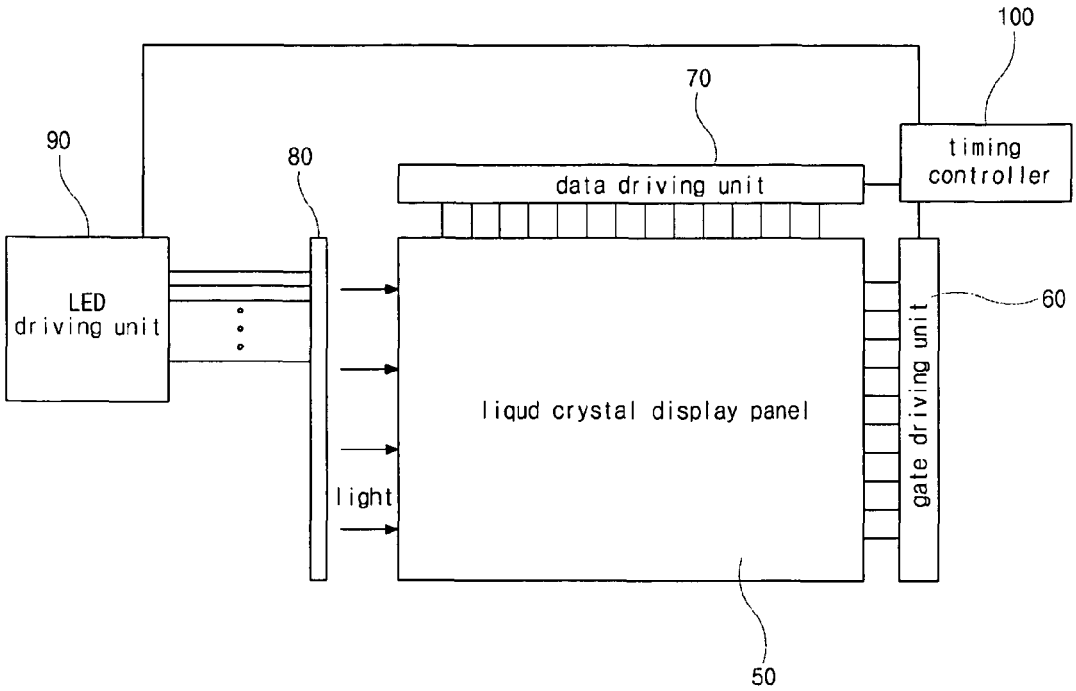
FIG. 2 is a block diagram showing a liquid crystal display device representative of embodiments of the invention.
Figure 3:
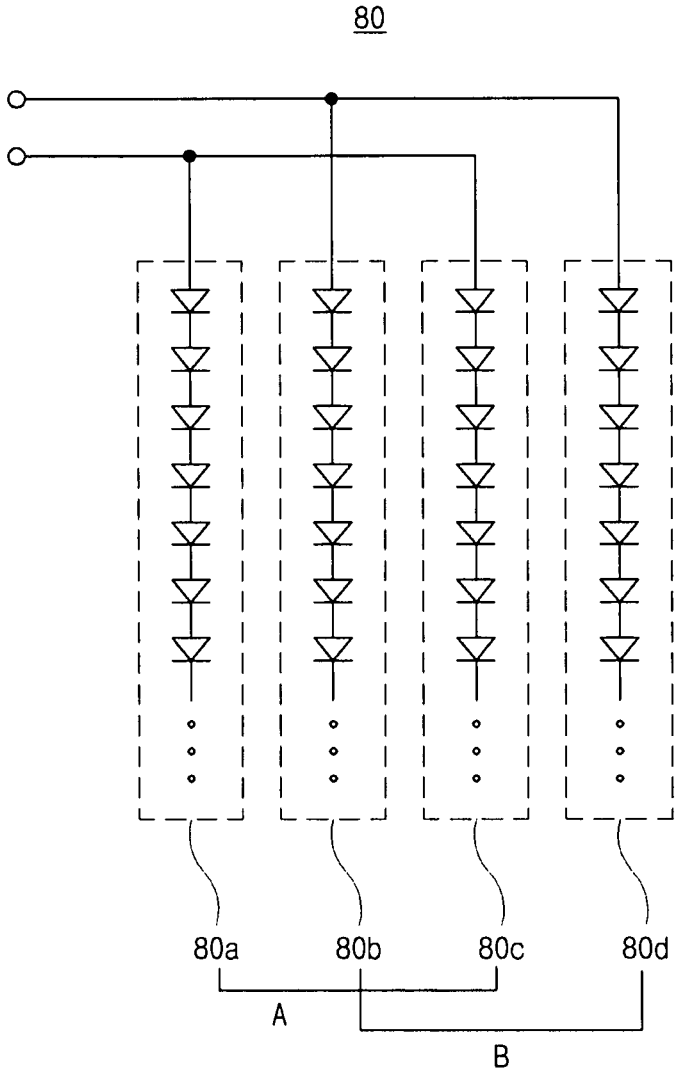
FIG. 3 is a block diagram showing a light emitting diode array unit of a backlight unit for the liquid crystal display device shown in FIG. 2.

FIG. 2 is a block diagram showing a liquid crystal display device representative of embodiments of the invention and FIG. 3 is a block diagram showing a light emitting diode array unit of a backlight unit for the liquid crystal display device shown in FIG. 2. As shown in FIG. 2, a liquid crystal display device includes a liquid crystal display panel 50, a gate driving unit 60, a data driving unit 70, a light emitting diode (LED) array unit 80, an LED driving unit 90 and a timing controller 100. Although not shown in FIG. 2, the liquid crystal display panel includes first and second substrates facing and spaced apart from each other with a liquid crystal layer interposed between the first and second substrates. FIG. 2 also does not show gate lines and data lines crossing each other on the first substrate to define pixel regions, nor a thin film transistor (TFT) in each pixel region connected to a gate line and a data line.

The gate driving unit 60 supplies gate signals to the gate lines to control ON/OFF of the TFTs in the pixel regions. The data driving unit 70 supplies data signals to the data lines in synchronization with the gate signals. As a result of this synchronization, the data signals are applied to the liquid crystal layers in the pixel regions through the TFTs so that the liquid crystal display panel 50 can display images.

As shown in FIG. 3, the LED array unit 80 includes a plurality of LED arrays 80*a*, 80*b*, 80*c* and 80*d*. Each LED array 80*a*, 80*b*, 80*c* and 80*d* includes a plurality of LEDs that can emit white-colored light. In an edge-type backlight unit, for example, the LED array unit 80 is disposed at a side of the liquid crystal display panel 50 so that the liquid crystal display device has a thin profile and light emission can be easily controlled. In a direct-type backlight unit, the LED array is disposed directly behind a liquid crystal display panel and supplies light upwardly toward the back of the liquid crystal panel 50.

The LED array unit 80 is separated into at least two groups in which at least two pulse width modulation (PWM) signals are respectively applied to the at least two groups in the plurality of LED arrays 80*a*, 80*b*, 80*c* and 80*d*. The at least two PWM signals are applied to the at least two groups, respectively such that a single PWM signal is applied to LED arrays belonging to a single group. The at least two groups can include the same number of LED arrays as each other or each group can have only one LED array. Accordingly, each PWM signal is applied to at least one LED array.

The LED arrays belonging to a single group are connected to each other through an electrical connection circuit. For example, the LED array unit 80 in FIG. 3 is separated into first and second groups A and B. The first group A includes first and third LED arrays 80*a* and 80*c*, and the second group B includes second and fourth LED arrays 80*b* and 80*d*. The first and second PWM signals PWM1 and PWM2 are supplied to the first and second groups A and B, respectively. Thus, the first PWM signal PWM1 is applied to the first and third LED arrays 80*a* and 80*c*, and the second PWM signal PWM2 is applied to the second and fourth LED arrays 80*b* and 80*d*.

Referring again to FIG. 2, the LED driving unit 90 supplies the at least two PWM signals to control light emission of the LED array unit 80. The LED driving unit 90 can either generate the at least two PWM signals or receive the at least two PWM signals from an external circuit (not shown). The at least two PWM signals can have the same frequency and voltage as each other but will have different phases from each other. For example, the at least two PWM signals can have phase differences of about 60°, about 90°, about 120° or about 180°. In addition, the LED driving unit 90 can include a phase shifter for generating the at least two PWM signals having different phases. The timing controller 100 generates a plurality of control signals to control the gate driving unit 60, the data driving unit 70 and the LED driving unit 90.

As shown in FIG. 3, the LED array unit 80 includes the plurality of LED arrays 80*a*, 80*b*, 80*c* and 80*d*, and the LED driving unit 90 for supplying two PWM signals to the plurality of LED arrays 80*a*, 80*b*, 80*c* and 80*d* to control light emission of each LED array. The plurality of LED arrays 80*a*, 80*b*, 80*c* and 80*d* are separated into two groups. Each of the LED arrays in a group of FIG. 3 are electrically connected and driven by a single PWM signal. Since the LED arrays belonging to the two groups are driven by two PWM signals having different phases, respectively, one of the LED arrays belonging to one of the two groups are turned ON at different times than the LED arrays belonging to the other of the two groups. Accordingly, the number of LED arrays turned ON at a one time by the two PWM signals is reduced and change in the instant luminance of the backlight unit is reduced, as compared to all of the LED arrays being turned ON at the same time by a single PWM signal. As a result of respectively driving at least two groups of arrays with at least two PWM signals, the deterioration in the display quality of the liquid crystal display panel, such as a wavy noise, due to variations in the OFF current of each TFT of the liquid crystal panel is improved without a reduction in overall brightness from the backlight unit.

Figure 4A:
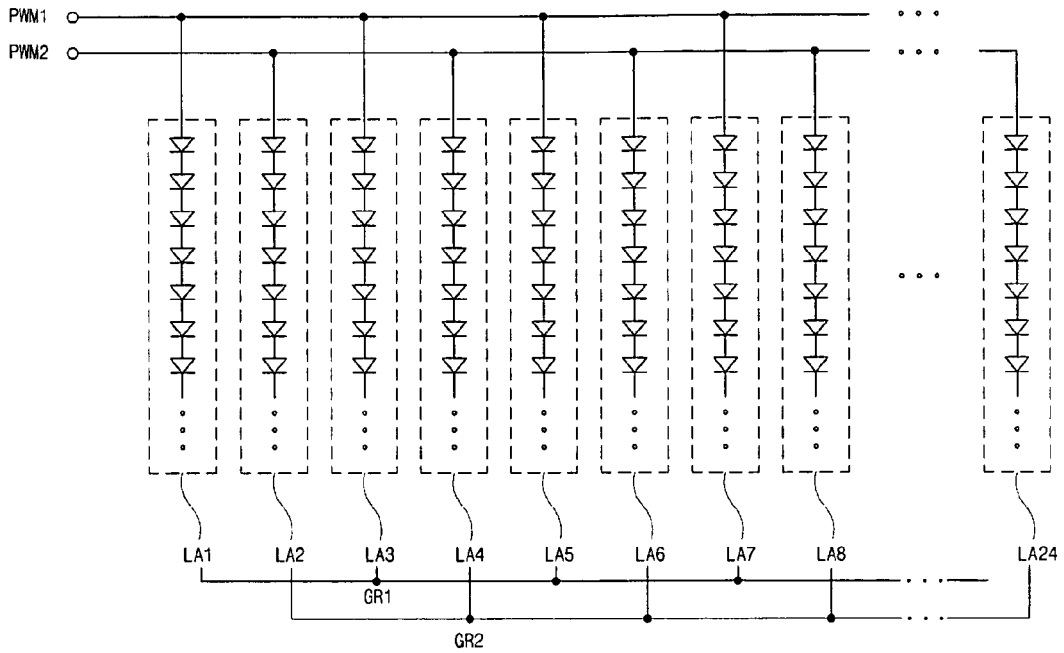
FIG. 4A is a block diagram of an LED array unit of a backlight unit for a liquid crystal display device according to an embodiment of the invention having two groups of arrays.
Figure 4B:
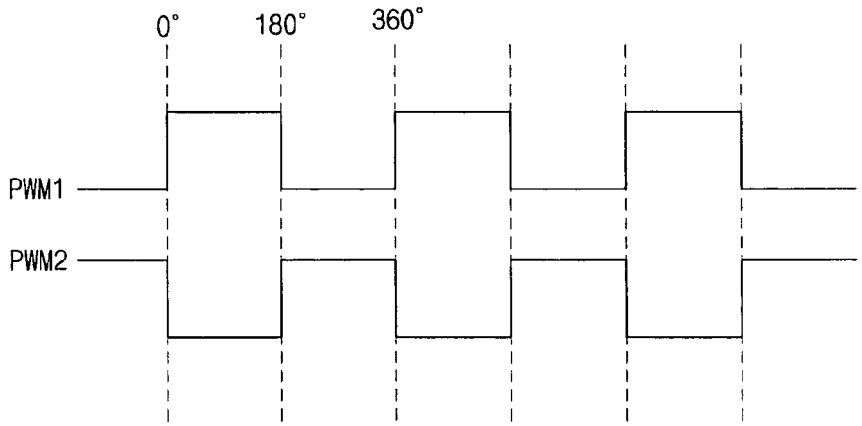
FIG. 4B is a timing chart of two PWM signals for the backlight unit shown in FIG. 4A.

FIG. 4A is a block diagram of an LED array unit of a backlight unit for a liquid crystal display device according to an embodiment of the invention having two groups of arrays. FIG. 4B is a timing chart of two PWM signals for the backlight unit shown in FIG. 4A. As shown in FIG. 4A, an LED array unit includes first to twenty-fourth LED arrays LA1 to LA24. The first to twenty-fourth LED arrays LA1 to LA24 are separated into first and second groups GR1 and GR2. As a result, the first, third, fifth . . . and twenty-third LED arrays LA1, LA3, LA5 . . . and LA23 of the first group GR1 are electrically connected to each other, and the second, fourth, sixth . . . and twenty-fourth LED arrays LA2, LA4, LA6 . . . and LA24 of the second group GR2 are electrically connected to each other. In addition, a first PWM signal PWM1 is supplied to the first, third, fifth . . . and twenty-third LED arrays LA1, LA3, LA5 . . . and LA23 of the first group GR1, and a second PWM signal PWM2 is supplied to the second, fourth, sixth . . . and twenty-fourth LED arrays LA2, LA4, LA6 . . . and LA24 of the second group GR2.

As shown in FIG. 4B, both the first and second PWM signals PWM1 and PWM2 have a duty ratio of about 50% and an identical frequency. In addition, since the phase difference between the first and second PWM signals PWM1 and PWM2 is about 180°, the first PWM signal PWM1 is an inverse to the second PWM signal PWM2. Although the duty ratio of the first and second PWM signals PWM1 and PWM2 of FIG. 4B is about 50%, the duty ratio of the at least two PWM signals can be selected from values in a range of about 1% to about 99%.

Because the first and second groups GR1 and GR2 are driven by the first and second PWM signals PWM1 and PWM2, respectively, the first, third, fifth . . . and twenty-third LED arrays LA1, LA3, LA5 . . . and LA23 of the first group GR1 are turned ON/OFF alternately with the second, fourth, sixth . . . and twenty-fourth LED arrays LA2, LA4, LA6 . . . and LA24 of the second group GR2. Accordingly, the first, third, fifth . . . and twenty-third LED arrays LA1, LA3, LA5 . . . and LA23 of the first group GR1 emit light at different timings from the second, fourth, sixth . . . and twenty-fourth LED arrays LA2, LA4, LA6 . . . and LA24 of the second group GR2. Since the number (i.e., 12) of the LED arrays emitting light at one time from the backlight unit using the first and second PWM signals PWM1 and PWM2 of FIG. 4B is smaller than the number (i.e., 24) of the LED arrays emitting light at one time of a related backlight unit using a single PWM signal, an instant luminance of the backlight unit using the first and second PWM signals PWM1 and PWM2 is about half of an instant luminance of the backlight unit using the single PWM signal. As a result, the variation in the OFF current of each TFT in the liquid crystal display panel is reduced due to reducing the change in the instant luminance of the incident light from the backlight unit. Thus, deterioration in the display quality of the liquid crystal display panel, such as a wavy noise, due to the variation in the OFF current of each TFT is improved.

Although an instant luminance of the first to twenty-fourth LED arrays LA1 to LA24 alternately turned ON/OFF by the first and second PWM signals PWM1 and PWM2 can be about half of the instant luminance of first to twenty-fourth LED arrays LA1 to LA24 simultaneously turned ON/OFF by a single PWM signal, total luminance of the first to twenty-fourth LED arrays LA1 to LA24 alternately turned ON/OFF is substantially the same as the total luminance of the first to twenty-fourth LED arrays LA1 to LA24 simultaneously turned ON/OFF because the backlight unit using the first and second PWM signals PWM1 and PWM2 emits light more frequently. Accordingly, the LCD device having the backlight unit according to embodiments of the invention has no reduction in brightness, as compared to an LCD device having the related art backlight unit.

Figure 5A:
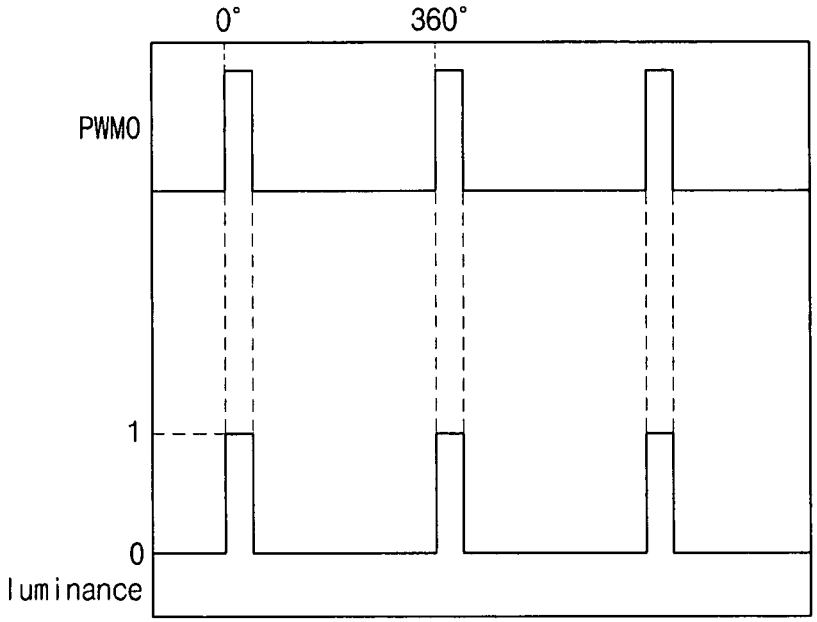
FIG. 5A shows the resulting luminance for a related art backlight unit from a single PWM signal having a duty ratio of about 10%.
Figure 5B:
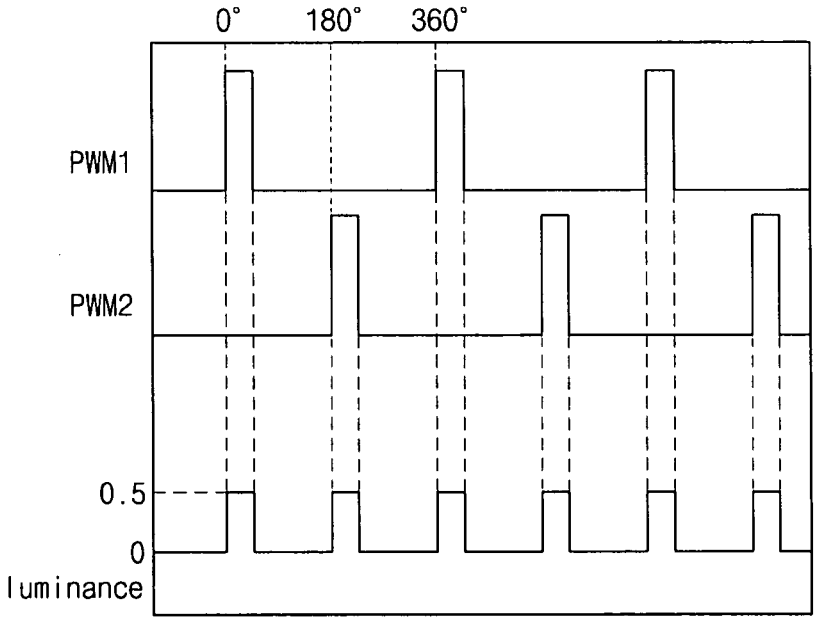
FIG. 5B shows the resulting luminance for the backlight unit shown in FIG. 4A from two PWM signals having a phase difference of about 180° and a duty ratio of about 10%.

The backlight unit according to embodiments of the invention can have various duty ratios. FIG. 5A shows the resulting luminance for a related art backlight unit from a single PWM signal having a duty ratio of about 10%. FIG. 5B shows the resulting luminance for the backlight unit shown in FIG. 4A from two PWM signals having a phase difference of about 180° and a duty ratio of about 10%. As shown in FIG. 5A, a single zeroth PWM signal PWM0 having a duty ratio of about 10% can be supplied to a related art backlight unit having first to twenty-fourth LED arrays LA1 to LA24. The single zeroth PWM signal PWM0 of FIG. 5A has a predetermined frequency and a predetermined voltage. Since the first to twenty-fourth LED arrays LA1 to LA24 are simultaneously turned ON/OFF according to the zeroth PWM signal PWM0 of FIG. 5A, the luminance of the first to twenty-fourth LED arrays LA1 to LA24 has a value of 0 or 1. The luminance can be measured as an electric signal by using a photo diode. The maximum and minimum values in luminance are represented as 1 and 0, respectively, for comparison purposes.

As shown in FIG. 5B, first and second PWM signals PWM1 and PWM2 each having a duty ratio of about 10% are supplied to a backlight unit of FIG. 4A having first to twenty-fourth LED arrays LA1 to LA24. As a result, the first, third, fifth . . . and twenty-third LED arrays LA1, LA3, LA5 . . . and LA23 of a first group GR1 of FIG. 4A are turned ON/OFF according to the first PWM signal PWM1 of FIG. 5B, and the second, fourth, sixth . . . and twenty-fourth LED arrays LA2, LA4, LA6 . . . and LA24 of FIG. 4A of a second group GR2 of FIG. 4A are turned ON/OFF according to the second PWM signal PWM2 of FIG. 5B.

The first and second PWM signals PWM1 and PWM2 of FIG. 5B have the same frequency, the same voltage and the same duty ratio as the single zeroth PWM signal PWM0 in FIG. 5A. In addition, the first and second PWM signals PWM1 and PWM2 of FIG. 5B have a phase difference of about 180°. Accordingly, the first, third, fifth . . . and twenty-third LED arrays LA1, LA3, LA5 . . . and LA23 of the first group GR1 are alternately turned ON/OFF with the second, fourth, sixth . . . and twenty-fourth LED arrays LA2, LA4, LA6 . . . and LA24 of the second group GR2.

In the instant of emitting light, since the number (i.e., 12) of emitting LED arrays of the backlight unit in FIG. 4A by one of the first and second PWM signals PWM1 and PWM2 of FIG. 5B is half of the number (i.e., 24) of emitting LED arrays in a related art backlight unit driven by the zeroth PWM signal PWM0 of FIG. 5A, the instant luminance of the backlight unit of FIG. 4A driven by one of the first and second PWM signals PWM1 and PWM2 of FIG. 5B is substantially half of the instant luminance of the related art backlight unit driven by the zeroth PWM signal PWM0 of FIG. 5A. During a predetermined time period, however, the number of emission times of the backlight unit of FIG. 4A driven by the first and second PWM signals PWM1 and PWM2 of FIG. 5B is twice the number of emission times of the related art backlight unit driven by the zeroth PWM signal PWM0 of FIG. 5A. Thus, the total luminance of the backlight unit of FIG. 4A driven by the first and second PWM signals PWM1 and PWM2 of FIG. 5B is substantially the same as the total luminance of the related art backlight unit driven by only the single PWM signal of FIG. 5A. In FIGS. 5A and 5B, the total luminance is calculated from the sum of areas corresponding to protruding rectangles of the luminance graph.

Figure 6A:
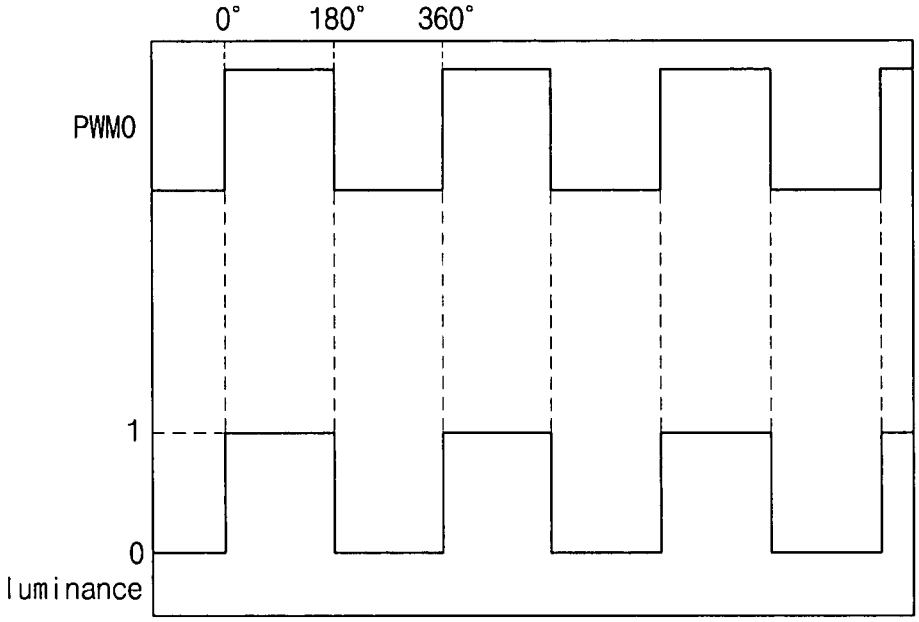
FIG. 6A shows the resulting luminance for a related art backlight unit from a single PWM signal having a duty ratio of about 50%.
Figure 6B:
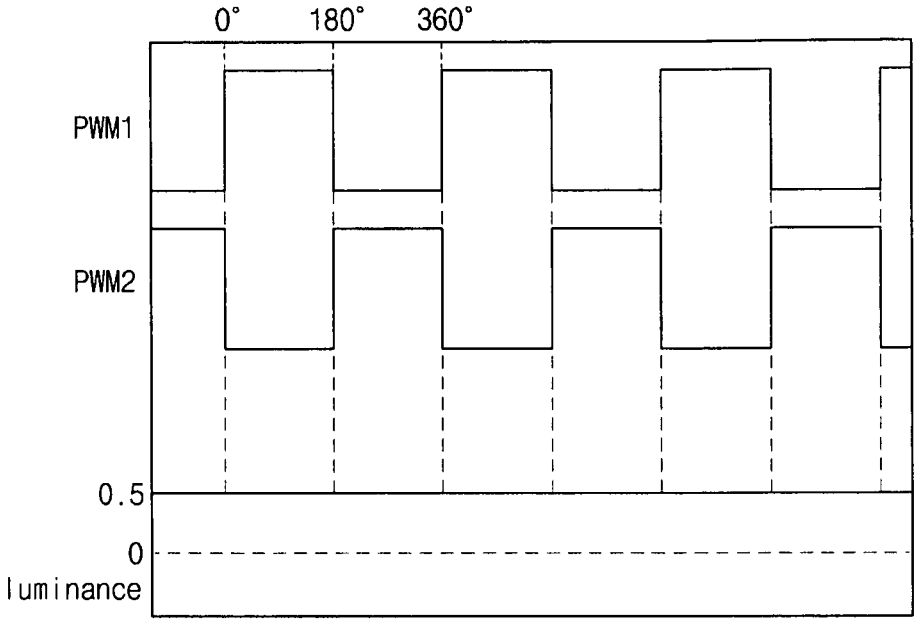
FIG. 6B shows resulting luminance for the backlight unit shown in FIG. 4A from two PWM signals having a phase difference of about 180° and a duty ratio of about 50%.

FIG. 6A shows the resulting luminance for a related art backlight unit from a single PWM signal having a duty ratio of about 50%. FIG. 6B shows resulting luminance for the backlight unit shown in FIG. 4A from two PWM signals having a phase difference of about 180° and a duty ratio of about 50%. As shown in FIG. 6A, a single zeroth PWM signal PWM0 having a duty ratio of about 50% can be supplied to a related art backlight unit having first to twenty-fourth LED arrays LA1 to LA24. The single zeroth PWM signal PWM0 of FIG. 6A has a predetermined frequency and a predetermined voltage. Since the first to twenty-fourth LED arrays LA1 to LA24 are simultaneously turned ON/OFF according to the zeroth PWM signal PWM0 of FIG. 6A, the luminance of the first to twenty-fourth LED arrays LA1 to LA24 has a value of 0 or 1. The luminance is measured as an electric signal by using a photo diode. The maximum and minimum values in luminance are represented as 1 and 0, respectively, for comparison.

As shown in FIG. 6B, first and second PWM signals PWM1 and PWM2 each having a duty ratio of about 50% are supplied to the backlight unit in FIG. 4A having first to twenty-fourth LED arrays LA1 to LA24. As a result, the first, third, fifth . . . and twenty-third LED arrays LA1, LA3, LA5 . . . and LA23 of a first group GR1 of FIG. 4A are turned ON/OFF according to the first PWM signal PWM1 of FIG. 6B, and the second, fourth, sixth . . . and twenty-fourth LED arrays LA2, LA4, LA6 . . . and LA24 of a second group GR2 of FIG. 4A are turned ON/OFF according to the second PWM signal PWM2 of FIG. 6B.

The first and second PWM signals PWM1 and PWM2 of FIG. 6B have the same frequency, the same voltage and the same duty ratio as the single zeroth PWM signal PWM0 of FIG. 6A. In addition, the first and second PWM signals PWM1 and PWM2 of FIG. 6B have a phase difference of about 180°. Accordingly, the first, third, fifth . . . and twenty-third LED arrays LA1, LA3, LA5 . . . and LA23 of the first group GR1 are alternately turned ON/OFF with the second, fourth, sixth . . . and twenty-fourth LED arrays LA2, LA4, LA6 . . . and LA24 of the second group GR2.

In the instant of emitting light, since the number (i.e., 12) of emitting LED arrays of the backlight unit in FIG. 4A by one of the first and second PWM signals PWM1 and PWM2 of FIG. 6B is half of the number (i.e., 24) of emitting LED arrays in the related art backlight unit driven by the zeroth PWM signal PWM0 of FIG. 6A, the instant luminance of the backlight unit of FIG. 4A driven by one of the first and second PWM signals PWM1 and PWM2 of FIG. 6B is substantially half of the instant luminance of the related art backlight unit driven by the zeroth PWM signal PWM0 of FIG. 6A. During a predetermined time period, however, the number of emission times of the backlight unit of FIG. 4A driven by the first and second PWM signals PWM1 and PWM2 of FIG. 6B is twice the number of emission times of the related art backlight unit driven by the zeroth PWM signal PWM0 of FIG. 6A. Thus, the total luminance of the backlight unit of FIG. 4A driven by the first and second PWM signals PWM1 and PWM2 of FIG. 6B is substantially the same as the total luminance of the related art backlight unit driven by only the single PWM signal of FIG. 6A. In FIGS. 6A and 6B, the total luminance is calculated from the sum of areas corresponding to protruding rectangles of the luminance graph.

Specifically, since the instant luminance of the backlight unit of FIG. 6B is a constant value of about 0.5 at any timing of the whole time period, the backlight unit supplies light without a variation in luminance to the liquid crystal display panel. As a result, the variation in the OFF current of each TFT of the liquid crystal display panel is eliminated so that deterioration in the image display quality of the liquid crystal display panel, such as a wavy noise, is prevented.

Figure 7A:
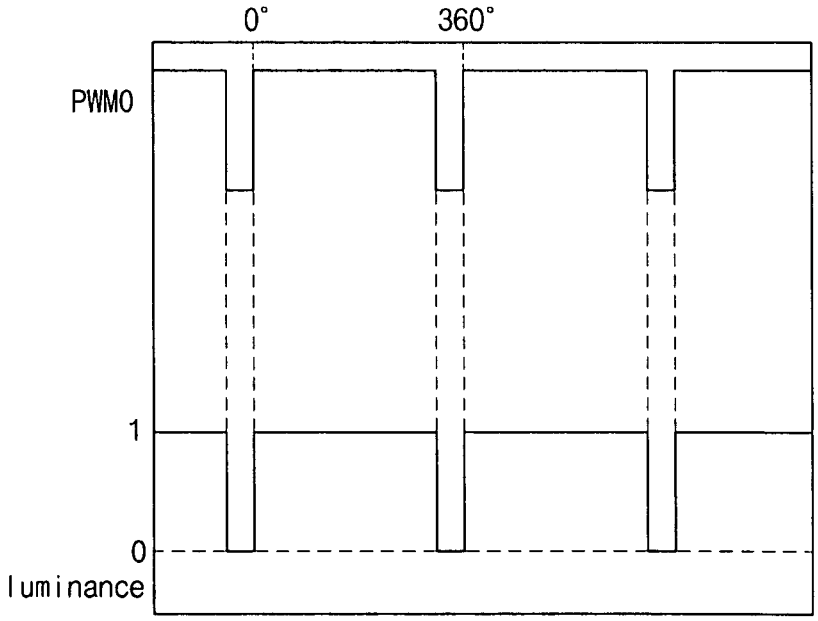
FIG. 7A shows the resulting luminance for a related art backlight unit from a single PWM signal having a duty ratio of about 90%.
Figure 7B:
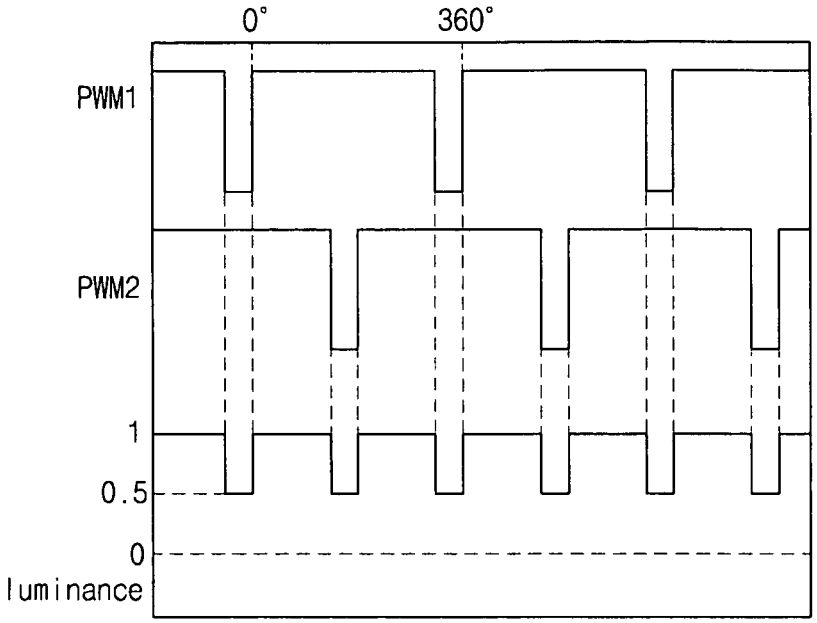
FIG. 7B shows the resulting luminance for the backlight unit shown in FIG. 4A from two PWM signals having a phase difference of about 180° and a duty ratio of about 90%.

FIG. 7A shows the resulting luminance for a related art backlight unit from a single PWM signal having a duty ratio of about 90%. FIG. 7B shows the resulting luminance for the backlight unit shown in FIG. 4A from two PWM signals having a phase difference of about 180° and a duty ratio of about 90%. As shown in FIG. 7A, a single zeroth PWM signal PWM0 having a duty ratio of about 90% is supplied to a related art backlight unit having first to twenty-fourth LED arrays LA1 to LA24. The single zeroth PWM signal PWM0 of FIG. 7A has a predetermined frequency and a predetermined voltage. Since the first to twenty-fourth LED arrays LA1 to LA24 are simultaneously turned ON/OFF according to the zeroth PWM signal PWM0 of FIG. 7A, the luminance of the first to twenty-fourth LED arrays LA1 to LA24 has a value of 0 or 1. The luminance may be measured as an electric signal by using a photo diode. The maximum and minimum values in luminance are represented as 1 and 0, respectively, for comparison purposes.

As shown in FIG. 7B, first and second PWM signals PWM1 and PWM2 each having a duty ratio of about 90% are supplied to a backlight unit in FIG. 4A having first to twenty-fourth LED arrays LA1 to LA24. As a result, the first, third, fifth . . . and twenty-third LED arrays LA1, LA3, LA5 . . . and LA23 of a first group GR1 of FIG. 4A are turned ON/OFF according to the first PWM signal PWM1 of FIG. 7B, and the second, fourth, sixth . . . and twenty-fourth LED arrays LA2, LA4, LA6 . . . and LA24 of a second group GR2 of FIG. 4A are turned ON/OFF according to the second PWM signal PWM2 of FIG. 7B.

The first and second PWM signals PWM1 and PWM2 of FIG. 7B have the same frequency, the same voltage and the same duty ratio as the single zeroth PWM signal PWM0 of FIG. 7A. In addition, the first and second PWM signals PWM1 and PWM2 have a phase difference of about 180°. Accordingly, the first, third, fifth . . . and twenty-third LED arrays LA1, LA3, LA5 . . . and LA23 of the first group GR1 are alternately turned ON/OFF with the second, fourth, sixth . . . and twenty-fourth LED arrays LA2, LA4, LA6 . . . and LA24 of the second group GR2.

In the instant of emitting light, since the number (i.e., 12) of emitting LED arrays of the backlight unit in FIG. 4A by one of the first and second PWM signals PWM1 and PWM2 of FIG. 7B is half of the number (i.e., 24) of emitting LED arrays in the related art backlight unit driven by the zeroth PWM signal PWM0 of FIG. 7A, the instant luminance of the backlight unit of FIG. 4A driven by one of the first and second PWM signals PWM1 and PWM2 of FIG. 7B is substantially half of the instant luminance of the related art backlight unit driven by the zeroth PWM signal PWM0 of FIG. 7A. During a predetermined time period, however, the number of emission times of the backlight unit of FIG. 4A driven by the first and second PWM signals PWM1 and PWM2 of FIG. 7B is twice the number of emission times of the related art backlight unit driven by the zeroth PWM signal PWM0 of FIG. 7A. Thus, the total luminance of the backlight unit of FIG. 4A driven by the first and second PWM signals PWM1 and PWM2 of FIG. 7B is substantially the same as the total luminance of the related art backlight unit driven by only the single PWM signal of FIG. 7A. In FIGS. 7A and 7B, the total luminance is calculated from the sum of areas corresponding to protruding rectangles of the luminance graph.

In the backlight unit of FIG. 4A, a plurality of LED arrays are separated into two groups driven by two PWM signals having phase differences, as shown in FIGS. 5B, 6B and 7B. As a result, deterioration in the image display quality of the liquid crystal display panel, such as a wavy noise, due to the variation in the OFF current of each TFT of the liquid crystal display panel is prevented without a reduction in total luminance.

Figure 8A:
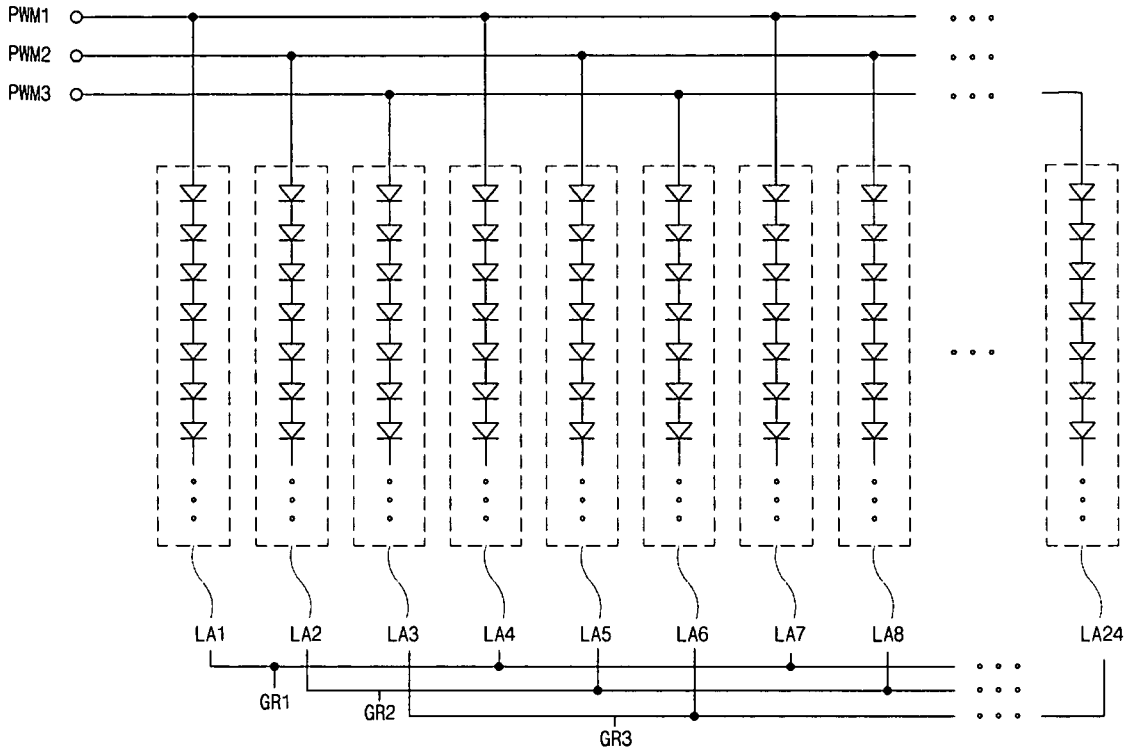
FIG. 8A is a block diagram of an LED array unit of a backlight unit for a liquid crystal display device according to an embodiment of the invention having three groups of arrays.
Figure 8B:
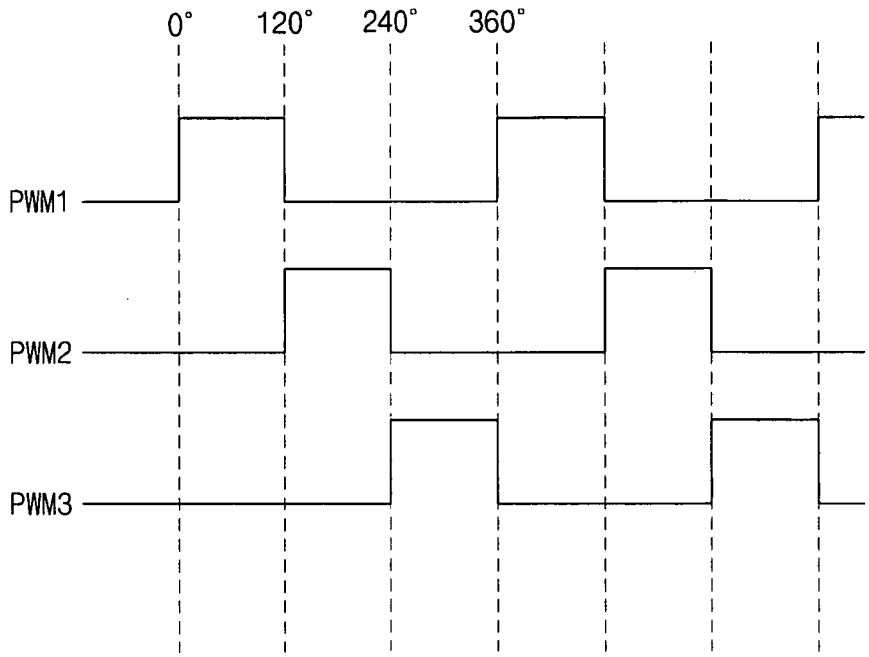
FIG. 8B is a timing chart of three PWM signals for the backlight unit shown in FIG. 8A.

FIG. 8A is a block diagram of an LED array unit of a backlight unit for a liquid crystal display device according to an embodiment of the invention having three groups of arrays and FIG. 8B is a timing chart of three PWM signals for the backlight unit shown in FIG. 8A. As shown in FIG. 8A, an LED array unit includes first to twenty-fourth LED arrays LA1 to LA24. The first to twenty-fourth LED arrays LA1 to LA24 are separated into first, second and third groups GR1, GR2 and GR3. The first, fourth, seventh . . . and twenty-second LED arrays LA1, LA4, LA7 . . . and LA22 of the first group GR1 are electrically connected to each other. Similarly, the second, fifth, eighth . . . and twenty-third LED arrays LA2, LA4, LA8 . . . and LA23 of the second group GR2 are electrically connected to each other, and the third, sixth, ninth . . . and twenty-fourth LED arrays LA3, LA6, LA9 . . . and LA24 of the third group GR3 are electrically connected to each other. In addition, a first PWM signal PWM1 is supplied to the first, fourth, seventh . . . and twenty-second LED arrays LA1, LA4, LA7 . . . and LA22 of the first group GR1, a second PWM signal PWM2 is supplied to the second, fifth, eighth . . . and twenty-third LED arrays LA2, LA4, LA8 . . . and LA23 of the second group GR2, and a third PWM signal PWM3 is supplied to the third, sixth, ninth . . . and twenty-fourth LED arrays LA3, LA6, LA9 . . . and LA24 of the third group GR3.

As shown in FIG. 8B, the first, second and third PWM signals PWM1, PWM2 and PWM3 have a duty ratio of about 33% and an identical frequency. In addition, the phase difference between two of the first, second and third PWM signals PWM1, PWM2 and PWM3 is about 120°. Although the duty ratio of the first, second and third PWM signals PWM1, PWM2 and PWM3 of FIG. 8B is about 33%, the duty ratio of the first, second and third PWM signals PWM1, PWM2 and PWM3 can be selected from values in a range of about 1% to about 99%.

Because the first, second and third groups GR1, GR2 and GR3 are driven by the first, second and third PWM signals PWM1, PWM2 and PWM3, respectively, the first group GR1 including the first, fourth, seventh . . . and twenty-second LED arrays LA1, LA4, LA7 . . . and LA22, the second group GR2 including the second, fifth, eighth . . . and twenty-third LED arrays LA2, LA4, LA8 . . . and LA23 and the third group GR3 including the third, sixth, ninth . . . and twenty-fourth LED arrays LA3, LA6, LA9 . . . and LA24 are turned ON/OFF alternately with one another. Accordingly, the second, fifth, eighth . . . and twenty-third LED arrays LA2, LA4, LA8 . . .

and LA23 of the second group GR2 are turned ON after the first, fourth, seventh . . . and twenty-second LED arrays LA1, LA4, LA7 . . . and LA22 of the first group GR1 are turned OFF, and the third, sixth, ninth . . . and twenty-fourth LED arrays LA3, LA6, LA9 . . . and LA24 of the third group GR3 are turned ON after second, fifth, eighth . . . and twenty-third LED arrays LA2, LA4, LA8 . . . and LA23 of the second group GR2 are turned OFF. In addition, after the third, sixth, ninth . . . and twenty-fourth LED arrays LA3, LA6, LA9 . . . and LA24 of the third group GR3 are turned OFF, the first, fourth, seventh . . . and twenty-second LED arrays LA1, LA4, LA7 . . . and LA22 of the first group GR1 are turned ON again. Since the number (i.e., 8) of the LED arrays emitting light at one time of a backlight unit using the first, second and third PWM signals PWM1, PWM2 and PWM3 of FIG. 8A is smaller than the number (i.e., 24) of the LED arrays emitting light at one time of a related art backlight unit using a single PWM signal of FIG. 1, an instant luminance of the backlight unit using the first, second and third PWM signals PWM1, PWM2 and PWM3 is about one third of an instant luminance of the backlight unit using the single PWM signal. As a result, the variation in the OFF current of each TFT in the liquid crystal display panel is reduced due to reducing the change in the instant luminance of the incident light from the backlight unit. Thus, deterioration in the display quality of the liquid crystal display panel, such as a wavy noise, due to the variation in the OFF current of each TFT is prevented.

Although the instant luminance of the first to twenty-fourth LED arrays LA1 to LA24 alternately turned ON/OFF by the first, second and third PWM signals PWM1, PWM2 and PWM3 is about one third of the instant luminance of the first to twenty-fourth LED arrays LA1 to LA24 simultaneously turned ON/OFF by the single PWM signal, a total luminance of the first to twenty-fourth LED arrays LA1 to LA24 alternately turned ON/OFF is substantially the same as a total luminance of the first to twenty-fourth LED arrays LA1 to LA24 simultaneously turned ON/OFF because the backlight unit using the first, second and third PWM signals PWM1, PWM2 and PWM3 emits light more frequently. Accordingly, the LCD device having the backlight unit according to embodiments of the invention has no reduction in brightness as compared to an LCD device having the related art backlight unit.

Figure 9A:
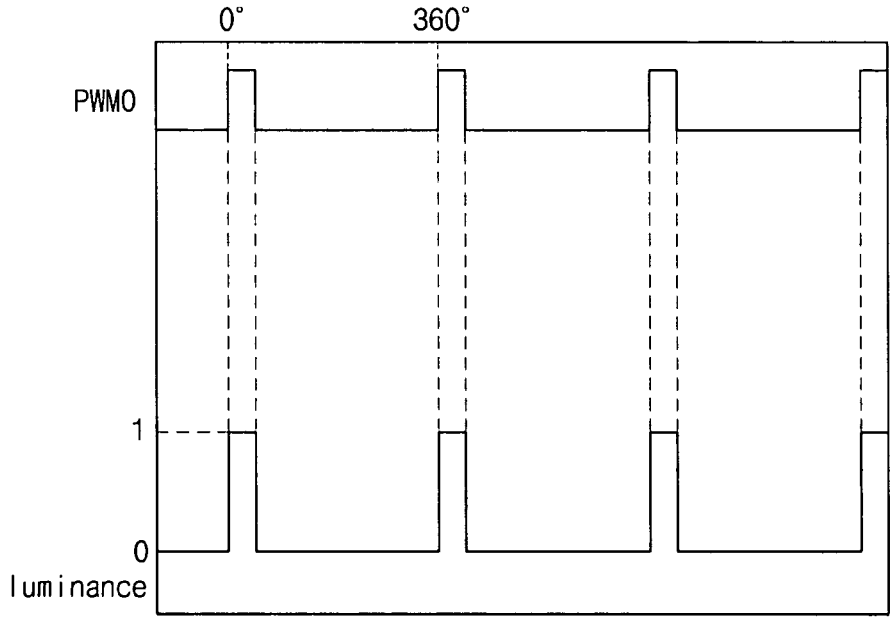
FIG. 9A shows the resulting luminance for a related art backlight unit from a single PWM signal having a duty ratio of about 10%.
Figure 9B:
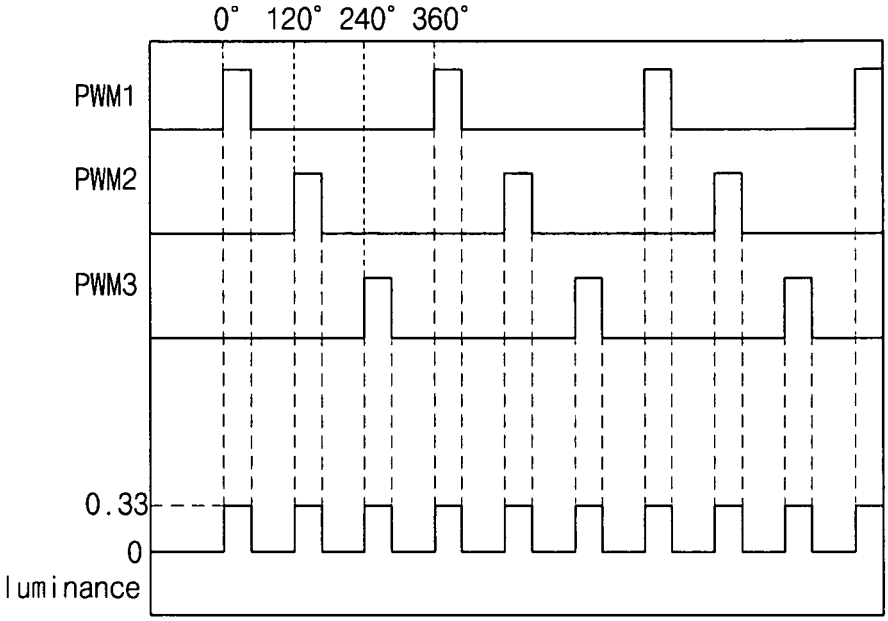
FIG. 9B shows the resulting luminance for the backlight unit shown in FIG. 8A from three PWM signals having a phase difference of about 120° and a duty ratio of about 10%.

FIG. 9A shows the resulting luminance for a related art backlight unit from a single PWM signal having a duty ratio of about 10%. FIG. 9B shows the resulting luminance for the backlight unit shown in FIG. 8A from three PWM signals having a phase difference of about 120° and a duty ratio of about 10%. As shown in FIG. 9A, a single zeroth PWM signal PWM0 having a duty ratio of about 10% is supplied to a comparison purposes backlight unit having first to twenty-fourth LED arrays LA1 to LA24. The single zeroth PWM signal PWM0 of FIG. 9A has a predetermined frequency and a predetermined voltage. Since the first to twenty-fourth LED arrays LA1 to LA24 are simultaneously turned ON/OFF according to the zeroth PWM signal PWM0 of FIG. 9A, the luminance of the first to twenty-fourth LED arrays LA1 to LA24 has a value of 0 or 1. The luminance may be measured as an electric signal by using a photo diode. The maximum and minimum values in luminance are represented as 1 and 0, respectively, for comparison purposes.

As shown in FIG. 9B, first, second and third PWM signals PWM1, PWM2 and PWM3 each having a duty ratio of about 10% are supplied to a backlight unit of FIG. 8A having first to twenty-fourth LED arrays LA1 to LA24 according to another embodiment of the present invention. As a result, the first, fourth, seventh . . . and twenty-second LED arrays LA1, LA4, LA7 . . . and LA22 of a first group GR1 of FIG. 8A are turned ON/OFF according to the first PWM signal PWM1, the second, fifth, eighth . . . and twenty-third LED arrays LA2, LA4, LA8 . . . and LA23 of the second group GR2 of FIG. 8A are turned ON/OFF according to the second PWM signal PWM2, and the third, sixth, ninth . . . and twenty-fourth LED arrays LA3, LA6, LA9 . . . and LA24 of the third group GR3 of FIG. 8A are turned ON/OFF according to the third PWM signal PWM3.

The first, second and third PWM signals PWM1, PWM2 and PWM3 have the same frequency, the same voltage and the same duty ratio as the single zeroth PWM signal PWM0 of FIG. 9A. In addition, the first, second and third PWM signals PWM1, PWM2 and PWM3 have a phase difference of about 120° with one another. As a result, the second PWM signal PWM2 has a phase delayed by about 120° with respect to the first PWM signal PWM1, and the third PWM signal PWM3 has a phase delayed by about 240° with respect to the first PWM signal PWM1. Accordingly, the first group GR1 including first, fourth, seventh . . . and twenty-second LED arrays LA1, LA4, LA7 . . . and LA22, the second group GR2 including the second, fifth, eighth . . . and twenty-third LED arrays LA2, LA4, LA8 . . . and LA23 and the third group GR3 including the third, sixth, ninth . . . and twenty-fourth LED arrays LA3, LA6, LA9 . . . and LA24 are alternately turned ON/OFF.

In the instant of emitting light, since the number (i.e., 8) of emitting LED arrays of the backlight unit of FIG. 8A driven by one of the first, second and third PWM signals PWM1, PWM2 and PWM3 of FIG. 9B is one third of the number (i.e., 24) of emitting LED arrays of the related art backlight unit driven by the zeroth PWM signal PWM0 of FIG. 9A, the instant luminance of the backlight unit of FIG. 8A driven by one of the first, second and third PWM signals PWM1, PWM2 and PWM3 of FIG. 9B is substantially a third of the instant luminance of the related art backlight unit driven by the zeroth PWM signal PWM0 of FIG. 9A. During a predetermined time period, however, the number of emission times of the backlight unit of FIG. 8A driven by the first, second and third PWM signals PWM1, PWM2 and PWM3 of FIG. 9B is three times the number of emission times of a related art backlight unit driven by the zeroth PWM signal PWM0 of FIG. 9A. Thus, the total luminance of the backlight unit driven by the first, second and third PWM signals PWM1, PWM2 and PWM3 of FIG. 9B is substantially the same total luminance as the related art backlight unit driven by only the single PWM signal of FIG. 9A. In FIGS. 9A and 9B, the total luminance is calculated from the sum of areas corresponding to protruding rectangles of the luminance graph.

Figure 10A:
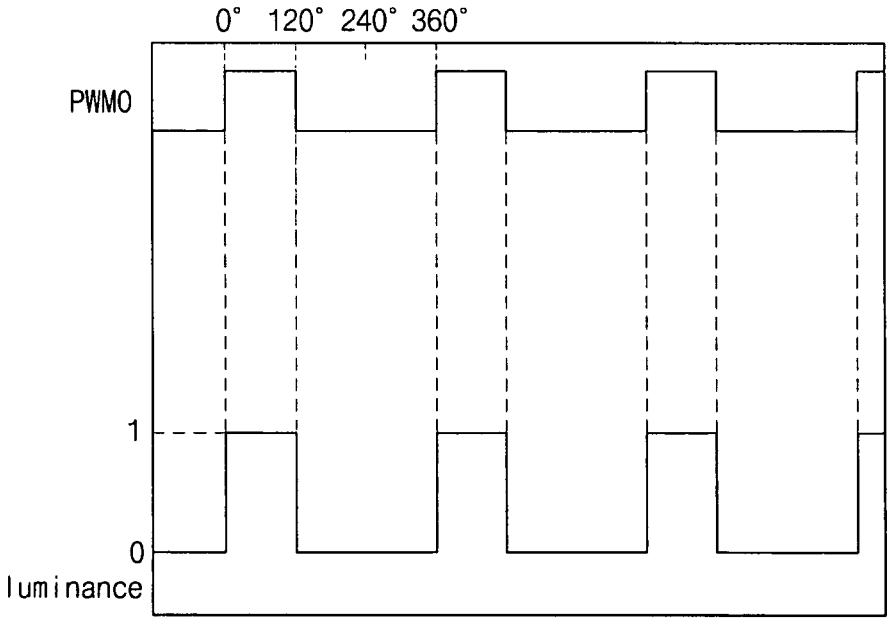
FIG. 10A shows the resulting luminance for a related art backlight unit from a single PWM signal having a duty ratio of about 33.3%.
Figure 10B:
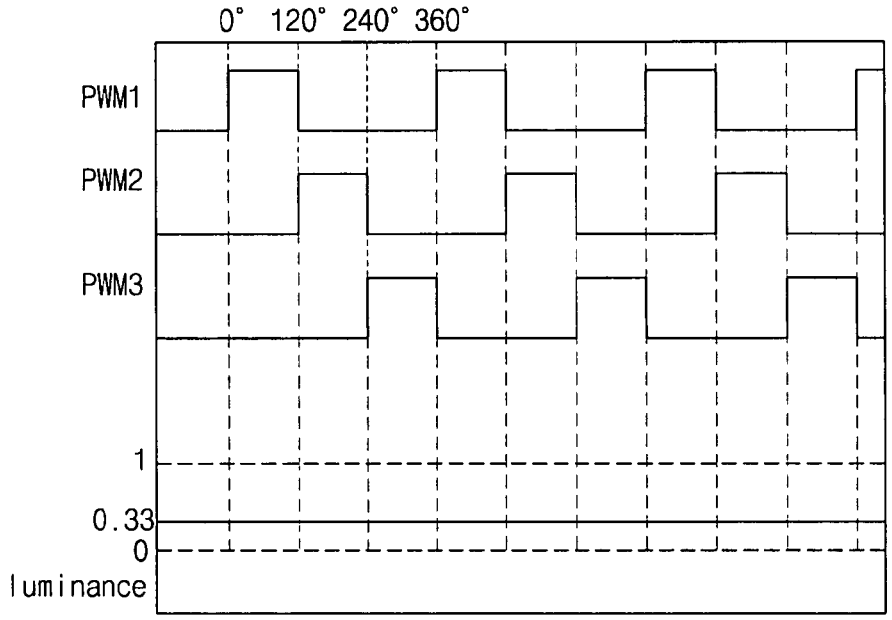
FIG. 10B shows the resulting luminance for the backlight unit shown in FIG. 8A from three PWM signals having a phase difference of about 120° and a duty ratio of about 33.3%.

FIG. 10A shows the resulting luminance for a related art backlight unit from a single PWM signal having a duty ratio of about 33.3%. FIG. 10B shows the resulting luminance for the backlight unit shown in FIG. 8A from three PWM signals having a phase difference of about 120° and a duty ratio of about 33.3%. As shown in FIG. 10A, a single zeroth PWM signal PWM0 having a duty ratio of about 33.3% is supplied to a related art backlight unit having first to twenty-fourth LED arrays LA1 to LA24. The single zeroth PWM signal PWM0 has a predetermined frequency and a predetermined voltage. Since the first to twenty-fourth LED arrays LA1 to LA24 are simultaneously turned ON/OFF according to the zeroth PWM signal PWM0 of FIG. 10A, the luminance of the first to twenty-fourth LED arrays LA1 to LA24 has a value of 0 or 1. The luminance may be measured as an electric signal by using a photo diode. The maximum and minimum values in luminance are represented as 1 and 0, respectively, for comparison purposes.

As shown in FIG. 10B, first, second and third PWM signals PWM1, PWM2 and PWM3 each having a duty ratio of about 33.3% are supplied to a backlight unit of FIG. 8A having first to twenty-fourth LED arrays LA1 to LA24. As a result, the first, fourth, seventh . . . and twenty-second LED arrays LA1, LA4, LA7 . . . and LA22 of a first group GR1 of FIG. 8A are turned ON/OFF according to the first PWM signal PWM1, the second, fifth, eighth . . . and twenty-third LED arrays LA2, LA4, LA8 . . . and LA23 of the second group GR2 of FIG. 8A are turned ON/OFF according to the second PWM signal PWM2, and the third, sixth, ninth . . . and twenty-fourth LED arrays LA3, LA6, LA9 . . . and LA24 of the third group GR3 of FIG. 8A are turned ON/OFF according to the third PWM signal PWM3.

The first, second and third PWM signals PWM1, PWM2 and PWM3 have the same frequency, the same voltage and the same duty ratio as the zeroth PWM signal PWM0 of FIG. 10A. In addition, the first, second and third PWM signals PWM1, PWM2 and PWM3 have a phase difference of about 120° with one another. As a result, the second PWM signal PWM2 has a phase delayed by about 120° with respect to the first PWM signal PWM1, and the third PWM signal PWM3 has a phase delayed by about 240° with respect to the first PWM signal PWM1. Accordingly, the first group GR1 including first, fourth, seventh . . . and twenty-second LED arrays LA1, LA4, LA7 . . . and LA22, the second group GR2 including the second, fifth, eighth . . . and twenty-third LED arrays LA2, LA4, LA8 . . . and LA23 and the third group GR3 including the third, sixth, ninth . . . and twenty-fourth LED arrays LA3, LA6, LA9 . . . and LA24 are alternately turned ON/OFF.

In the instant of emitting light, since the number (i.e., 8) of emitting LED arrays of the backlight unit of FIG. 8A driven by one of the first, second and third PWM signals PWM1, PWM2 and PWM3 of FIG. 10B is one third of the number (i.e., 24) of emitting LED arrays of the related art backlight unit driven by the zeroth PWM signal PWM0 of FIG. 10A, the instant luminance of the backlight unit of FIG. 8A driven by one of the first, second and third PWM signals PWM1, PWM2 and PWM3 of FIG. 10B is substantially a third of the instant luminance of the related art backlight unit driven by the zeroth PWM signal PWM0 of FIG. 10A. During a predetermined time period, however, the number of emission times of the backlight unit of FIG. 8A driven by the first, second and third PWM signals PWM1, PWM2 and PWM3 of FIG. 10B is three times the number of emission times of a related art backlight unit driven by the zeroth PWM signal PWM0 of FIG. 10A. Thus, the total luminance of the backlight unit driven by the first, second and third PWM signals PWM1, PWM2 and PWM3 of FIG. 10B is substantially the same total luminance as the related art backlight unit driven by only the single PWM signal of FIG. 10A. In FIGS. 10A and 10B, the total luminance is calculated from the sum of areas corresponding to protruding rectangles of the luminance graph.

Specifically, since the instant luminance of the backlight unit of FIG. 10B is a constant value of about 0.33 at any time of the whole time period, the backlight unit supplies light without a change in luminance to the liquid crystal display panel. As a result, the variation in the OFF current of each TFT of the liquid crystal display panel is eliminated so that deterioration in the image display quality of the liquid crystal display panel, such as a wavy noise, is prevented.

Figure 11A:
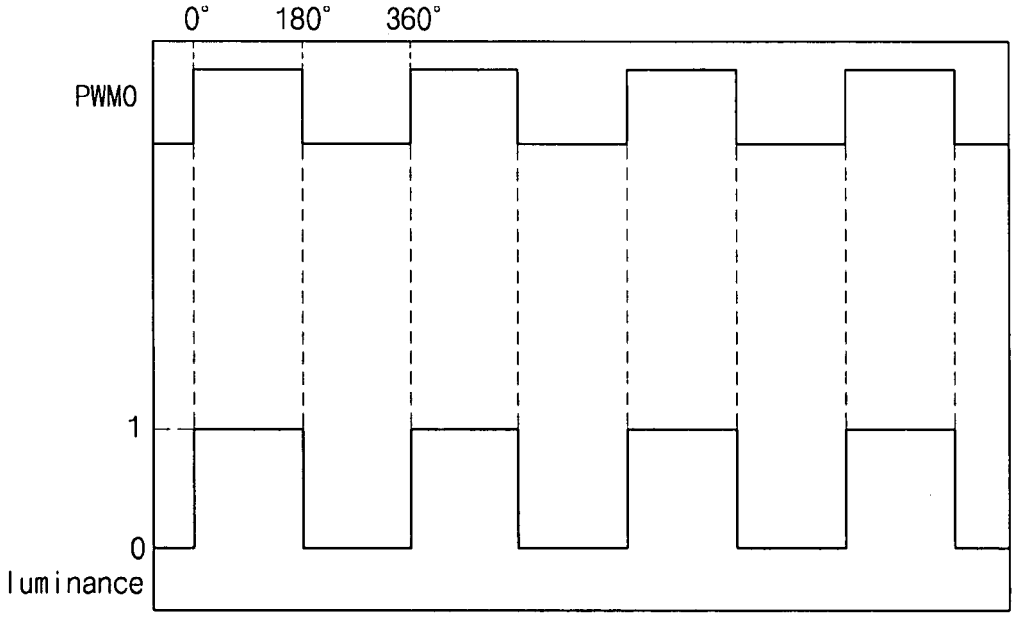
FIG. 11A shows the resulting luminance for a related art backlight unit from a single PWM signal having a duty ratio of about 50%.
Figure 11B:
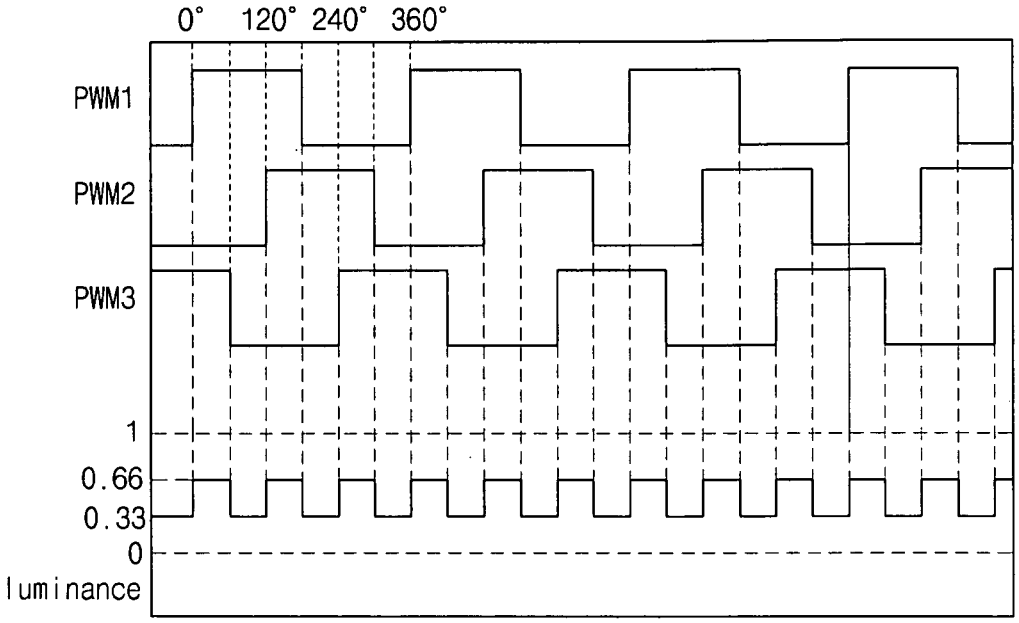
FIG. 11B shows the resulting luminance for the backlight unit shown in FIG. 8A from three PWM signals having a phase difference of about 120° and a duty ratio of about 50%.

FIG. 11A shows the resulting luminance for a related art backlight unit from a single PWM signal having a duty ratio of about 50%. FIG. 11B shows the resulting luminance for the backlight unit shown in FIG. 8A from three PWM signals having a phase difference of about 120° and a duty ratio of about 50%. As shown in FIG. 11A, a single zeroth PWM signal PWM0 having a duty ratio of about 50% is supplied to a related art backlight unit having first to twenty-fourth LED arrays LA1 to LA24. The single zeroth PWM signal PWM0 of FIG. 11A has a predetermined frequency and a predetermined voltage. Since the first to twenty-fourth LED arrays LA1 to LA24 are simultaneously turned ON/OFF according to the zeroth PWM signal PWM0 of FIG. 11A, the luminance of the first to twenty-fourth LED arrays LA1 to LA24 has a value of 0 or 1. The luminance can be measured as an electric signal by using a photo diode. The maximum and minimum values in luminance are represented as 1 and 0, respectively, for comparison purposes.

As shown in FIG. 11B, first, second and third PWM signals PWM1, PWM2 and PWM3 each having a duty ratio of about 50% are supplied to the backlight unit of FIG. 8A having first to twenty-fourth LED arrays LA1 to LA24. As a result, the first, fourth, seventh . . . and twenty-second LED arrays LA1, LA4, LA7 . . . and LA22 of a first group GR1 of FIG. 8A are turned ON/OFF according to the first PWM signal PWM1, the second, fifth, eighth . . . and twenty-third LED arrays LA2, LA4, LA8 . . . and LA23 of the second group GR2 of FIG. 8A are turned ON/OFF according to the second PWM signal PWM2, and the third, sixth, ninth . . . and twenty-fourth LED arrays LA3, LA6, LA9 . . . and LA24 of the third group GR3 of FIG. 8A are turned ON/OFF according to the third PWM signal PWM3.

The first, second and third PWM signals PWM1, PWM2 and PWM3 have the same frequency, the same voltage and the same duty ratio as the zeroth PWM signal PWM0 of FIG. 11A. In addition, the first, second and third PWM signals PWM1, PWM2 and PWM3 have a phase difference of about 120° with one another. As a result, the second PWM signal PWM2 has a phase delayed by about 120° with respect to the first PWM signal PWM1, and the third PWM signal PWM3 has a phase delayed by about 240° with respect to the first PWM signal PWM1. Accordingly, the first group GR1 including first, fourth, seventh . . . and twenty-second LED arrays LA1, LA4, LA7 . . . and LA22, the second group GR2 including the second, fifth, eighth . . . and twenty-third LED arrays LA2, LA4, LA8 . . . and LA23 and the third group GR3 including the third, sixth, ninth . . . and twenty-fourth LED arrays LA3, LA6, LA9 . . . and LA24 are alternately turned ON/OFF.

In the instant of emitting light, since the number (i.e., 8) of emitting LED arrays of the backlight unit of FIG. 8A driven by one of the first, second and third PWM signals PWM1, PWM2 and PWM3 of FIG. 11B is one third of the number (i.e., 24) of emitting LED arrays of the related art backlight unit driven by the zeroth PWM signal PWM0 of FIG. 11A, the instant luminance of the backlight unit of FIG. 8A driven by one of the first, second and third PWM signals PWM1, PWM2 and PWM3 of FIG. 11B is substantially a third of the instant luminance of the related art backlight unit driven by the zeroth PWM signal PWM0 of FIG. 11A. During a predetermined time period, however, the number of emission times of the backlight unit of FIG. 8A driven by the first, second and third PWM signals PWM1, PWM2 and PWM3 of FIG. 11B is three times the number of emission times of a related art backlight unit driven by the zeroth PWM signal PWM0 of FIG. 11A. Thus, the total luminance of the backlight unit driven by the first, second and third PWM signals PWM1, PWM2 and PWM3 of FIG. 11B is substantially the same total luminance as the related art backlight unit driven by only the single PWM signal of FIG. 11. In FIGS. 11A and 11B, the total luminance is calculated from the sum of areas corresponding to protruding rectangles of the luminance graph.

Figure 12A:
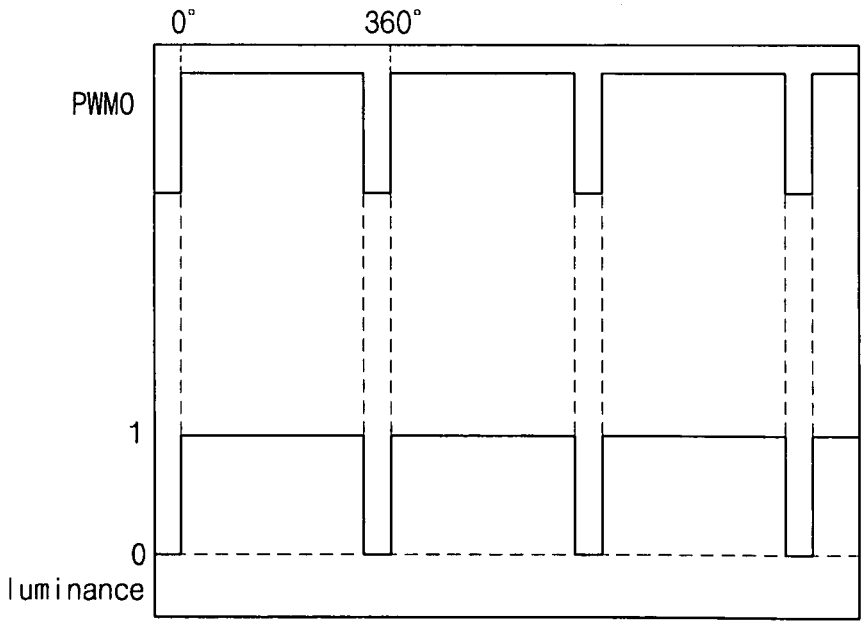
FIG. 12A shows the resulting luminance for a related art backlight unit from a single PWM signal having a duty ratio of about 90%.
Figure 12B:
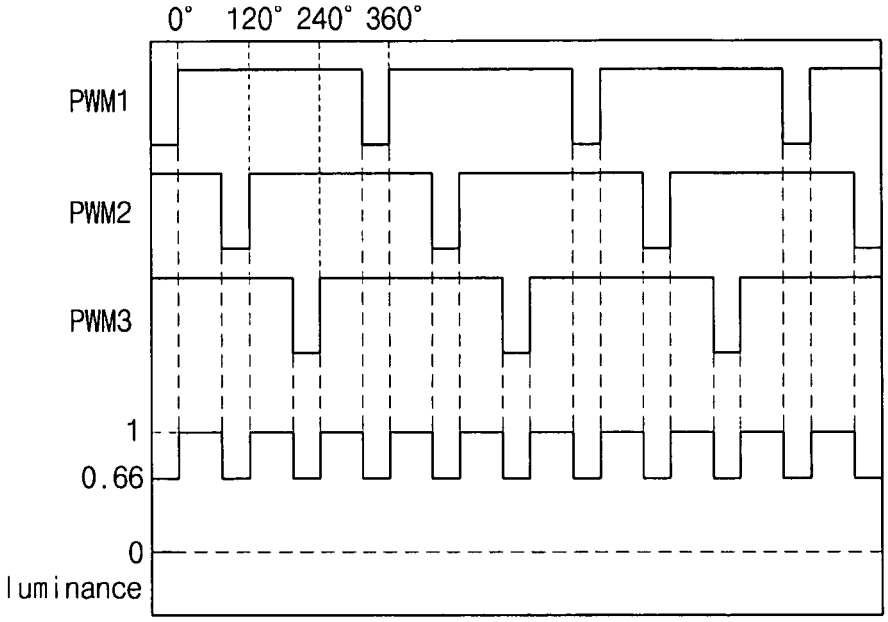
FIG. 12B shows the resulting luminance for the backlight unit shown in FIG. 8A from three PWM signals having a phase difference of about 120° and a duty ratio of about 90%.

FIG. 12A shows the resulting luminance for a related art backlight unit from a single PWM signal having a duty ratio of about 90%. FIG. 12B shows the resulting luminance for the backlight unit shown in FIG. 8A from three PWM signals having a phase difference of about 120° and a duty ratio of about 90%. As shown in FIG. 12A, a single zeroth PWM signal PWM0 having a duty ratio of about 90% is supplied to a related art backlight unit having first to twenty-fourth LED arrays LA1 to LA24. The single zeroth PWM signal PWM0 has a predetermined frequency and a predetermined voltage. Since the first to twenty-fourth LED arrays LA1 to LA24 are simultaneously turned ON/OFF according to the single zeroth PWM signal PWM0 of FIG. 12A, the luminance of the first to twenty-fourth LED arrays LA1 to LA24 has a value of 0 or 1. The luminance can be measured as an electric signal by using a photo diode. The maximum and minimum values in luminance are represented as 1 and 0, respectively, for comparison purposes.

As shown in FIG. 12B, first, second and third PWM signals PWM1, PWM2 and PWM3 each having a duty ratio of about 90% are supplied to a backlight unit of FIG. 8A having first to twenty-fourth LED arrays LA1 to LA24. As a result, the first, fourth, seventh . . . and twenty-second LED arrays LA1, LA4, LA7 . . . and LA22 of a first group GR1 of FIG. 8A are turned ON/OFF according to the first PWM signal PWM1, the second, fifth, eighth . . . and twenty-third LED arrays LA2, LA4, LA8 . . . and LA23 of the second group GR2 of FIG. 8A are turned ON/OFF according to the second PWM signal PWM2, and the third, sixth, ninth . . . and twenty-fourth LED arrays LA3, LA6, LA9 . . . and LA24 of the third group GR3 of FIG. 8A are turned ON/OFF according to the third PWM signal PWM3.

The first, second and third PWM signals PWM1, PWM2 and PWM3 have the same frequency, the same voltage and the same duty ratio as the single zeroth PWM signal PWM0 of FIG. 12A. In addition, the first, second and third PWM signals PWM1, PWM2 and PWM3 have a phase difference of about 120° with one another. As a result, the second PWM signal PWM2 has a phase delayed by about 120° with respect to the first PWM signal PWM1, and the third PWM signal PWM3 has a phase delayed by about 240° with respect to the first PWM signal PWM1. Accordingly, the first group GR1 including first, fourth, seventh . . . and twenty-second LED arrays LA1, LA4, LA7 . . . and LA22, the second group GR2 including the second, fifth, eighth . . . and twenty-third LED arrays LA2, LA4, LA8 . . . and LA23 and the third group GR3 including the third, sixth, ninth . . . and twenty-fourth LED arrays LA3, LA6, LA9 . . . and LA24 are alternately turned ON/OFF.

In the instant of emitting light, since the number (i.e., 8) of emitting LED arrays of the backlight unit of FIG. 8A driven by one of the first, second and third PWM signals PWM1, PWM2 and PWM3 of FIG. 12B is one third of the number (i.e., 24) of emitting LED arrays of the related art backlight unit driven by the zeroth PWM signal PWM0 of FIG. 12A, the instant luminance of the backlight unit of FIG. 8A driven by one of the first, second and third PWM signals PWM1, PWM2 and PWM3 of FIG. 12B is substantially a third of the instant luminance of the related art backlight unit driven by the zeroth PWM signal PWM0 of FIG. 12A. During a predetermined time period, however, the number of emission times of the backlight unit of FIG. 8A driven by the first, second and third PWM signals PWM1, PWM2 and PWM3 of FIG. 12B is three times the number of emission times of a related art backlight unit driven by the zeroth PWM signal PWM0 of FIG. 12A. Thus, the total luminance of the backlight unit driven by the first, second and third PWM signals PWM1, PWM2 and PWM3 of FIG. 12B is substantially the same total luminance as the related art backlight unit driven by only the single PWM signal of FIG. 12A. In FIGS. 12A and 12B, the total luminance is calculated from the sum of areas corresponding to protruding rectangles of the luminance graph.

In the backlight unit of FIG. 8A, a plurality of LED arrays are separated into three groups driven by three PWM signals having phase differences, as shown in FIGS. 9B, 10B, 11B and 12B. As a result, deterioration in the image display quality of the liquid crystal display panel, such as a wavy noise, due to the variation in the OFF current of each TFT of the liquid crystal display panel is prevented without a reduction in total luminance.

Figure 13A:
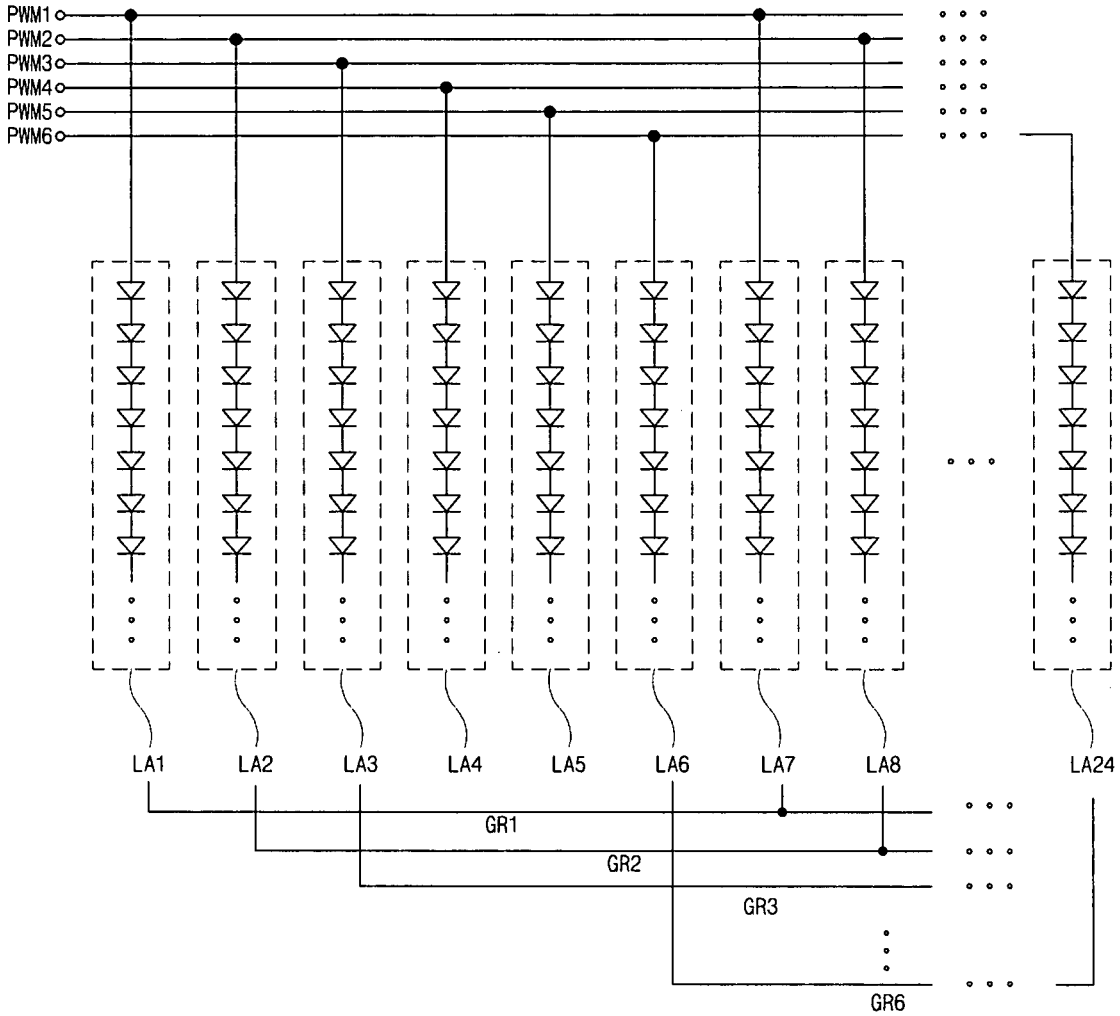
FIG. 13A is a block diagram of an LED array unit of a backlight unit for a liquid crystal display device according to an embodiment of the invention having six groups of arrays.
Figure 13B:
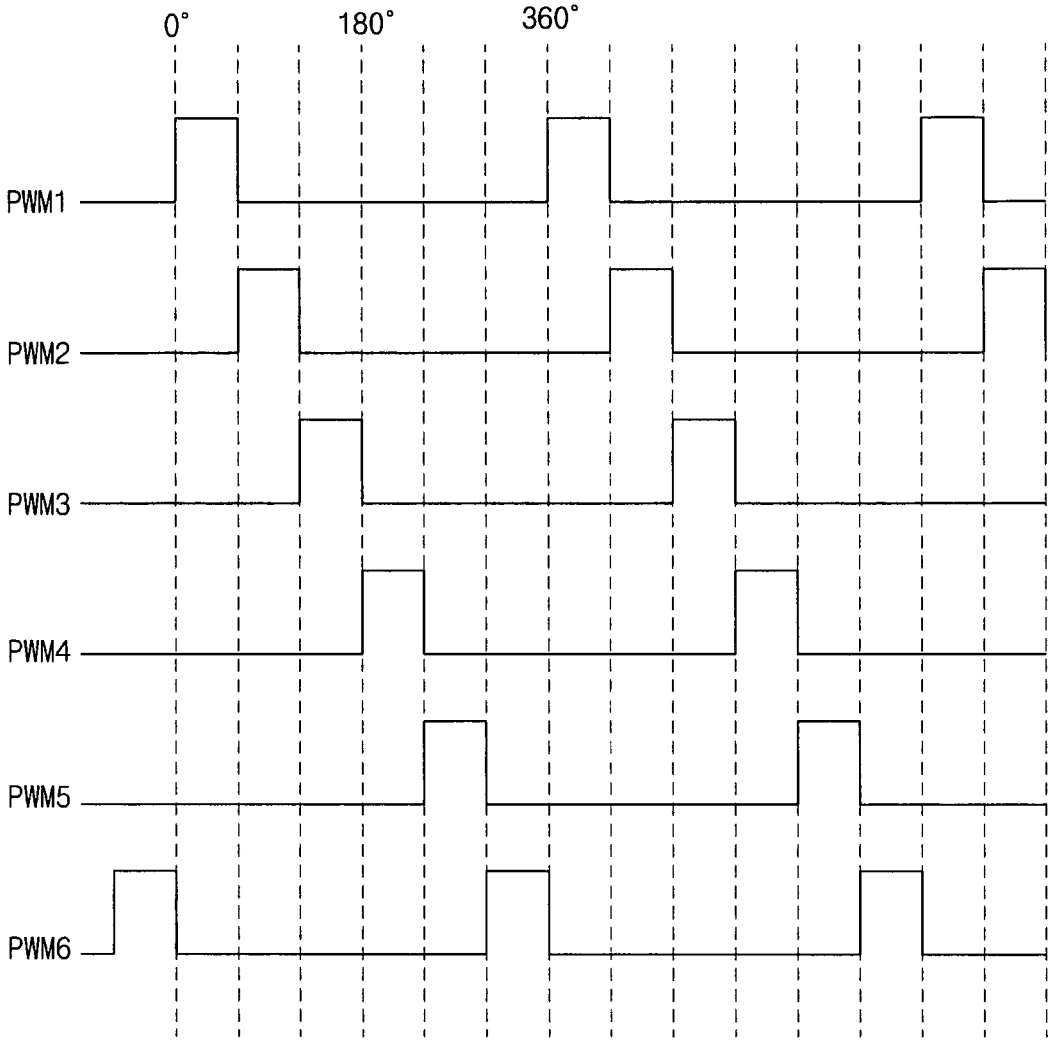
FIG. 13B is a timing chart of six PWM signals for the backlight unit shown in FIG. 13A.

FIG. 13A is a block diagram of an LED array unit of a backlight unit for a liquid crystal display device according to an embodiment of the invention having six groups of arrays. FIG. 13B is a timing chart of six PWM signals for the backlight unit shown in FIG. 13A. As shown in FIG. 13A, an LED array unit includes first to twenty-fourth LED arrays LA1 to LA24. The first to twenty-fourth LED arrays LA1 to LA24 are separated into first to sixth groups GR1 to GR6. As a result, the first, seventh . . . and nineteenth LED arrays LA1, LA7 . . . and LA19 of the first group GR1 are electrically connected to each other, and the second, eighth . . . and twentieth LED arrays LA2, LA8 . . . and LA20 of the second group GR2 are electrically connected to each other. Similarly, the third, ninth . . . and twenty-first LED arrays LA3, LA9 . . . and LA21 of the third group GR3 are electrically connected to each other, and the fourth, tenth . . . and twenty-second LED arrays LA4, LA10 . . . and LA22 of the fourth group GR4 are electrically connected to each other. Further, the fifth, eleventh . . . and twenty-third LED arrays LA5, LA11 . . . and LA23 of the fifth group GR5 are electrically connected to each other, and the sixth, twelfth . . . and twenty-fourth LED arrays LA6, LA12 . . . LA24 of the sixth group GR6 are electrically connected to each other.

A first PWM signal PWM1 is supplied to the first, seventh . . . and nineteenth LED arrays LA1, LA7 . . . and LA19 of the first group GR1, and a second PWM signal PWM2 is supplied to the second, eighth . . . and twentieth LED arrays LA2, LA8 . . . and LA20 of the second group GR2. Similarly, a third PWM signal PWM3 is supplied to the third, ninth . . . and twenty-first LED arrays LA3, LA9 . . . and LA21 of the third group GR3, and a fourth PWM signal PWM4 is supplied to the fourth, tenth . . . and twenty-second LED arrays LA4, LA10 . . . and LA22 of the fourth group GR4. Further, a fifth PWM signal PWM5 is supplied to the fifth, eleventh . . . and twenty-third LED arrays LA5, LA1 . . . and LA23 of the fifth group GR5, and a sixth PWM signal PWM64 is supplied to the sixth, twelfth . . . and twenty-fourth LED arrays LA6, LA12 . . . LA24 of the sixth group GR6.

As shown in FIG. 13B, the first to sixth PWM signals PWM1 to PWM6 have a duty ratio of about 17% and an identical frequency. In addition, the phase difference between neighboring two of the first to sixth PWM signals PWM1 to PWM6 is about 60°. Although the duty ratio of the first to sixth PWM signals PWM1 to PWM6 of FIG. 13B is about 17%, the duty ratio of t the first to sixth PWM signals PWM1 to PWM6 can be selected from values in a range of about 1% to about 99%.

Since the first to sixth groups GR1 to GR6 are driven by the first to sixth PWM signals PWM1 to PWM6, respectively, the first group GR1 including the first, seventh . . . and nineteenth LED arrays LA1, LA7 . . . and LA19, the second group GR2 including the second, eighth . . . and twentieth LED arrays LA2, LA8 . . . and LA20, the third group GR3 including the third, ninth . . . and twenty-first LED arrays LA3, LA9 . . . and LA21, the fourth group GR4 including the fourth, tenth . . . and twenty-second LED arrays LA4, LA10 . . . and LA22, the fifth group GR5 including the fifth, eleventh . . . and twenty-third LED arrays LA5, LA1 . . . and LA23 and the sixth group GR6 including the sixth, twelfth . . . and twenty-fourth LED arrays LA6, LA12 . . . LA24 are turned ON/OFF alternately with one another. Accordingly, the second, eighth . . . and twentieth LED arrays LA2, LA8 . . . and LA20 of the second group GR2 are turned ON after the first, seventh . . . and nineteenth LED arrays LA1, LA7 . . . and LA19 of the first group GR1 are turned OFF, and the third, ninth . . . and twenty-first LED arrays LA3, LA9 . . . and LA21 of the third group GR3 are turned ON after the second, eighth . . . and twentieth LED arrays LA2, LA8 . . . and LA20 of the second group GR2 are turned OFF. Similarly, the fourth, tenth . . . and twenty-second LED arrays LA4, LA10 . . . and LA22 of the fourth group GR4 are turned ON after the third, ninth . . . and twenty-first LED arrays LA3, LA9 . . . and LA21 of the third group GR3 are turned OFF, and the fifth, eleventh . . . and twenty-third LED arrays LA5, LA11 . . . and LA23 of the fifth group GR5 are turned ON after the fourth, tenth . . . and twenty-second LED arrays LA4, LA10 . . . and LA22 of the fourth group GR4 are turned OFF. Further, the sixth, twelfth . . . and twenty-fourth LED arrays LA6, LA12 . . . LA24 of the sixth group GR6 are turned ON after the fifth, eleventh . . . and twenty-third LED arrays LA5, LA11 . . . and LA23 of the fifth group GR5 are turned OFF. After the sixth, twelfth . . . and twenty-fourth LED arrays LA6, LA12 . . . LA24 of the sixth group GR6 are turned OFF, the first, seventh . . . and nineteenth LED arrays LA1, LA7 . . . and LA19 of the first group GR1 are turned ON again.

Figure 1:
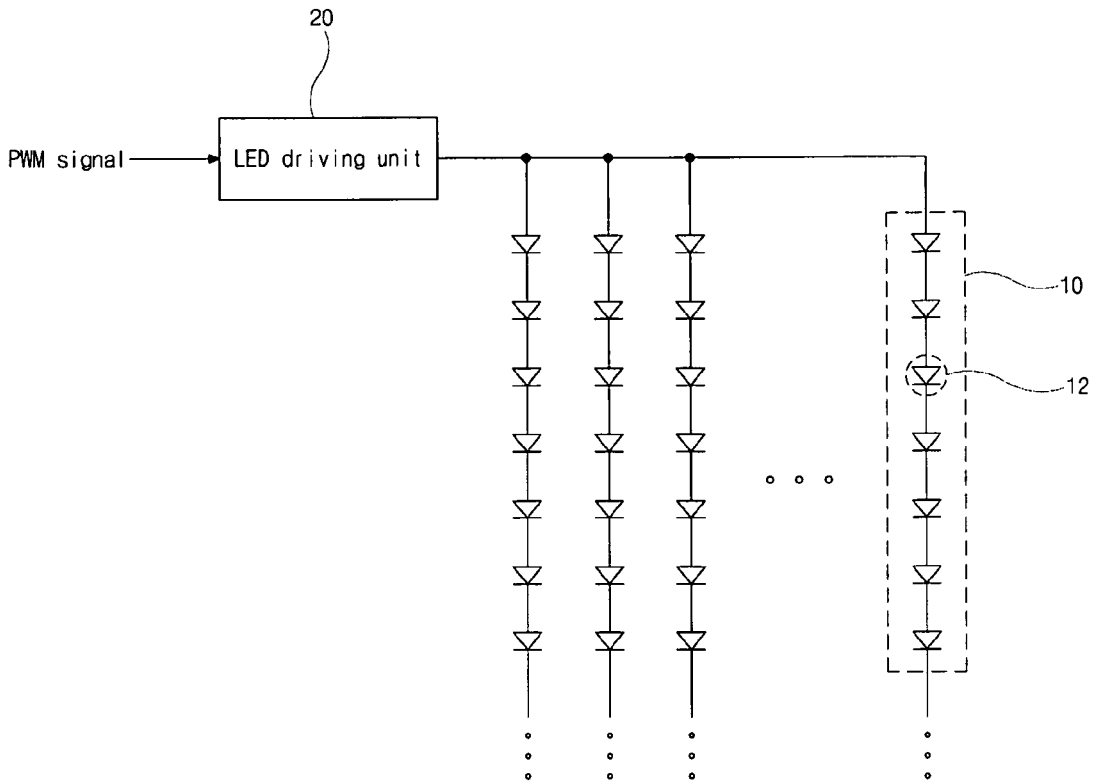
(related art) FIG. 1
FIG. 1 is a view showing an edge type backlight unit according to the related art.

Because the number (i.e., 4) of the LED arrays emitting light at one time in the backlight unit using the first to sixth PWM signals PWM1 to PWM6 of FIG. 13A is smaller than the number (i.e., 24) of the LED arrays emitting light at one time in a backlight unit using a single PWM signal, such as in FIG. 1, an instant luminance of the backlight unit using the first to sixth PWM signals PWM1 to PWM6 is about one sixth of an instant luminance of the backlight unit using the single PWM signal. As a result, the variation in the OFF current of each TFT in the liquid crystal display panel is reduced due to a reduction in the change of instant luminance of the incident light from the backlight unit. Thus, deterioration in the display quality of the liquid crystal display panel, such as a wavy noise, due to the variation in the OFF current of each TFT is prevented.

Although the instant luminance of the first to twenty-fourth LED arrays LA1 to LA24 alternately turned ON/OFF by the first to sixth PWM signals PWM1 to PWM6 is about one sixth of the instant luminance of the first to twenty-fourth LED arrays LA1 to LA24 simultaneously turned ON/OFF by the single PWM signal, a total luminance of the first to twenty-fourth LED arrays LA1 to LA24 alternately turned ON/OFF is substantially the same as a total luminance of the first to twenty-fourth LED arrays LA1 to LA24 simultaneously turned ON/OFF because the backlight unit using the first to sixth PWM signals PWM1 to PWM6 emits light more frequently. Accordingly, the LCD device having the backlight unit according to embodiments of the invention has no reduction in brightness as compared to an LCD device having the related art backlight unit.

Figure 14A:
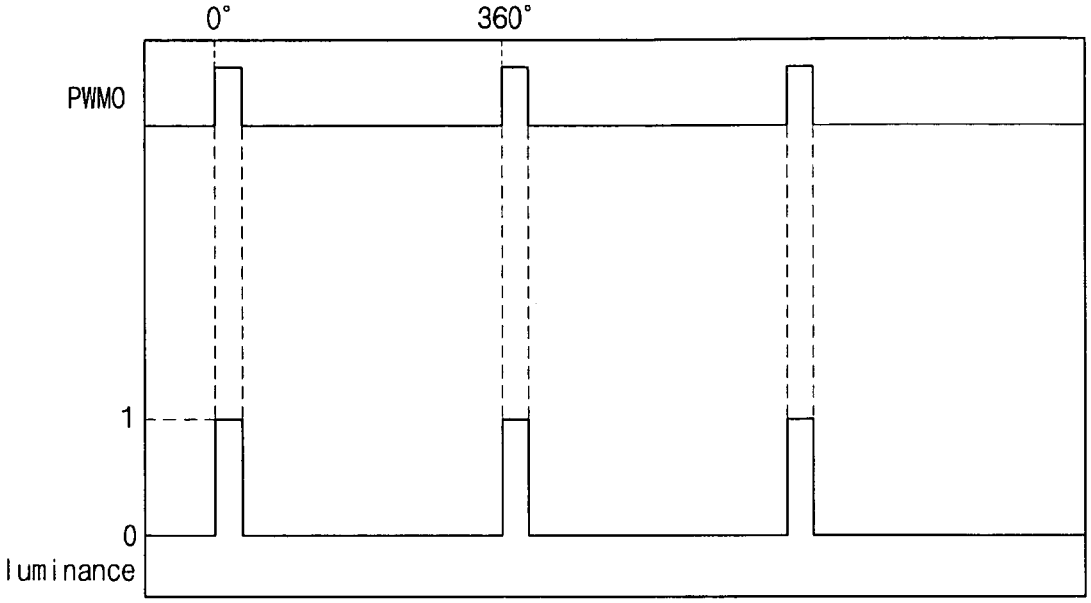
FIG. 14A shows the resulting luminance for a related art backlight unit from a single PWM signal having a duty ratio of about 10%.
Figure 14B:
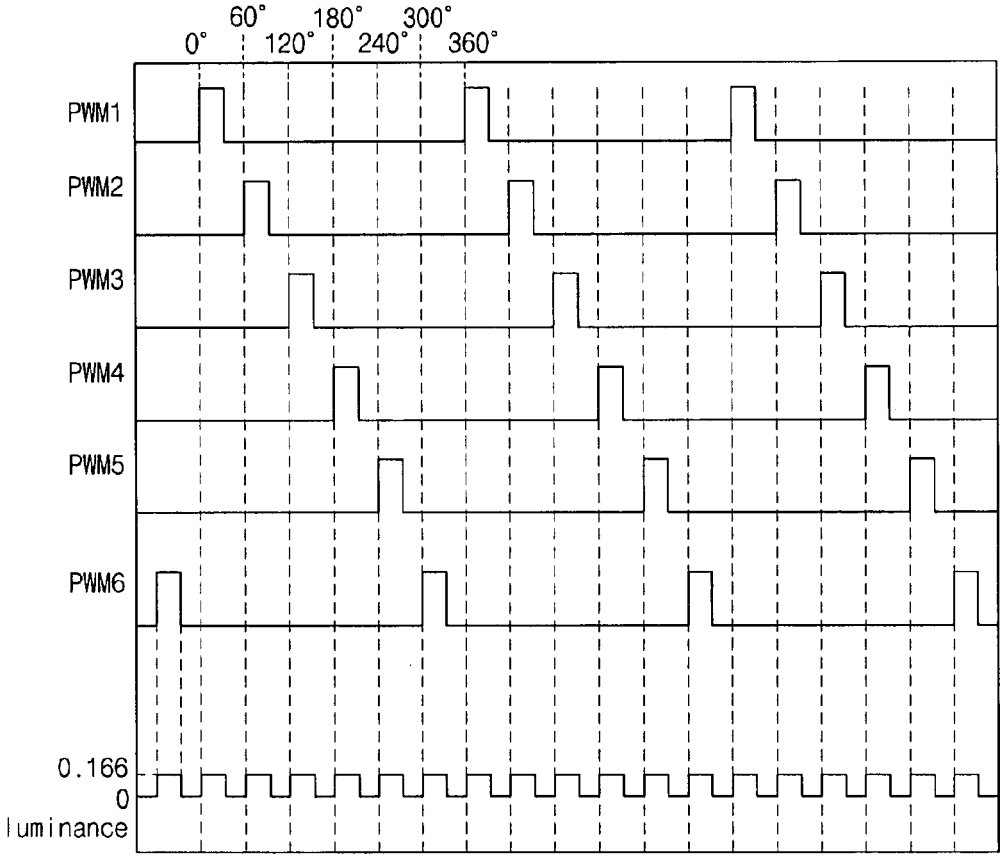
FIG. 14B shows the resulting luminance for the backlight unit shown in FIG. 13A from six PWM signals having a phase difference of about 60° and a duty ratio of about 10%.

FIG. 14A shows the resulting luminance for a related art backlight unit from a single PWM signal having a duty ratio of about 10%. FIG. 14B shows the resulting luminance for the backlight unit shown in FIG. 13A from six PWM signals having a phase difference of about 60° and a duty ratio of about 10%. As shown in FIG. 14A, a single zeroth PWM signal PWM0 having a duty ratio of about 10% is supplied to a related art backlight unit having first to twenty-fourth LED arrays LA1 to LA24. The single zeroth PWM signal PWM0 has a predetermined frequency and a predetermined voltage. Since the first to twenty-fourth LED arrays LA1 to LA24 are simultaneously turned ON/OFF according to the single zeroth PWM signal PWM0, the luminance of the first to twenty-fourth LED arrays LA1 to LA24 has a value of 0 or 1. The luminance can be measured as an electric signal by using a photo diode. The maximum and minimum values in luminance are represented as 1 and 0, respectively, for comparison purposes.

As shown in FIG. 14B, first to sixth PWM signals PWM1 to PWM6 each having a duty ratio of about 10% are supplied to a backlight unit having first to twenty-fourth LED arrays LA1 to LA24. As a result, the first, seventh . . . and nineteenth LED arrays LA1, LA7 . . . and LA19 of the first group GR1 of FIG. 13A are turned ON/OFF according to the first PWM signal PWM1, and the second, eighth . . . and twentieth LED arrays LA2, LA8 . . . and LA20 of the second group GR2 of FIG. 13A are turned ON/OFF according to the second PWM signal PWM2. Similarly, the third, ninth . . . and twenty-first LED arrays LA3, LA9 . . . and LA21 of the third group GR3 of FIG. 13A are turned ON/OFF according to the third PWM signal PWM3, and the fourth, tenth . . . and twenty-second LED arrays LA4, LA10 . . . and LA22 of the fourth group GR4 of FIG. 13A are turned ON/OFF according to the fourth PWM signal PWM4. Further, the fifth, eleventh . . . and twenty-third LED arrays LA5, LA11 . . . and LA23 of the fifth group GR5 of FIG. 13A are turned ON/OFF according to the fifth PWM signal PWM5, and the sixth, twelfth . . . and twenty-fourth LED arrays LA6, LA12 . . . LA24 of the sixth group GR6 of FIG. 13A are turned ON/OFF according to the sixth PWM signal PWM6.

The first to sixth PWM signals PWM1 to PWM6 of FIG. 14B have the same frequency, the same voltage and the same duty ratio as the zeroth PWM signal PWM0 of FIG. 14A. In addition, neighboring two of the first to sixth PWM signals PWM1 to PWM6 have a phase difference of about 60° with each another. As a result, the second PWM signal PWM2 has a phase delayed by about 60° with respect to the first PWM signal PWM1, and the third PWM signal PWM3 has a phase delayed by about 120° with respect to the first PWM signal PWM1. Further, the fourth PWM signal PWM4 has a phase delayed by about 180° with respect to the first PWM signal PWM1, the fifth PWM signal PWM5 has a phase delayed by about 240° with respect to the first PWM signal PWM1 and the sixth PWM signal PWM6 has a phase delayed by about 300° with respect to the first PWM signal PWM1. Accordingly, the first group GR1 including the first, seventh . . . and nineteenth LED arrays LA1, LA7 . . . and LA19, the second group GR2 including the second, eighth . . . and twentieth LED arrays LA2, LA8 . . . and LA20, the third group GR3 including the third, ninth . . . and twenty-first LED arrays LA3, LA9 . . . and LA21, the fourth group GR4 including the fourth, tenth . . . and twenty-second LED arrays LA4, LA10 . . . and LA22, the fifth group GR5 including the fifth, eleventh . . . and twenty-third LED arrays LA5, LA11 . . . and LA23, and the sixth group GR6 including the sixth, twelfth . . . and twenty-fourth LED arrays LA6, LA12 . . . LA24 are alternately turned ON/OFF.

In the instant of emitting light, since the number (i.e., 4) of emitting LED arrays of the backlight unit of FIG. 13A driven by one of the first to sixth PWM signals PWM1 to PWM6 of FIG. 14B is one sixth of the number (i.e., 24) of emitting LED arrays of the related art backlight unit driven by the zeroth PWM signal PWM0 of FIG. 14A, the instant luminance of the backlight unit of FIG. 13A driven by one of the first to sixth PWM signals PWM1 to PWM6 of FIG. 14B is substantially one sixth of the luminance of the related art backlight unit. During a predetermined time period, however, since the number of emission times of the backlight unit of FIG. 13A driven by one of the first to sixth PWM signals PWM1 to PWM6 of FIG. 14B is six times the number of emission times of the related art backlight unit driven by the zeroth PWM signal PWM0 of FIG. 14A, the total luminance of the backlight unit driven by one of the first to sixth PWM signals PWM1 to PWM6 of FIG. 14B is substantially the same as the total luminance of the related art backlight unit driven by the zeroth PWM signal PWM0 of FIG. 14A. In FIGS. 14A and 14B, the total luminance is calculated from the sum of areas corresponding to protruding rectangles of the luminance graph.

Figure 15A:
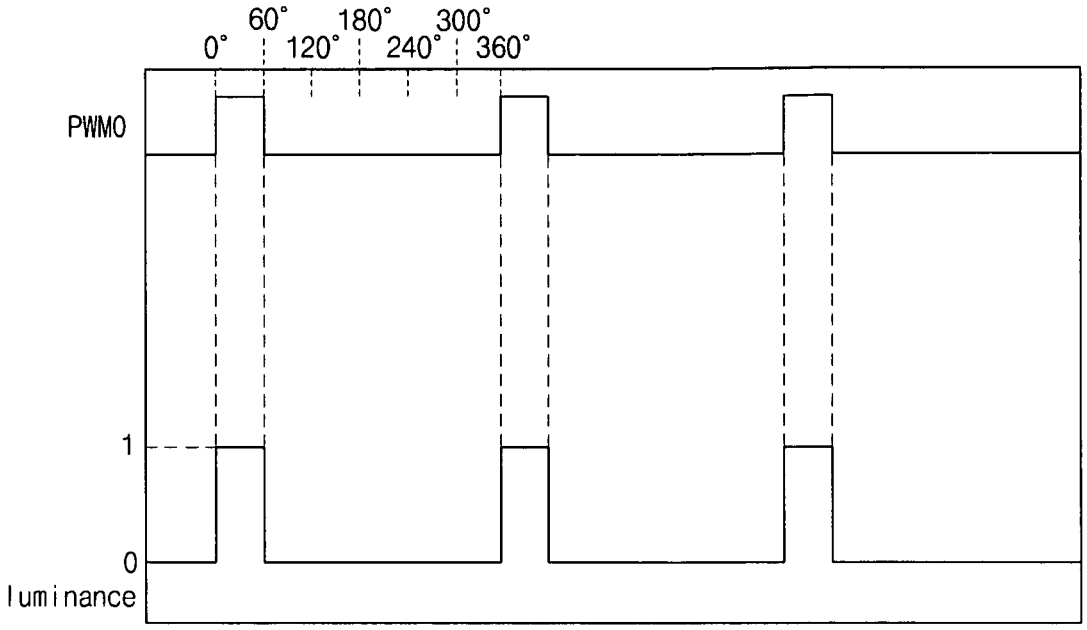
FIG. 15A shows the resulting luminance for a related art backlight unit from a single PWM signal having a duty ratio of about 16.7%.
Figure 15B:
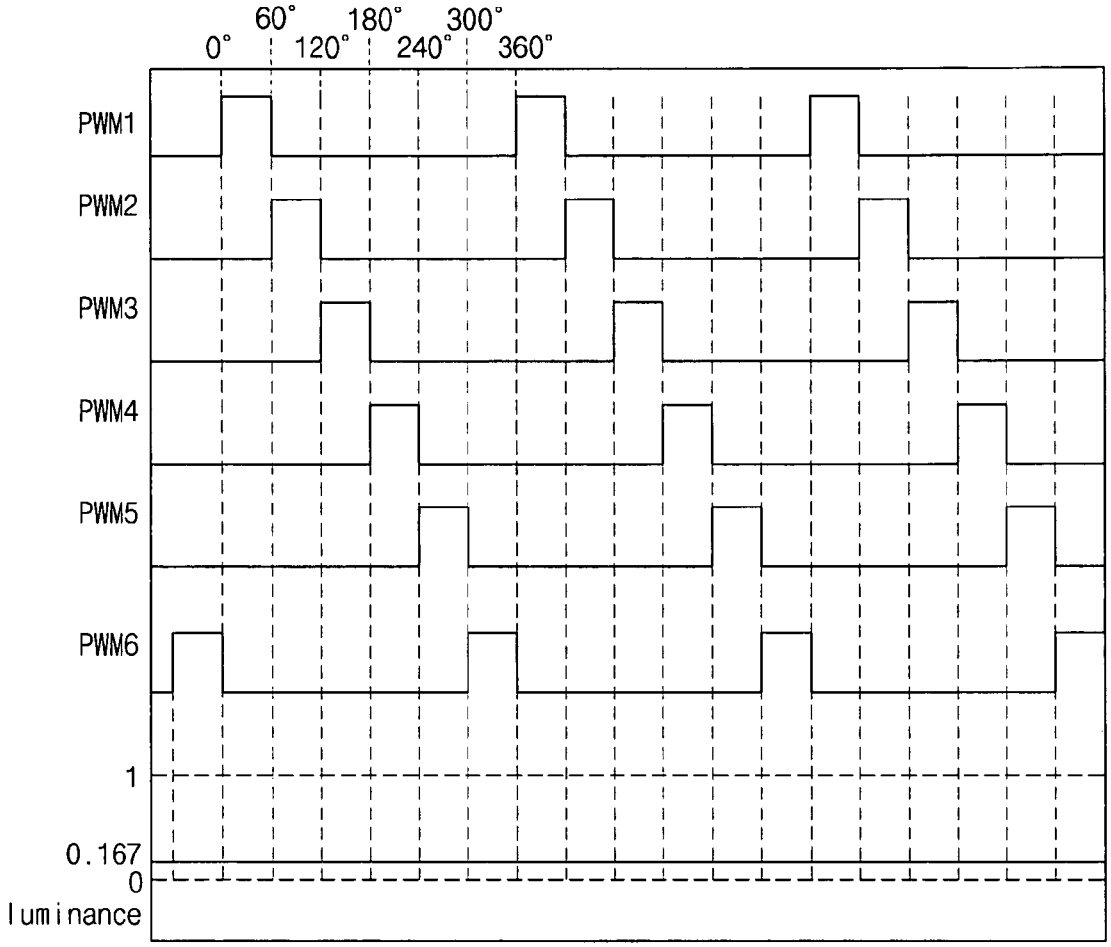
FIG. 15B shows the resulting luminance for the backlight unit shown in FIG. 13A from six PWM signals having a phase difference of about 60° and a duty ratio of about 16.7%.

FIG. 15A shows the resulting luminance for a related art backlight unit from a single PWM signal having a duty ratio of about 16.7%. FIG. 15B shows the resulting luminance for the backlight unit shown in FIG. 13A from six PWM signals having a phase difference of about 60° and a duty ratio of about 16.7%. As shown in FIG. 15A, a single zeroth PWM signal PWM0 having a duty ratio of about 16.7% is supplied to a related art backlight unit having first to twenty-fourth LED arrays LA1 to LA24. The single zeroth PWM signal PWM0 has a predetermined frequency and a predetermined voltage. Since the first to twenty-fourth LED arrays LA1 to LA24 are simultaneously turned ON/OFF according to the zeroth PWM signal PWM0, the luminance of the first to twenty-fourth LED arrays LA1 to LA24 has a value of 0 or 1. The luminance can be measured as an electric signal by using a photo diode. The maximum and minimum values in luminance are represented as 1 and 0, respectively, for comparison.

As shown in FIG. 15B, first to sixth PWM signals PWM1 to PWM6 each having a duty ratio of about 16.7% are supplied to a backlight unit having first to twenty-fourth LED arrays LA1 to LA24. As a result, the first, seventh . . . and nineteenth LED arrays LA1, LA7 . . . and LA19 of the first group GR1 of FIG. 13A are turned ON/OFF according to the first PWM signal PWM1, and the second, eighth . . . and twentieth LED arrays LA2, LA8 . . . and LA20 of the second group GR2 of FIG. 13A are turned ON/OFF according to the second PWM signal PWM2. Similarly, the third, ninth . . . and twenty-first LED arrays LA3, LA9 . . . and LA21 of the third group GR3 of FIG. 13A are turned ON/OFF according to the third PWM signal PWM3, and the fourth, tenth . . . and twenty-second LED arrays LA4, LA10 . . . and LA22 of the fourth group GR4 of FIG. 13A are turned ON/OFF according to the fourth PWM signal PWM4. Further, the fifth, eleventh . . . and twenty-third LED arrays LA5, LA11 . . . and LA23 of the fifth group GR5 of FIG. 13A are turned ON/OFF according to the fifth PWM signal PWM5, and the sixth, twelfth . . . and twenty-fourth LED arrays LA6, LA2 . . . LA24 of the sixth group GR6 of FIG. 13A are turned ON/OFF according to the sixth PWM signal PWM6.

The first to sixth PWM signals PWM1 to PWM6 have the same frequency, the same voltage and the same duty ratio as the zeroth PWM signal PWM0 of FIG. 15A. In addition, neighboring two of the first to sixth PWM signals PWM1 to PWM6 have a phase difference of about 60° with each another. As a result, the second PWM signal PWM2 has a phase delayed by about 60° with respect to the first PWM signal PWM1, and the third PWM signal PWM3 has a phase delayed by about 120° with respect to the first PWM signal PWM1. Further, the fourth PWM signal PWM4 has a phase delayed by about 180° with respect to the first PWM signal PWM1, the fifth PWM signal PWM5 has a phase delayed by about 240° with respect to the first PWM signal PWM1 and the sixth PWM signal PWM6 has a phase delayed by about 300° with respect to the first PWM signal PWM1. Accordingly, the first group GR1 including the first, seventh . . . and nineteenth LED arrays LA1, LA7 . . . and LA19, the second group GR2 including the second, eighth . . . and twentieth LED arrays LA2, LA8 . . . and LA20, the third group GR3 including the third, ninth . . . and twenty-first LED arrays LA3, LA9 . . . and LA21, the fourth group GR4 including the fourth, tenth . . . and twenty-second LED arrays LA4, LA10 . . . and LA22, the fifth group GR5 including the fifth, eleventh . . . and twenty-third LED arrays LA5, LA11 . . . and LA23, and the sixth group GR6 including the sixth, twelfth . . . and twenty-fourth LED arrays LA6, LA12 . . . LA24 are alternately turned ON/OFF.

In the instant of emitting light, since the number (i.e., 4) of emitting LED arrays of the backlight unit of FIG. 13A driven by one of the first to sixth PWM signals PWM1 to PWM6 of FIG. 15B is one sixth of the number (i.e., 24) of emitting LED arrays of the related art backlight unit driven by the zeroth PWM signal PWM0 of FIG. 15A, the instant luminance of the backlight unit of FIG. 13A driven by one of the first to sixth PWM signals PWM1 to PWM6 of FIG. 15B is substantially one sixth of the luminance of the related art backlight unit. During a predetermined time period, however, since the number of emission times of the backlight unit of FIG. 13A driven by one of the first to sixth PWM signals PWM1 to PWM6 of FIG. 15B is six times the number of emission times of the related art backlight unit driven by the zeroth PWM signal PWM0 of FIG. 15A, the total luminance of the backlight unit driven by one of the first to sixth PWM signals PWM1 to PWM6 of FIG. 15B is substantially the same as the total luminance of the related art backlight unit driven by the zeroth PWM signal PWM0 of FIG. 15A. In FIGS. 15A and 15B, the total luminance is calculated from the sum of areas corresponding to protruding rectangles of the luminance graph.

Specifically, since the instant luminance of the backlight unit of FIG. 15B is a constant value of about 0.167 at any time during the whole time period, the backlight unit supplies light without a change in luminance to the liquid crystal display panel. As a result, the variation in the OFF current of each TFT of the liquid crystal display panel is eliminated and deterioration in the image display quality, such as a wavy noise, is prevented.

Figure 16A:
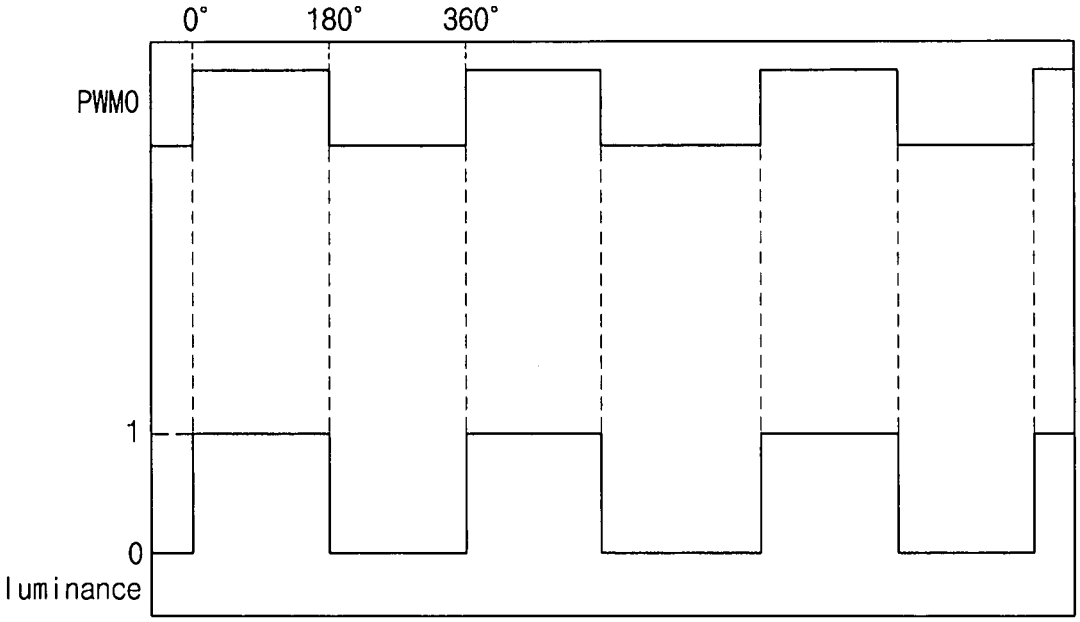
FIG. 16A shows a single PWM signal having a duty ratio of about 50% and the resulting luminance for a related art backlight unit.
Figure 16B:
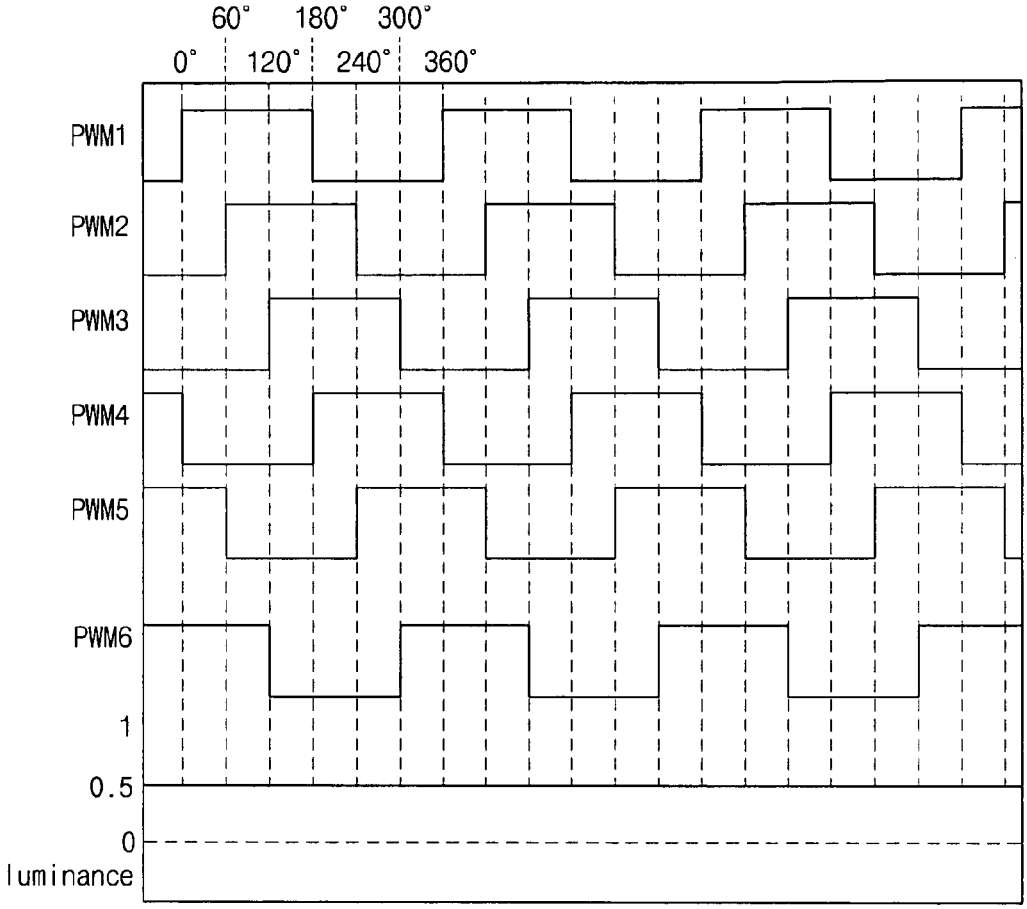
FIG. 16B the resulting luminance for the backlight unit shown in FIG. 13A from six PWM signals having a phase difference of about 60° and a duty ratio of about 50%.

FIG. 16A shows a single PWM signal having a duty ratio of about 50% and the resulting luminance for a related art backlight unit. FIG. 16B the resulting luminance for the backlight unit shown in FIG. 13A from six PWM signals having a phase difference of about 60° and a duty ratio of about 50%. As shown in FIG. 16A, a single zeroth PWM signal PWM0 having a duty ratio of about 50% is supplied to a related art backlight unit having first to twenty-fourth LED arrays LA1 to LA24. The zeroth PWM signal PWM0 has a predetermined frequency and a predetermined voltage. Since the first to twenty-fourth LED arrays LA1 to LA24 are simultaneously turned ON/OFF according to the single zeroth PWM signal PWM0, the luminance of the first to twenty-fourth LED arrays LA1 to LA24 has a value of 0 or 1. The luminance can be measured as an electric signal by using a photo diode. The maximum and minimum values in luminance are represented as 1 and 0, respectively, for comparison purposes.

As shown in FIG. 16B, first to sixth PWM signals PWM1 to PWM6 each having a duty ratio of about 50% are supplied to a backlight unit having first to twenty-fourth LED arrays LA1 to LA24. As a result, the first, seventh . . . and nineteenth LED arrays LA1, LA7 . . . and LA19 of the first group GR1 of FIG. 13A are turned ON/OFF according to the first PWM signal PWM1, and the second, eighth . . . and twentieth LED arrays LA2, LA8 . . . and LA20 of the second group GR2 of FIG. 13A are turned ON/OFF according to the second PWM signal PWM2. Similarly, the third, ninth . . . and twenty-first LED arrays LA3, LA9 . . . and LA21 of the third group GR3 of FIG. 13A are turned ON/OFF according to the third PWM signal PWM3, and the fourth, tenth . . . and twenty-second LED arrays LA4, LA10 . . . and LA22 of the fourth group GR4 of FIG. 13A are turned ON/OFF according to the fourth PWM signal PWM4. Further, the fifth, eleventh . . . and twenty-third LED arrays LA5, LA1 . . . and LA23 of the fifth group GR5 of FIG. 13A are turned ON/OFF according to the fifth PWM signal PWM5, and the sixth, twelfth . . . and twenty-fourth LED arrays LA6, LA12 . . . LA24 of the sixth group GR6 of FIG. 13A are turned ON/OFF according to the sixth PWM signal PWM6.

The first to sixth PWM signals PWM1 to PWM6 have the same frequency, the same voltage and the same duty ratio as the zeroth PWM signal PWM0 of FIG. 16A. In addition, neighboring two of the first to sixth PWM signals PWM1 to PWM6 have a phase difference of about 60° with each another. As a result, the second PWM signal PWM2 has a phase delayed by about 60° with respect to the first PWM signal PWM1, and the third PWM signal PWM3 has a phase delayed by about 120° with respect to the first PWM signal PWM1. Further, the fourth PWM signal PWM4 has a phase delayed by about 180° with respect to the first PWM signal PWM1, the fifth PWM signal PWM5 has a phase delayed by about 240° with respect to the first PWM signal PWM1 and the sixth PWM signal PWM6 has a phase delayed by about 300° with respect to the first PWM signal PWM1. Accordingly, the first group GR1 including the first, seventh . . . and nineteenth LED arrays LA1, LA7 . . . and LA19, the second group GR2 including the second, eighth . . . and twentieth LED arrays LA2, LA8 . . . and LA20, the third group GR3 including the third, ninth . . . and twenty-first LED arrays LA3, LA9 . . . and LA21, the fourth group GR4 including the fourth, tenth . . . and twenty-second LED arrays LA4, LA10 . . . and LA22, the fifth group GR5 including the fifth, eleventh . . . and twenty-third LED arrays LA5, LA11 . . . and LA23, and the sixth group GR6 including the sixth, twelfth . . . and twenty-fourth LED arrays LA6, LA12 . . . LA24 are alternately turned ON/OFF.

In the instant of emitting light, since the number (i.e., 4) of emitting LED arrays of the backlight unit of FIG. 13A driven by one of the first to sixth PWM signals PWM1 to PWM6 of FIG. 16B is one sixth of the number (i.e., 24) of emitting LED arrays of the related art backlight unit driven by the zeroth PWM signal PWM0 of FIG. 16A, the instant luminance of the backlight unit of FIG. 13A driven by one of the first to sixth PWM signals PWM1 to PWM6 of FIG. 16B is substantially one sixth of the luminance of the related art backlight unit. During a predetermined time period, however, since the number of emission times of the backlight unit of FIG. 13A driven by one of the first to sixth PWM signals PWM1 to PWM6 of FIG. 16B is six times the number of emission times of the related art backlight unit driven by the zeroth PWM signal PWM0 of FIG. 16A, the total luminance of the backlight unit driven by one of the first to sixth PWM signals PWM1 to PWM6 of FIG. 16B is substantially the same as the total luminance of the related art backlight unit driven by the zeroth PWM signal PWM0 of FIG. 16A. In FIGS. 16A and 16B, the total luminance is calculated from the sum of areas corresponding to protruding rectangles of the luminance graph.

Specifically, since the instant luminance of the backlight unit of FIG. 16B is a constant value of about 0.5 at any time during the whole time period, the backlight unit supplies light without a change in luminance to the liquid crystal display panel. As a result, the variation in the OFF current of each TFT of the liquid crystal display panel is eliminated and deterioration in the image display quality, such as a wavy noise, is prevented.

Figure 17A:
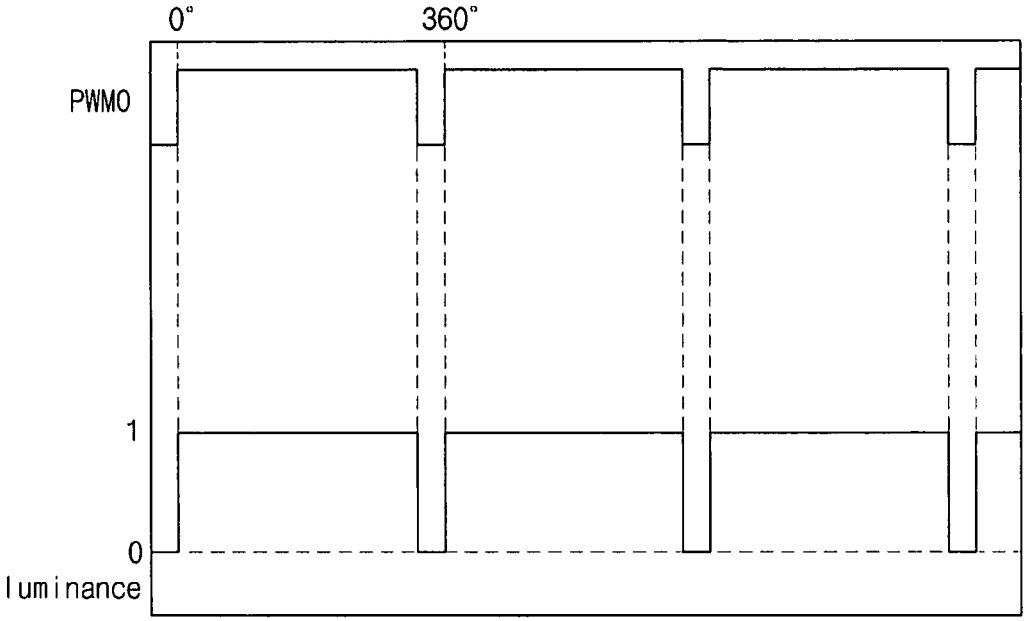
FIG. 17A shows a single PWM signal having a duty ratio of about 90% and the resulting luminance for a related art backlight unit.
Figure 17B:
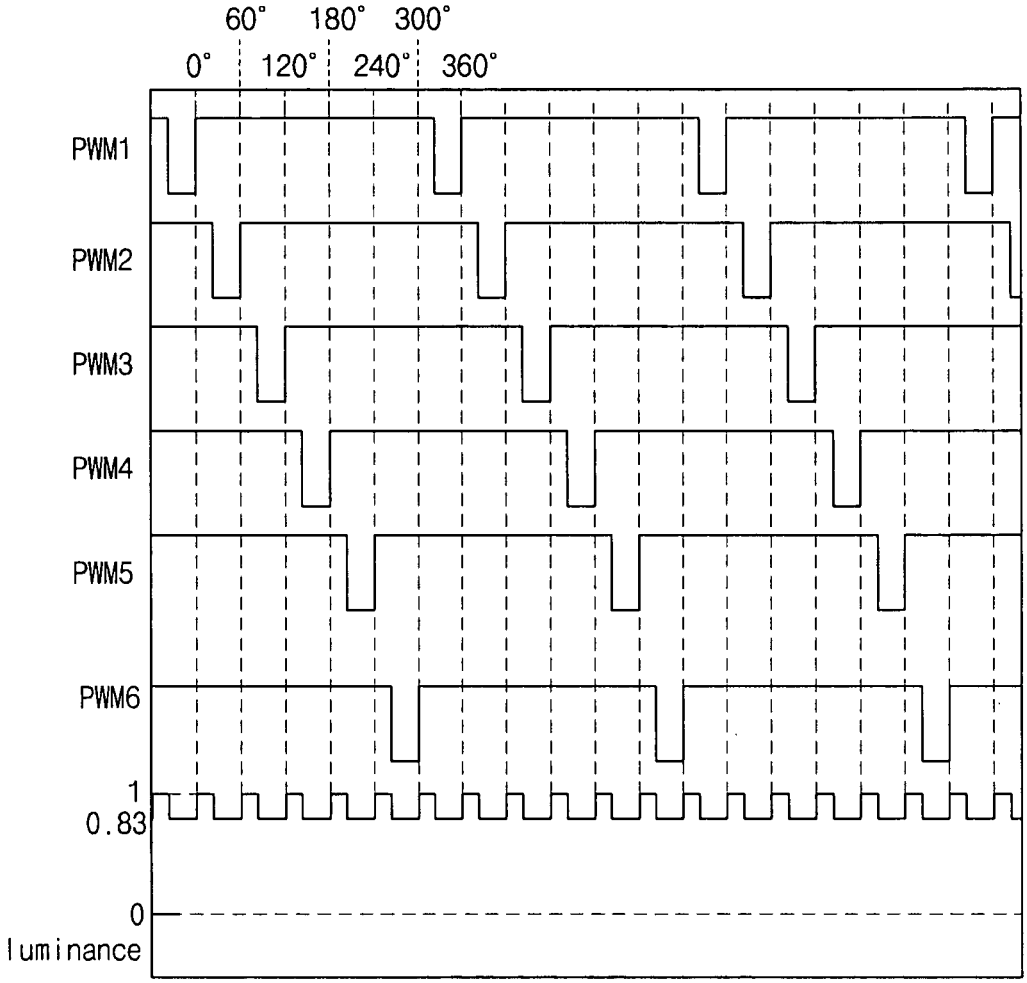
FIG. 17B shows the resulting luminance for the backlight unit shown in FIG. 13A from six PWM signals having a phase difference of about 60° and a duty ratio of about 90%.

FIG. 17A shows a single PWM signal having a duty ratio of about 90% and the resulting luminance for a related art backlight unit. FIG. 17B shows the resulting luminance for the backlight unit shown in FIG. 13A from six PWM signals having a phase difference of about 60° and a duty ratio of about 90%. As shown in FIG. 17A, a single zeroth PWM signal PWM0 having a duty ratio of about 90% is supplied to a related art backlight unit having first to twenty-fourth LED arrays LA1 to LA24. The single zeroth PWM signal PWM0 has a predetermined frequency and a predetermined voltage. Since the first to twenty-fourth LED arrays LA1 to LA24 are simultaneously turned ON/OFF according to the single zeroth PWM signal PWM0, the luminance of the first to twenty-fourth LED arrays LA1 to LA24 has a value of 0 or 1. The luminance can be measured as an electric signal by using a photo diode. The maximum and minimum values in luminance are represented as 1 and 0, respectively, for comparison purposes.

As shown in FIG. 17B, first to sixth PWM signals PWM1 to PWM6 each having a duty ratio of about 90% are supplied to a backlight unit having first to twenty-fourth LED arrays LA1 to LA24. As a result, the first, seventh . . . and nineteenth LED arrays LA1, LA7 . . . and LA19 of the first group GR1 of FIG. 13A are turned ON/OFF according to the first PWM signal PWM1, and the second, eighth . . . and twentieth LED arrays LA2, LA8 . . . and LA20 of the second group GR2 of FIG. 13A are turned ON/OFF according to the second PWM signal PWM2. Similarly, the third, ninth . . . and twenty-first LED arrays LA3, LA9 . . . and LA21 of the third group GR3 of FIG. 13A are turned ON/OFF according to the third PWM signal PWM3, and the fourth, tenth . . . and twenty-second LED arrays LA4, LA10 . . . and LA22 of the fourth group GR4 of FIG. 13A are turned ON/OFF according to the fourth PWM signal PWM4. Further, the fifth, eleventh . . . and twenty-third LED arrays LA5, LA11 . . . and LA23 of the fifth group GR5 of FIG. 13A are turned ON/OFF according to the fifth PWM signal PWM5, and the sixth, twelfth . . . and twenty-fourth LED arrays LA6, LA12 . . . LA24 of the sixth group GR6 of FIG. 13A are turned ON/OFF according to the sixth PWM signal PWM6.

The first to sixth PWM signals PWM1 to PWM6 have the same frequency, the same voltage and the same duty ratio as the zeroth PWM signal PWM0 of FIG. 17A. In addition, neighboring two of the first to sixth PWM signals PWM1 to PWM6 have a phase difference of about 60° with each another. As a result, the second PWM signal PWM2 has a phase delayed by about 60° with respect to the first PWM signal PWM1, and the third PWM signal PWM3 has a phase delayed by about 120° with respect to the first PWM signal PWM1. Further, the fourth PWM signal PWM4 has a phase delayed by about 180° with respect to the first PWM signal PWM1, the fifth PWM signal PWM5 has a phase delayed by about 240° with respect to the first PWM signal PWM1 and the sixth PWM signal PWM6 has a phase delayed by about 300° with respect to the first PWM signal PWM1. Accordingly, the first group GR1 including the first, seventh . . . and nineteenth LED arrays LA1, LA7 . . . and LA19, the second group GR2 including the second, eighth . . . and twentieth LED arrays LA2, LA8 . . . and LA20, the third group GR3 including the third, ninth . . . and twenty-first LED arrays LA3, LA9 . . . and LA21, the fourth group GR4 including the fourth, tenth . . . and twenty-second LED arrays LA4, LA10 . . . and LA22, the fifth group GR5 including the fifth, eleventh . . . and twenty-third LED arrays LA5, LA11 . . . and LA23, and the sixth group GR6 including the sixth, twelfth . . . and twenty-fourth LED arrays LA6, LA12 . . . LA24 are alternately turned ON/OFF.

In the instant of emitting light, since the number (i.e., 4) of emitting LED arrays of the backlight unit of FIG. 13A driven by one of the first to sixth PWM signals PWM1 to PWM6 of FIG. 17B is one sixth of the number (i.e., 24) of emitting LED arrays of the related art backlight unit driven by the zeroth PWM signal PWM0 of FIG. 17A, the instant luminance of the backlight unit of FIG. 13A driven by one of the first to sixth PWM signals PWM1 to PWM6 of FIG. 17B is substantially one sixth of the luminance of the related art backlight unit. During a predetermined time period, however, since the number of emission times of the backlight unit of FIG. 13A driven by one of the first to sixth PWM signals PWM1 to PWM6 of FIG. 17B is six times the number of emission times of the related art backlight unit driven by the zeroth PWM signal PWM0 of FIG. 17A, the total luminance of the backlight unit driven by one of the first to sixth PWM signals PWM1 to PWM6 of FIG. 17B is substantially the same as the total luminance of the related art backlight unit driven by the zeroth PWM signal PWM0 of FIG. 17A. In FIGS. 17A and 17B, the total luminance is calculated from the sum of areas corresponding to protruding rectangles of the luminance graph.

In the backlight unit of FIG. 13A, a plurality of LED arrays are separated into six groups driven by six PWM signals having phase differences, as shown in FIGS. 14B, 15B, 16B and 17B. As a result, deterioration in the image display quality of the liquid crystal display panel, such as a wavy noise, due to the variation in the OFF current of each TFT of the liquid crystal display panel is prevented without a reduction in total luminance.

Figure 18A:
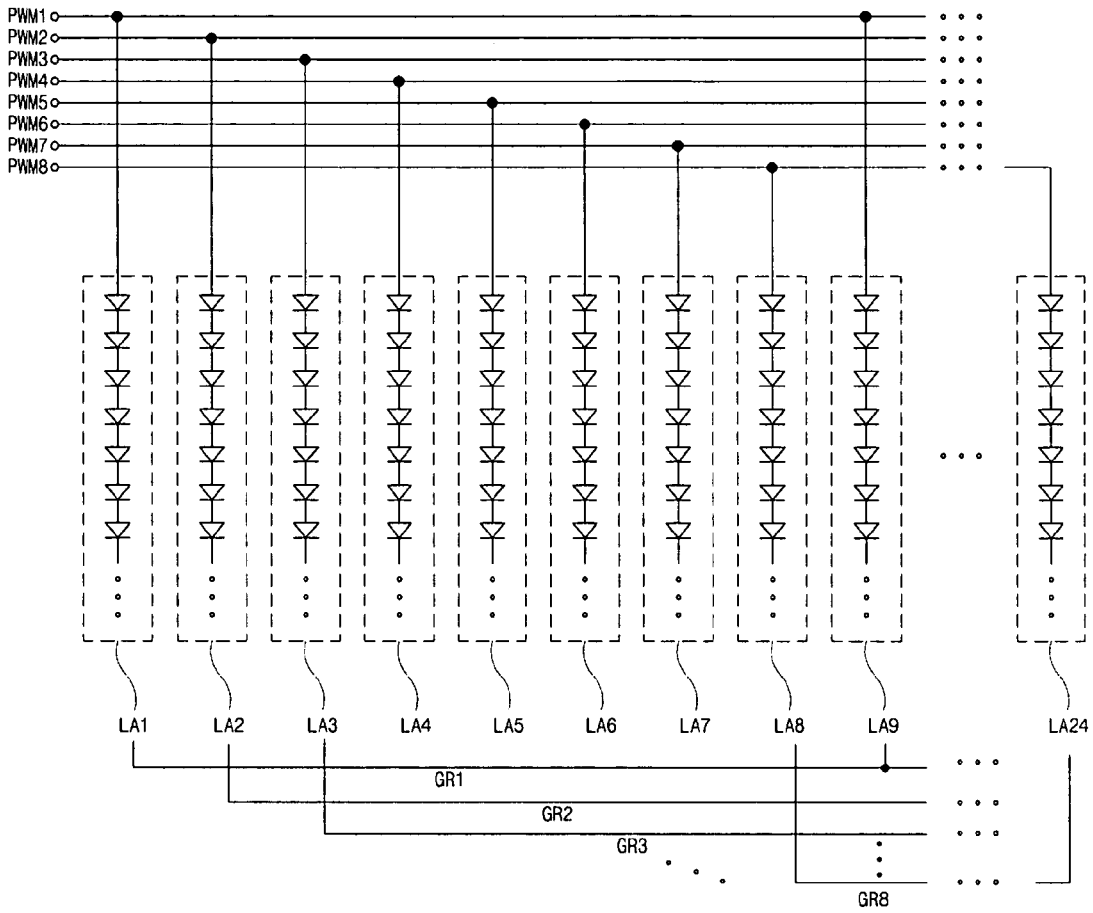
FIG. 18A is a block diagram of an LED array unit of a backlight unit for a liquid crystal display device according to an embodiment of the invention having eight groups of arrays.
Figure 18B:
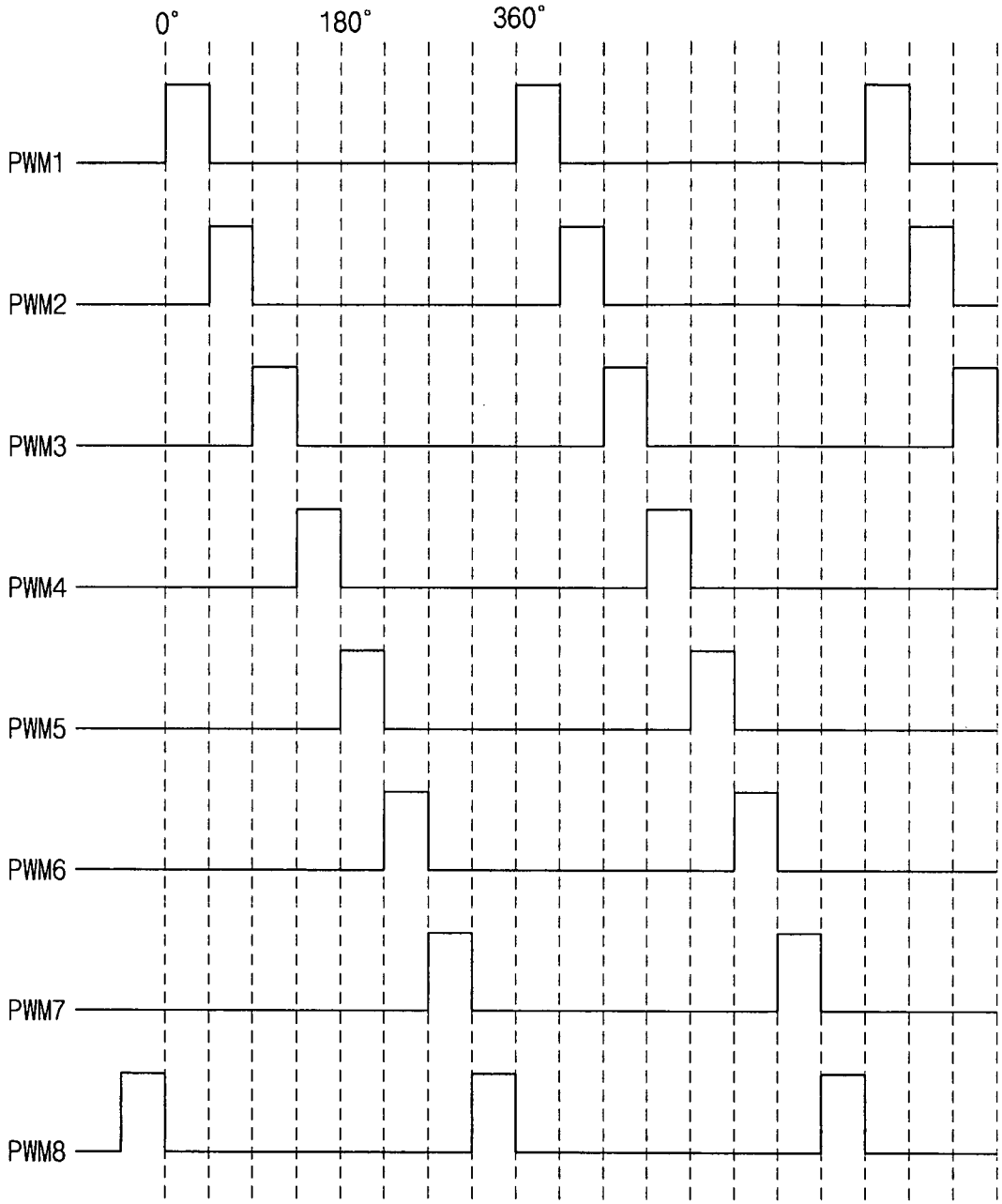
FIG. 18B is a timing chart of eight PWM signals for the backlight unit shown in FIG. 18A.

FIG. 18A is a block diagram of an LED array unit of a backlight unit for a liquid crystal display device according to an embodiment of the invention having eight groups of arrays. FIG. 18B is a timing chart of eight PWM signals for the backlight unit shown in FIG. 18A. As shown in FIG. 18A, an LED array unit includes first to twenty-fourth LED arrays LA1 to LA24. The first to twenty-fourth LED arrays LA1 to LA24 are separated into first to eighth groups GR1 to GR8. As a result, the first, ninth and seventeenth LED arrays LA1, LA9 and LA17 of the first group GR1 are electrically connected to each other, and the second, tenth and eighteenth LED arrays LA2, LA10 and LA18 of the second group GR2 are electrically connected to each other. Similarly, the third, eleventh and nineteenth LED arrays LA3, LA11 and LA19 of the third group GR3 are electrically connected to each other, and the fourth, twelfth and twentieth LED arrays LA4, LA12 and LA20 of the fourth group GR4 are electrically connected to each other. Further, the fifth, thirteenth and twenty-first LED arrays LA5, LA13 and LA21 of the fifth group GR5 are electrically connected to each other, the sixth, fourteenth and twenty-second LED arrays LA6, LA14 and LA22 of the sixth group GR6 are electrically connected to each other, the seventh, fifteenth and twenty-third LED arrays LA7, LA15 and LA23 of the seventh group GR7 are electrically connected to each other, and the eighth, sixteenth and twenty-fourth LED arrays LA8, LA16 and LA24 of the eighth group GR8 are electrically connected to each other.

A first PWM signal PWM1 is supplied to the first, ninth and seventeenth LED arrays LA1, LA9 and LA17 of the first group GR1, and a second PWM signal PWM2 is supplied to the second, tenth and eighteenth LED arrays LA2, LA10 and LA18 of the second group GR2. Similarly, a third PWM signal PWM3 is supplied to the third, eleventh and nineteenth LED arrays LA3, LA11 and LA19 of the third group GR3, and a fourth PWM signal PWM4 is supplied to the fourth, twelfth and twentieth LED arrays LA4, LA12 and LA20 of the fourth group GR4. Further, a fifth PWM signal PWM5 is supplied to the fifth, thirteenth and twenty-first LED arrays LA5, LA13 and LA21 of the fifth group GR5, a sixth PWM signal PWM64 is supplied to the sixth, fourteenth and twenty-second LED arrays LA6, LA14 and LA22 of the sixth group GR6, a seventh PWM signal PWM7 is supplied to the seventh, fifteenth and twenty-third LED arrays LA7, LA15 and LA23 of the seventh group GR7, and an eighth PWM signal PWM8 is supplied to the eighth, sixteenth and twenty-fourth LED arrays LA8, LA16 and LA24 of the eighth group GR8.

As shown in FIG. 18B, the first to eighth PWM signals PWM1 to PWM8 have a duty ratio of about 12.5% and an identical frequency. In addition, the phase difference between neighboring two of the first to eighth PWM signals PWM1 to PWM8 is about 45°. Although the duty ratio of the first to eighth PWM signals PWM1 to PWM8 of FIG. 18B is about 12.5%, the duty ratio of t the first to eighth PWM signals PWM1 to PWM8 can be selected from values in a range of about 1% to about 99%.

Since the first to eighth groups GR1 to GR8 are driven by the first to eighth PWM signals PWM1 to PWM8, respectively, the first group GR1 including the first, ninth and seventeenth LED arrays LA1, LA9 and LA17, the second group GR2 including the second, tenth and eighteenth LED arrays LA2, LA10 and LA18, the third group GR3 including the third, eleventh and nineteenth LED arrays LA3, LA11 and LA19, the fourth group GR4 including the fourth, twelfth and twentieth LED arrays LA4, LA12 and LA20, the fifth group GR5 including the fifth, thirteenth and twenty-first LED arrays LA5, LA13 and LA21, the sixth group GR6 including the sixth, fourteenth and twenty-second LED arrays LA6, LA14 and LA22, the seventh group GR7 including the seventh, fifteenth and twenty-third LED arrays LA7, LA15 and LA23, and the eighth group GR8 including the eighth, sixteenth and twenty-fourth LED arrays LA8, LA16 and LA24 are turned ON/OFF alternately with one another. Accordingly, the second, tenth and eighteenth LED arrays LA2, LA10 and LA18 of the second group GR2 are turned ON after the first, ninth and seventeenth LED arrays LA1, LA9 and LA17 of the first group GR1 are turned OFF, and the third, eleventh and nineteenth LED arrays LA3, LA11 and LA19 of the third group GR3 are turned ON after the second, tenth and eighteenth LED arrays LA2, LA10 and LA18 of the second group GR2 are turned OFF. Similarly, the fourth, twelfth and twentieth LED arrays LA4, LA12 and LA20 of the fourth group GR4 are turned ON after the third, eleventh and nineteenth LED arrays LA3, LA11 and LA19 of the third group GR3 are turned OFF, and the fifth, thirteenth and twenty-first LED arrays LA5, LA13 and LA21 of the fifth group GR5 are turned ON after the fourth, twelfth and twentieth LED arrays LA4, LA12 and LA20 of the fourth group GR4 are turned OFF. Further, the sixth, fourteenth and twenty-second LED arrays LA6, LA14 and LA22 of the sixth group GR6 are turned ON after the fifth, thirteenth and twenty-first LED arrays LA5, LA13 and LA21 of the fifth group GR5 are turned OFF, the seventh, fifteenth and twenty-third LED arrays LA7, LA15 and LA23 of the seventh group GR7 are turned ON after the sixth, fourteenth and twenty-second LED arrays LA6, LA14 and LA22 of the sixth group GR6 are turned OFF, and the eighth, sixteenth and twenty-fourth LED arrays LA8, LA16 and LA24 of the eighth group GR8 are turned ON after the seventh, fifteenth and twenty-third LED arrays LA7, LA15 and LA23 of the seventh group GR7 are turned OFF. After the eighth, sixteenth and twenty-fourth LED arrays LA8, LA16 of the eighth group GR8 are turned OFF, the first, ninth and seventeenth LED arrays LA1, LA9 and LA17 of the first group GR1 are turned ON again.

Because the number (i.e., 3) of the LED arrays emitting light at a time of the backlight unit using the first to eighth PWM signals PWM1 to PWM8 of FIG. 18A is smaller than the number (i.e., 24) of the LED arrays emitting light at a time of the backlight unit using a single PWM signal of FIG. 1, an instant luminance of the backlight unit using the first to eighth PWM signals PWM1 to PWM8 is about one eighth of an instant luminance of the backlight unit using the single PWM signal. As a result, the variation in the OFF current of each TFT in the liquid crystal display panel is reduced due to reducing the change of instant luminance of the incident light from the backlight unit. Thus, deterioration in the display quality of the liquid crystal display panel, such as a wavy noise, due to the variation in the OFF current of each TFT is prevented.

In addition, although the instant luminance of the first to twenty-fourth LED arrays LA1 to LA24 alternately turned ON/OFF by the first to eighth PWM signals PWM1 to PWM8 is about one eighth of the instant luminance of the first to twenty-fourth LED arrays LA1 to LA24 simultaneously turned ON/OFF by the single PWM signal, a total luminance of the first to twenty-fourth LED arrays LA1 to LA24 alternately turned ON/OFF is substantially the same as a total luminance of the first to twenty-fourth LED arrays LA1 to LA24 simultaneously turned ON/OFF because the backlight unit using the first to eighth PWM signals PWM1 to PWM8 emits light more frequently. Accordingly, the LCD device having the backlight unit according to embodiments of the invention has no reduction in brightness as compared to a LCD device having the related art backlight unit.

Figure 19A:
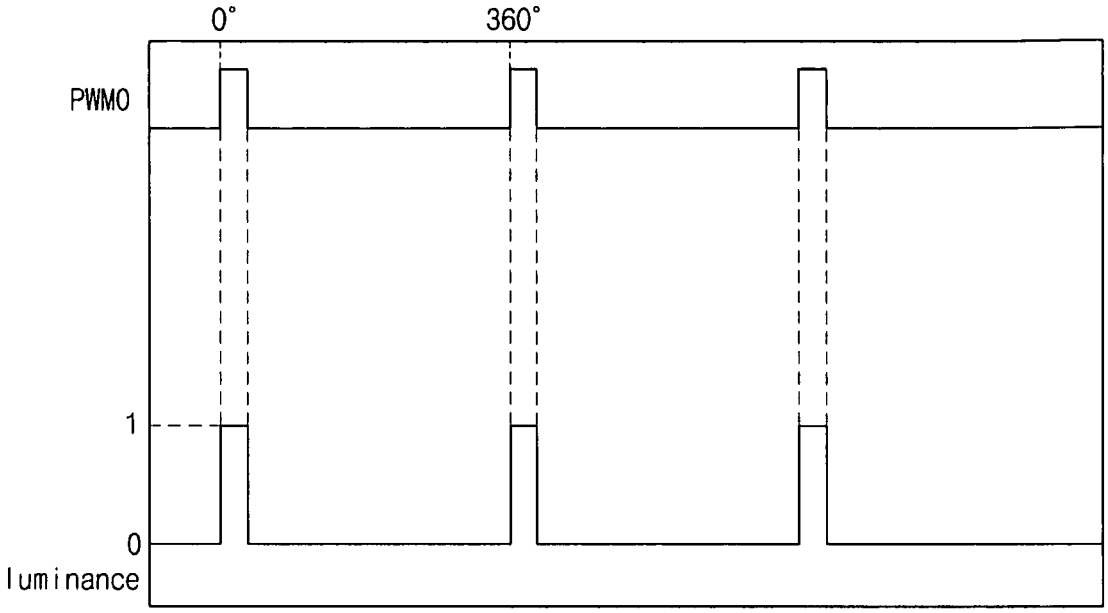
FIG. 19A shows the resulting luminance for a related art backlight unit from a single PWM signal having a duty ratio of about 10%.
Figure 19B:
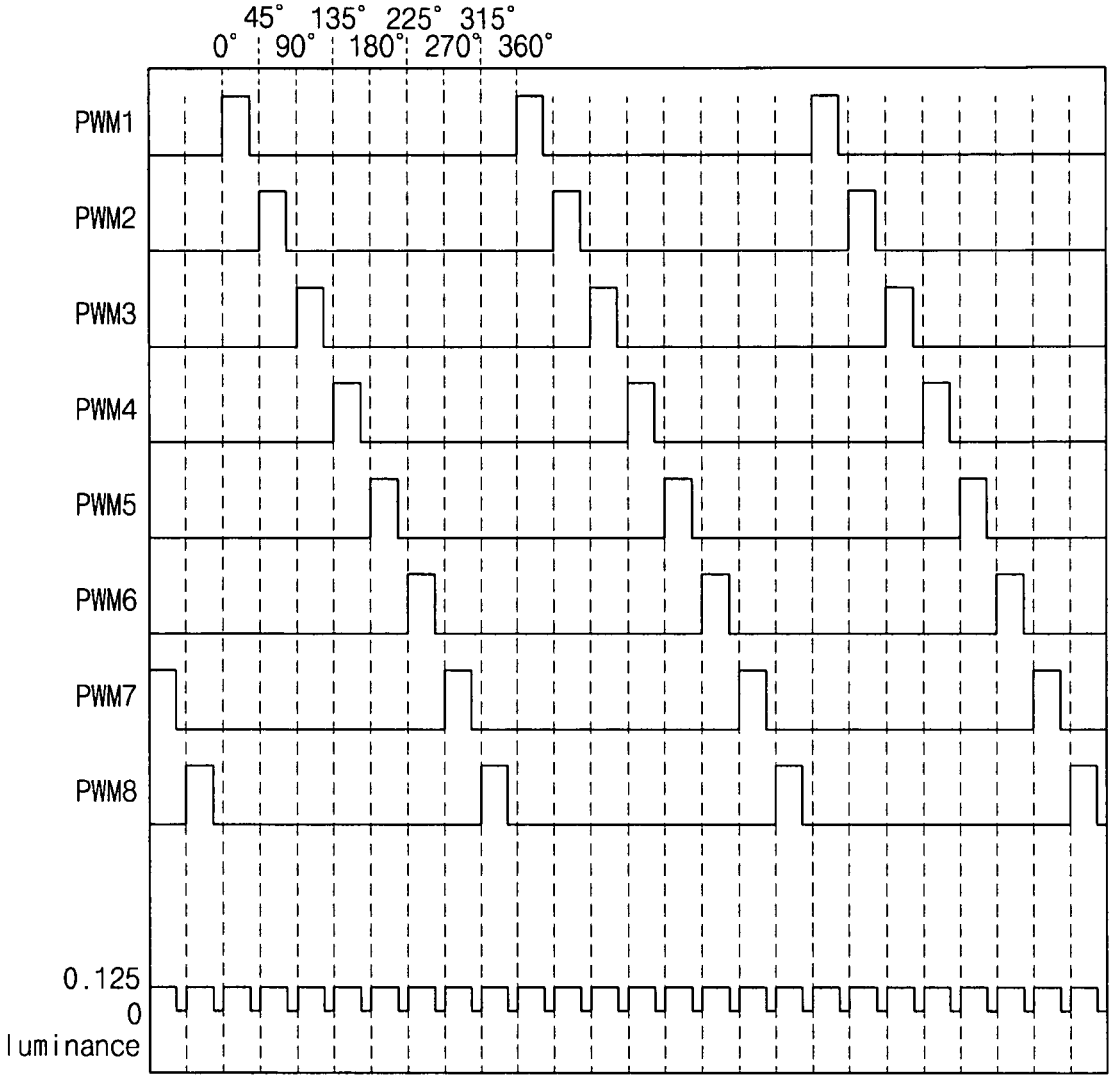
FIG. 19B shows the resulting luminance for the backlight unit shown in FIG. 18A from eight PWM signals having a phase difference of about 45° and a duty ratio of about 10%.

FIG. 19A shows the resulting luminance for a related art backlight unit from a single PWM signal having a duty ratio of about 10%. FIG. 19B shows the resulting luminance for the backlight unit shown in FIG. 18A from eight PWM signals having a phase difference of about 45° and a duty ratio of about 10%. As shown in FIG. 19A, a single zeroth PWM signal PWM0 having a duty ratio of about 10% is supplied to a related art backlight unit having first to twenty-fourth LED arrays LA1 to LA24. The single zeroth PWM signal PWM0 has a predetermined frequency and a predetermined voltage. Since the first to twenty-fourth LED arrays LA1 to LA24 are simultaneously turned ON/OFF according to the zeroth PWM signal PWM0, the luminance of the first to twenty-fourth LED arrays LA1 to LA24 has a value of 0 or 1. The luminance can be measured as an electric signal by using a photo diode. The maximum and minimum values in luminance are represented as 1 and 0, respectively, for comparison purposes.

As shown in FIG. 19B, first to eighth PWM signals PWM1 to PWM8 each having a duty ratio of about 10% are supplied to a backlight unit having first to twenty-fourth LED arrays LA1 to LA24. As a result, the first, ninth and seventeenth LED arrays LA1, LA9 and LA17 of the first group GR1 of FIG. 18A are turned ON/OFF according to the first PWM signal PWM1, and the second, tenth and eighteenth LED arrays LA2, LA10 and LA18 of the second group GR2 of FIG. 18A are turned ON/OFF according to the second PWM signal PWM2. Similarly, the third, eleventh and nineteenth LED arrays LA3, LA11 and LA19 of the third group GR3 of FIG. 18A are turned ON/OFF according to the third PWM signal PWM3, and the fourth, twelfth and twentieth LED arrays LA4, LA12 and LA20 of the fourth group GR4 of FIG. 18A are turned ON/OFF according to the fourth PWM signal PWM4. Further, the fifth, thirteenth and twenty-first LED arrays LA5, LA13 and LA21 of the fifth group GR5 of FIG. 18A are turned ON/OFF according to the fifth PWM signal PWM5, and the sixth, fourteenth and twenty-second LED arrays LA6, LA14 and LA22 of the sixth group GR6 of FIG. 18A are turned ON/OFF according to the sixth PWM signal PWM6, the seventh, fifteenth and twenty-third LED arrays LA7, LA15 and LA23 of the seventh group GR7 of FIG. 18A are turned ON/OFF according to the seventh PWM signal PWM7, and the eighth, sixteenth and twenty-fourth LED arrays LA8, LA16 and LA24 of the eighth group GR8 are turned ON/OFF according to the eighth PWM signal PWM8.

The first to eighth PWM signals PWM1 to PWM8 have the same frequency, the same voltage and the same duty ratio as the zeroth PWM signal PWM0 of FIG. 19A. In addition, neighboring two of the first to eighth PWM signals PWM1 to PWM8 have a phase difference of about 45° with each another. As a result, the second PWM signal PWM2 has a phase delayed by about 45° with respect to the first PWM signal PWM1, and the third PWM signal PWM3 has a phase delayed by about 90° with respect to the first PWM signal PWM1. Further, the fourth PWM signal PWM4 has a phase delayed by about 135° with respect to the first PWM signal PWM1, the fifth PWM signal PWM5 has a phase delayed by about 180° with respect to the first PWM signal PWM1, the sixth PWM signal PWM6 has a phase delayed by about 225° with respect to the first PWM signal PWM1, the seventh PWM signal PWM7 has a phase delayed by about 270° with respect to the first PWM signal PWM1, and the eighth PWM signal PWM8 has a phase delayed by about 315° with respect to the first PWM signal PWM1. Accordingly, the first group GR1 including the first, ninth and seventeenth LED arrays LA1, LA9 and LA17, the second group GR2 including the second, tenth and eighteenth LED arrays LA2, LA10 and LA18, the third group GR3 including the third, eleventh and nineteenth LED arrays LA3, LA11 and LA19, the fourth group GR4 including the fourth, twelfth and twentieth LED arrays LA4, LA12 and LA20, the fifth group GR5 including the fifth, thirteenth and twenty-first LED arrays LA5, LA13 and LA21, the sixth group GR6 including the sixth, fourteenth and twenty-second LED arrays LA6, LA14 and LA22, the seventh group GR7 including the seventh, fifteenth and twenty-third LED arrays LA7, LA15 and LA23, and the eighth group GR8 including the eighth, sixteenth and twenty-fourth LED arrays LA8, LA16 and LA24 are alternately turned ON/OFF.

In the instant of emitting light, since the number (i.e., 3) of emitting LED arrays of the backlight unit of FIG. 18A driven by one of the first to eighth PWM signals PWM1 to PWM8 of FIG. 19B is one eighth of the number (i.e., 24) of emitting LED arrays of a related art backlight unit driven by the zeroth PWM signal PWM0 of FIG. 19A, the instant luminance of the backlight unit of FIG. 18A driven by one of the first to eighth PWM signals PWM1 to PWM8 of FIG. 19B is substantially one eighth of the luminance of the related art backlight unit driven by the zeroth PWM signal PWM0 of FIG. 19A. During a predetermined time period, however, since the number of emission times of the backlight unit of FIG. 18A driven by the first to eighth PWM signals PWM1 to PWM8 of FIG. 19B is substantially eight times the number of emission times of the related art backlight unit driven by the zeroth PWM signal PWM0 of FIG. 19A, the total luminance of the backlight unit of FIG. 18A driven by the first to eighth PWM signals PWM1 to PWM8 of FIG. 19B is substantially the same as the total luminance of the related art backlight unit driven by the zeroth PWM signal PWM0 of FIG. 19A. In FIGS. 19A and 19B, the total luminance is calculated from the sum of areas corresponding to protruding rectangles of the luminance graph.

Figure 20A:
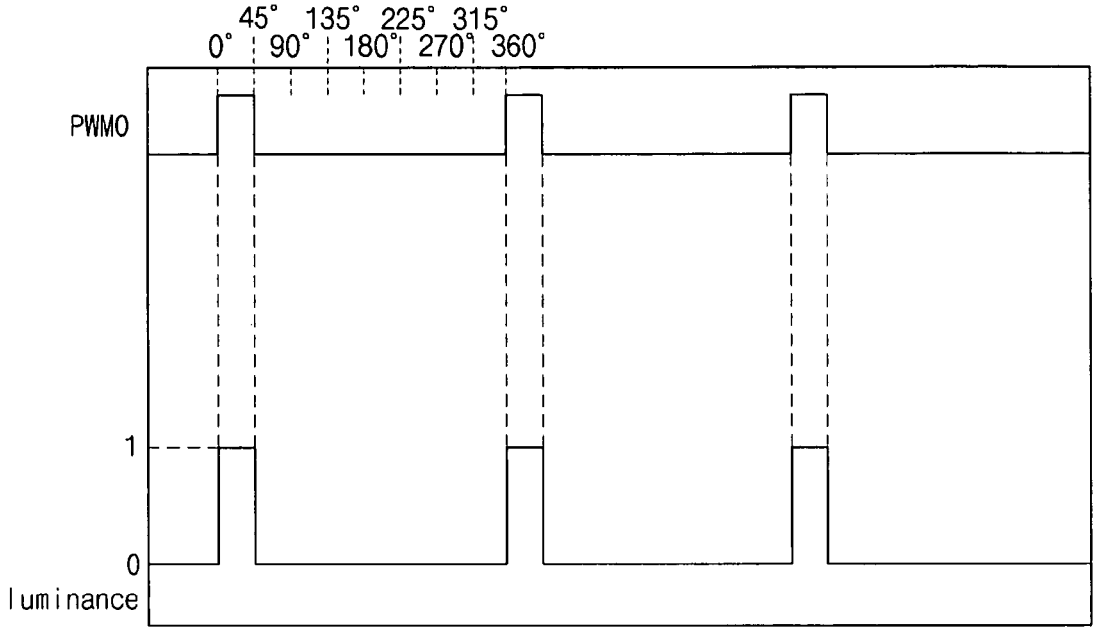
FIG. 20A shows the resulting luminance for a related art backlight unit from a single PWM signal having a duty ratio of about 12.5%.
Figure 20B:
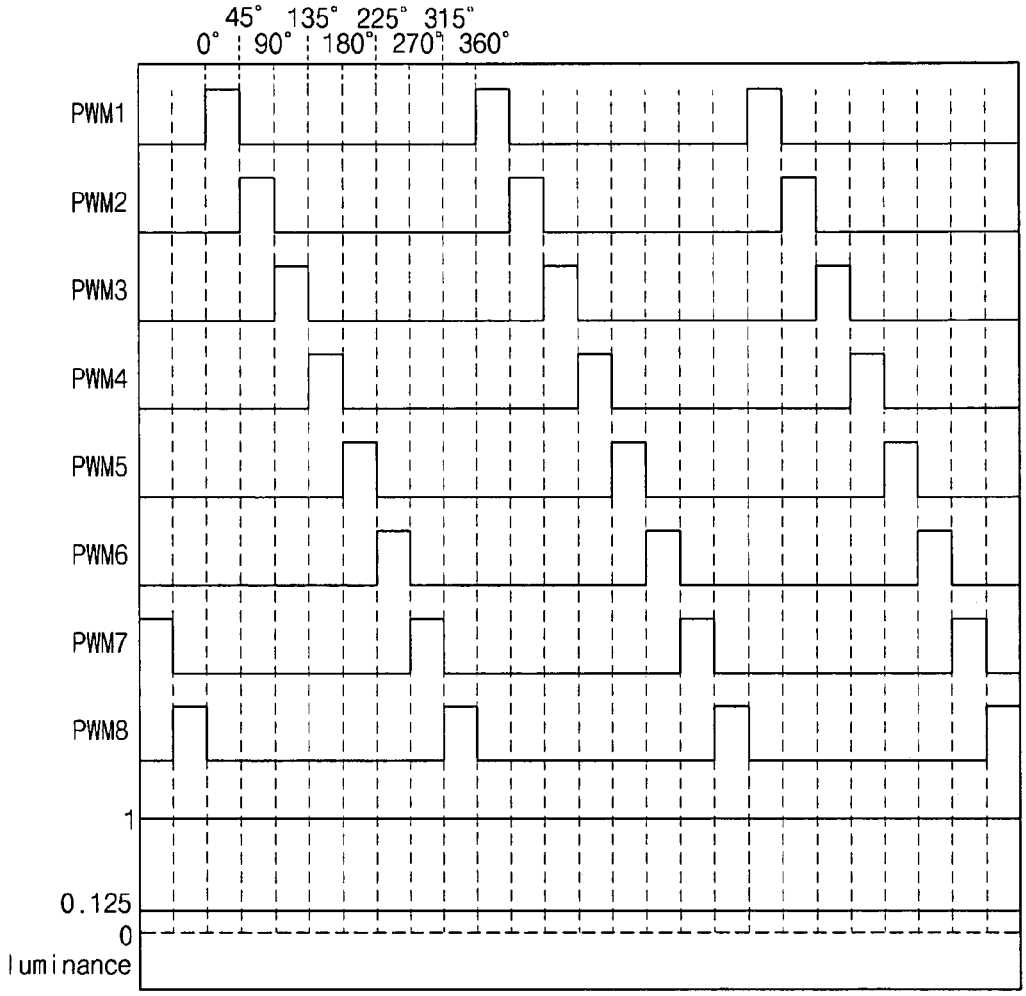
FIG. 20B shows the resulting luminance for the backlight unit shown in FIG. 18A from eight PWM signals having a phase difference of about 45° and a duty ratio of about 12.5%.

FIG. 20A shows the resulting luminance for a related art backlight unit from a single PWM signal having a duty ratio of about 12.5%. FIG. 20B shows the resulting luminance for the backlight unit shown in FIG. 18A from eight PWM signals having a phase difference of about 45° and a duty ratio of about 12.5%. As shown in FIG. 20A, a single zeroth PWM signal PWM0 having a duty ratio of about 50% is supplied to a related art backlight unit having first to twenty-fourth LED arrays LA1 to LA24. The single zeroth PWM signal PWM0 has a predetermined frequency and a predetermined voltage. Since the first to twenty-fourth LED arrays LA1 to LA24 are simultaneously turned ON/OFF according to the zeroth PWM signal PWM0, the luminance of the first to twenty-fourth LED arrays LA1 to LA24 has a value of 0 or 1. The luminance can be measured as an electric signal by using a photo diode. The maximum and minimum values in luminance are represented as 1 and 0, respectively, for comparison purposes.

As shown in FIG. 20B, first to eighth PWM signals PWM1 to PWM8 each having a duty ratio of about 50% are supplied to a backlight unit having first to twenty-fourth LED arrays LA1 to LA24. As a result, the first, ninth and seventeenth LED arrays LA1, LA9 and LA17 of the first group GR1 of FIG. 18A are turned ON/OFF according to the first PWM signal PWM1, and the second, tenth and eighteenth LED arrays LA2, LA10 and LA18 of the second group GR2 of FIG. 18A are turned ON/OFF according to the second PWM signal PWM2. Similarly, the third, eleventh and nineteenth LED arrays LA3, LA11 and LA19 of the third group GR3 of FIG. 18A are turned ON/OFF according to the third PWM signal PWM3, and the fourth, twelfth and twentieth LED arrays LA4, LA12 and LA20 of the fourth group GR4 of FIG. 18A are turned ON/OFF according to the fourth PWM signal PWM4. Further, the fifth, thirteenth and twenty-first LED arrays LA5, LA13 and LA21 of the fifth group GR5 of FIG. 18A are turned ON/OFF according to the fifth PWM signal PWM5, and the sixth, fourteenth and twenty-second LED arrays LA6, LA14 and LA22 of the sixth group GR6 of FIG. 18A are turned ON/OFF according to the sixth PWM signal PWM6, the seventh, fifteenth and twenty-third LED arrays LA7, LA15 and LA23 of the seventh group GR7 of FIG. 18A are turned ON/OFF according to the seventh PWM signal PWM7, and the eighth, sixteenth and twenty-fourth LED arrays LA8, LA16 and LA24 of the eighth group GR8 are turned ON/OFF according to the eighth PWM signal PWM8.

The first to eighth PWM signals PWM1 to PWM8 have the same frequency, the same voltage and the same duty ratio as the zeroth PWM signal PWM0 of FIG. 20A. In addition, neighboring two of the first to eighth PWM signals PWM1 to PWM8 have a phase difference of about 45° with each another. As a result, the second PWM signal PWM2 has a phase delayed by about 45° with respect to the first PWM signal PWM1, and the third PWM signal PWM3 has a phase delayed by about 90° with respect to the first PWM signal PWM1. Further, the fourth PWM signal PWM4 has a phase delayed by about 135° with respect to the first PWM signal PWM1, the fifth PWM signal PWM5 has a phase delayed by about 180° with respect to the first PWM signal PWM1, the sixth PWM signal PWM6 has a phase delayed by about 225° with respect to the first PWM signal PWM1, the seventh PWM signal PWM7 has a phase delayed by about 270° with respect to the first PWM signal PWM1, and the eighth PWM signal PWM8 has a phase delayed by about 315° with respect to the first PWM signal PWM1. Accordingly, the first group GR1 including the first, ninth and seventeenth LED arrays LA1, LA9 and LA17, the second group GR2 including the second, tenth and eighteenth LED arrays LA2, LA10 and LA18, the third group GR3 including the third, eleventh and nineteenth LED arrays LA3, LA11 and LA19, the fourth group GR4 including the fourth, twelfth and twentieth LED arrays LA4, LA12 and LA20, the fifth group GR5 including the fifth, thirteenth and twenty-first LED arrays LA5, LA13 and LA21, the sixth group GR6 including the sixth, fourteenth and twenty-second LED arrays LA6, LA14 and LA22, the seventh group GR7 including the seventh, fifteenth and twenty-third LED arrays LA7, LA15 and LA23, and the eighth group GR8 including the eighth, sixteenth and twenty-fourth LED arrays LA8, LA16 and LA24 are alternately turned ON/OFF.

In the instant of emitting light, since the number (i.e., 3) of emitting LED arrays of the backlight unit of FIG. 18A driven by one of the first to eighth PWM signals PWM1 to PWM8 of FIG. 20B is one eighth of the number (i.e., 24) of emitting LED arrays of a related art backlight unit driven by the zeroth PWM signal PWM0 of FIG. 20A, the instant luminance of the backlight unit of FIG. 18A driven by one of the first to eighth PWM signals PWM1 to PWM8 of FIG. 20B is substantially one eighth of the luminance of the related art backlight unit driven by the zeroth PWM signal PWM0 of FIG. 20A. During a predetermined time period, however, since the number of emission times of the backlight unit of FIG. 18A driven by the first to eighth PWM signals PWM1 to PWM8 of FIG. 20B is substantially eight times the number of emission times of the related art backlight unit driven by the zeroth PWM signal PWM0 of FIG. 20A, the total luminance of the backlight unit of FIG. 18A driven by the first to eighth PWM signals PWM1 to PWM8 of FIG. 20B is substantially the same as the total luminance of the related art backlight unit driven by the zeroth PWM signal PWM0 of FIG. 20A. In FIGS. 20A and 20B, the total luminance is calculated from the sum of areas corresponding to protruding rectangles of the luminance graph.

Specifically, since the instant luminance of the backlight unit of FIG. 20B is a constant value of about 0.125 at anytime, the backlight unit supplies light without a variation in luminance to the liquid crystal display panel. As a result, the variation in the OFF current of each TFT of the liquid crystal display panel is eliminated and deterioration in the image display quality of the liquid crystal display panel, such as a wavy noise, is prevented.

Figure 21A:
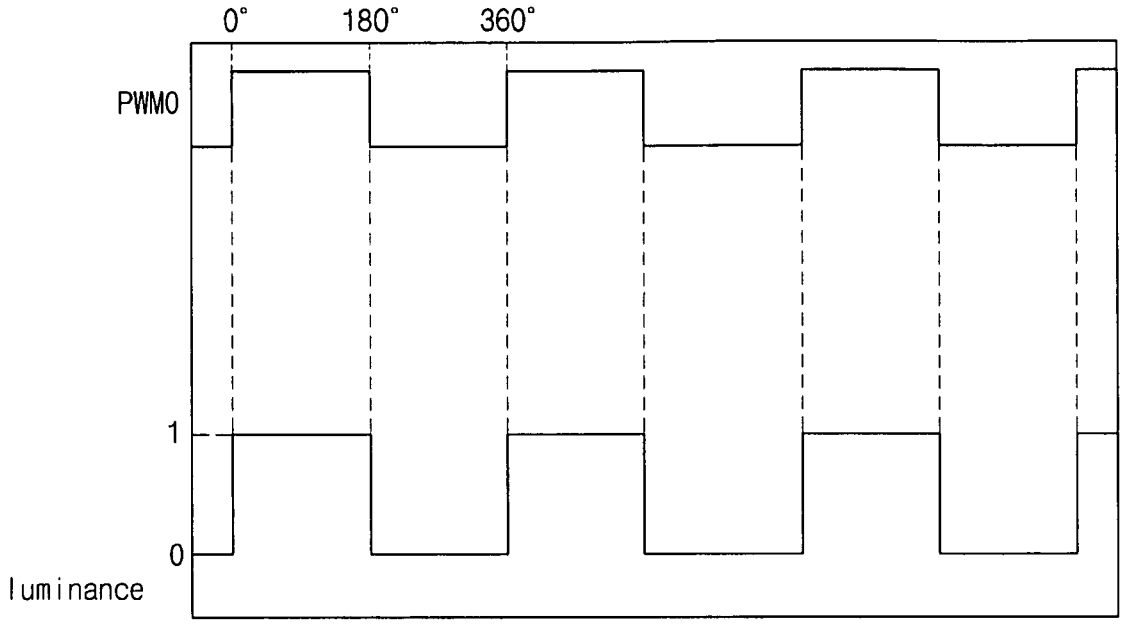
FIG. 21A shows the resulting luminance for a related art backlight unit from a single PWM signal having a duty ratio of about 50%.
Figure 21B:
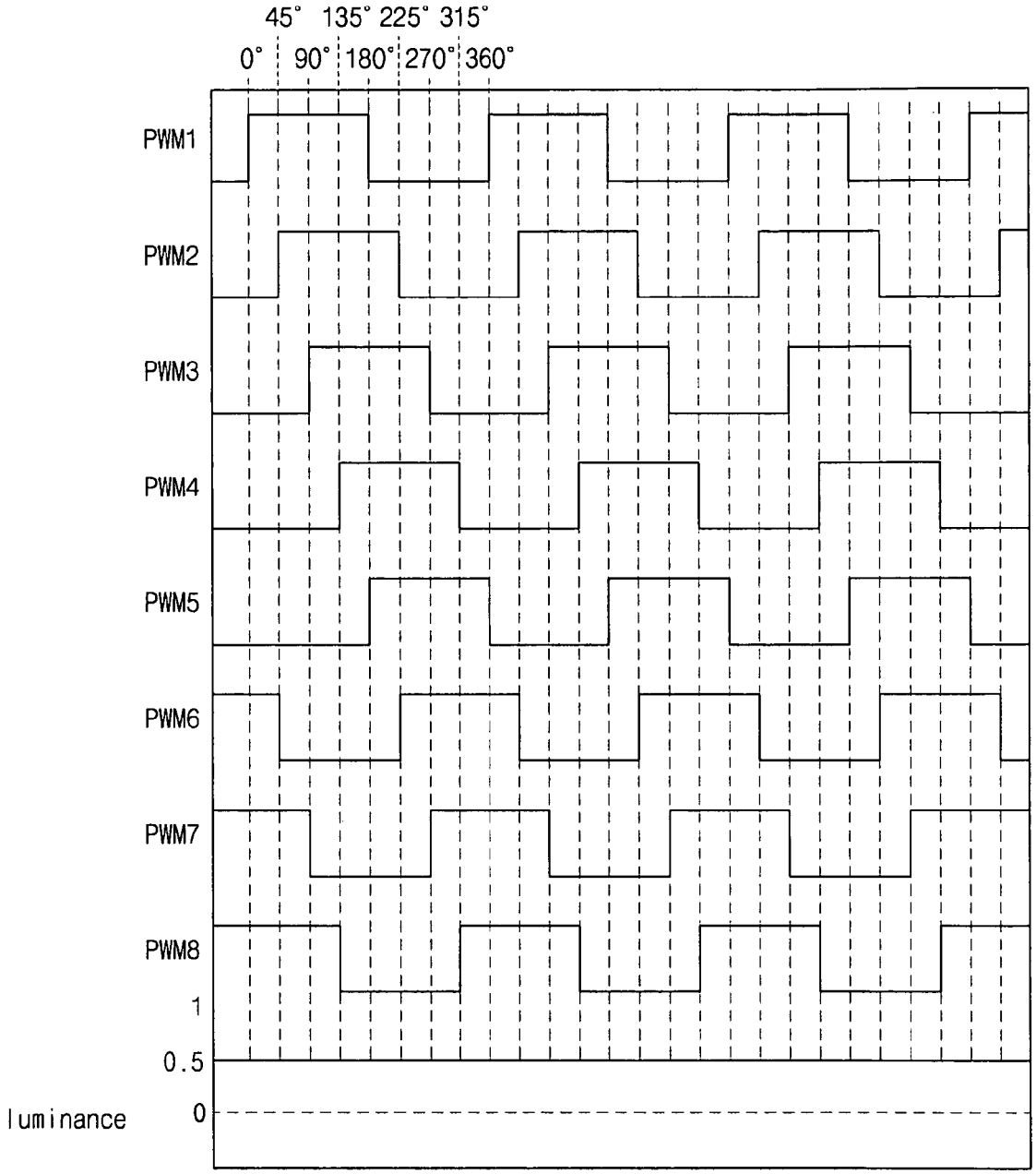
FIG. 21B shows the resulting luminance for the backlight unit shown in FIG. 18A from eight PWM signals having a phase difference of about 45° and a duty ratio of about 50%.

FIG. 21A shows the resulting luminance for a related art backlight unit from a single PWM signal having a duty ratio of about 50%. FIG. 21B shows the resulting luminance for the backlight unit shown in FIG. 18A from eight PWM signals having a phase difference of about 45° and a duty ratio of about 50%. As shown in FIG. 21A, a single zeroth PWM signal PWM0 having a duty ratio of about 50% is supplied to a related art backlight unit having first to twenty-fourth LED arrays LA1 to LA24. The single zeroth PWM signal PWM0 has a predetermined frequency and a predetermined voltage. Since the first to twenty-fourth LED arrays LA1 to LA24 are simultaneously turned ON/OFF according to the single zeroth PWM signal PWM0, the luminance of the first to twenty-fourth LED arrays LA1 to LA24 has a value of 0 or 1. The luminance can be measured as an electric signal by using a photo diode. The maximum and minimum values in luminance are represented as 1 and 0, respectively, for comparison purposes.

As shown in FIG. 21B, first to eighth PWM signals PWM1 to PWM8 each having a duty ratio of about 50% are supplied to a backlight unit having first to twenty-fourth LED arrays LA1 to LA24. As a result, the first, ninth and seventeenth LED arrays LA1, LA9 and LA17 of the first group GR1 of FIG. 18A are turned ON/OFF according to the first PWM signal PWM1, and the second, tenth and eighteenth LED arrays LA2, LA10 and LA18 of the second group GR2 of FIG. 18A are turned ON/OFF according to the second PWM signal PWM2. Similarly, the third, eleventh and nineteenth LED arrays LA3, LA11 and LA19 of the third group GR3 of FIG. 18A are turned ON/OFF according to the third PWM signal PWM3, and the fourth, twelfth and twentieth LED arrays LA4, LA12 and LA20 of the fourth group GR4 of FIG. 18A are turned ON/OFF according to the fourth PWM signal PWM4. Further, the fifth, thirteenth and twenty-first LED arrays LA5, LA13 and LA21 of the fifth group GR5 of FIG. 18A are turned ON/OFF according to the fifth PWM signal PWM5, and the sixth, fourteenth and twenty-second LED arrays LA6, LA14 and LA22 of the sixth group GR6 of FIG. 18A are turned ON/OFF according to the sixth PWM signal PWM6, the seventh, fifteenth and twenty-third LED arrays LA7, LA15 and LA23 of the seventh group GR7 of FIG. 18A are turned ON/OFF according to the seventh PWM signal PWM7, and the eighth, sixteenth and twenty-fourth LED arrays LA8, LA16 and LA24 of the eighth group GR8 of FIG. 18A are turned ON/OFF according to the eighth PWM signal PWM8.

The first to eighth PWM signals PWM1 to PWM8 have the same frequency, the same voltage and the same duty ratio as the zeroth PWM signal PWM0 of FIG. 21A. In addition, neighboring two of the first to eighth PWM signals PWM1 to PWM8 have a phase difference of about 45° with each another. As a result, the second PWM signal PWM2 has a phase delayed by about 45° with respect to the first PWM signal PWM1, and the third PWM signal PWM3 has a phase delayed by about 90° with respect to the first PWM signal PWM1. Further, the fourth PWM signal PWM4 has a phase delayed by about 135° with respect to the first PWM signal PWM1, the fifth PWM signal PWM5 has a phase delayed by about 180° with respect to the first PWM signal PWM1, the sixth PWM signal PWM6 has a phase delayed by about 225° with respect to the first PWM signal PWM1, the seventh PWM signal PWM7 has a phase delayed by about 270° with respect to the first PWM signal PWM1, and the eighth PWM signal PWM8 has a phase delayed by about 315° with respect to the first PWM signal PWM1. Accordingly, the first group GR1 including the first, ninth and seventeenth LED arrays LA1, LA9 and LA17, the second group GR2 including the second, tenth and eighteenth LED arrays LA2, LA10 and LA18, the third group GR3 including the third, eleventh and nineteenth LED arrays LA3, LA11 and LA19, the fourth group GR4 including the fourth, twelfth and twentieth LED arrays LA4, LA12 and LA20, the fifth group GR5 including the fifth, thirteenth and twenty-first LED arrays LA5, LA13 and LA21, the sixth group GR6 including the sixth, fourteenth and twenty-second LED arrays LA6, LA14 and LA22, the seventh group GR7 including the seventh, fifteenth and twenty-third LED arrays LA7, LA15 and LA23, and the eighth group GR8 including the eighth, sixteenth and twenty-fourth LED arrays LA8, LA16 and LA24 are alternately turned ON/OFF.

In the instant of emitting light, since the number (i.e., 3) of emitting LED arrays of the backlight unit of FIG. 18A driven by one of the first to eighth PWM signals PWM1 to PWM8 of FIG. 21B is one eighth of the number (i.e., 24) of emitting LED arrays of a related art backlight unit driven by the zeroth PWM signal PWM0 of FIG. 21A, the instant luminance of the backlight unit of FIG. 18A driven by one of the first to eighth PWM signals PWM1 to PWM8 of FIG. 21B is substantially one eighth of the luminance of the related art backlight unit driven by the zeroth PWM signal PWM0 of FIG. 21A. During a predetermined time period, however, since the number of emission times of the backlight unit of FIG. 18A driven by the first to eighth PWM signals PWM1 to PWM8 of FIG. 21B is substantially eight times the number of emission times of the related art backlight unit driven by the zeroth PWM signal PWM0 of FIG. 21A, the total luminance of the backlight unit of FIG. 18A driven by the first to eighth PWM signals PWM1 to PWM8 of FIG. 21B is substantially the same as the total luminance of the related art backlight unit driven by the zeroth PWM signal PWM0 of FIG. 21A. In FIGS. 21A and 21B, the total luminance is calculated from the sum of areas corresponding to protruding rectangles of the luminance graph.

Specifically, since the instant luminance of the backlight unit of FIG. 21B is a constant value of about 0.5 at anytime, the backlight unit supplies light without a variation in luminance to the liquid crystal display panel. As a result, the variation in the OFF current of each TFT of the liquid crystal display panel is eliminated and deterioration in the image display quality of the liquid crystal display panel, such as a wavy noise, is prevented.

Figure 22A:
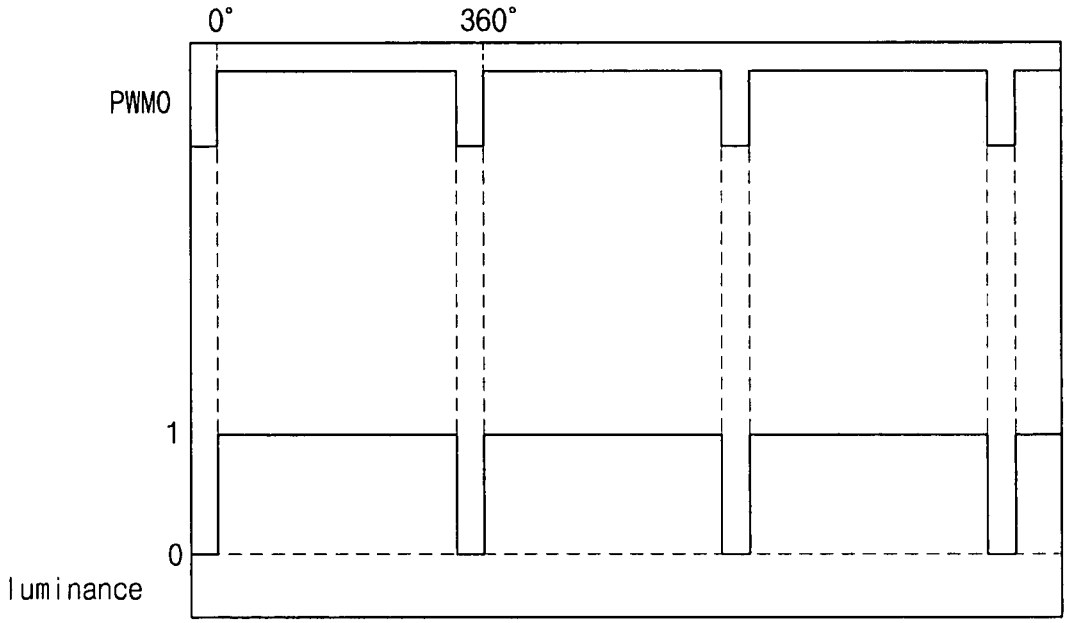
FIG. 22A shows the resulting luminance for a related art backlight unit from a single PWM signal having a duty ratio of about 90%.
Figure 22B:
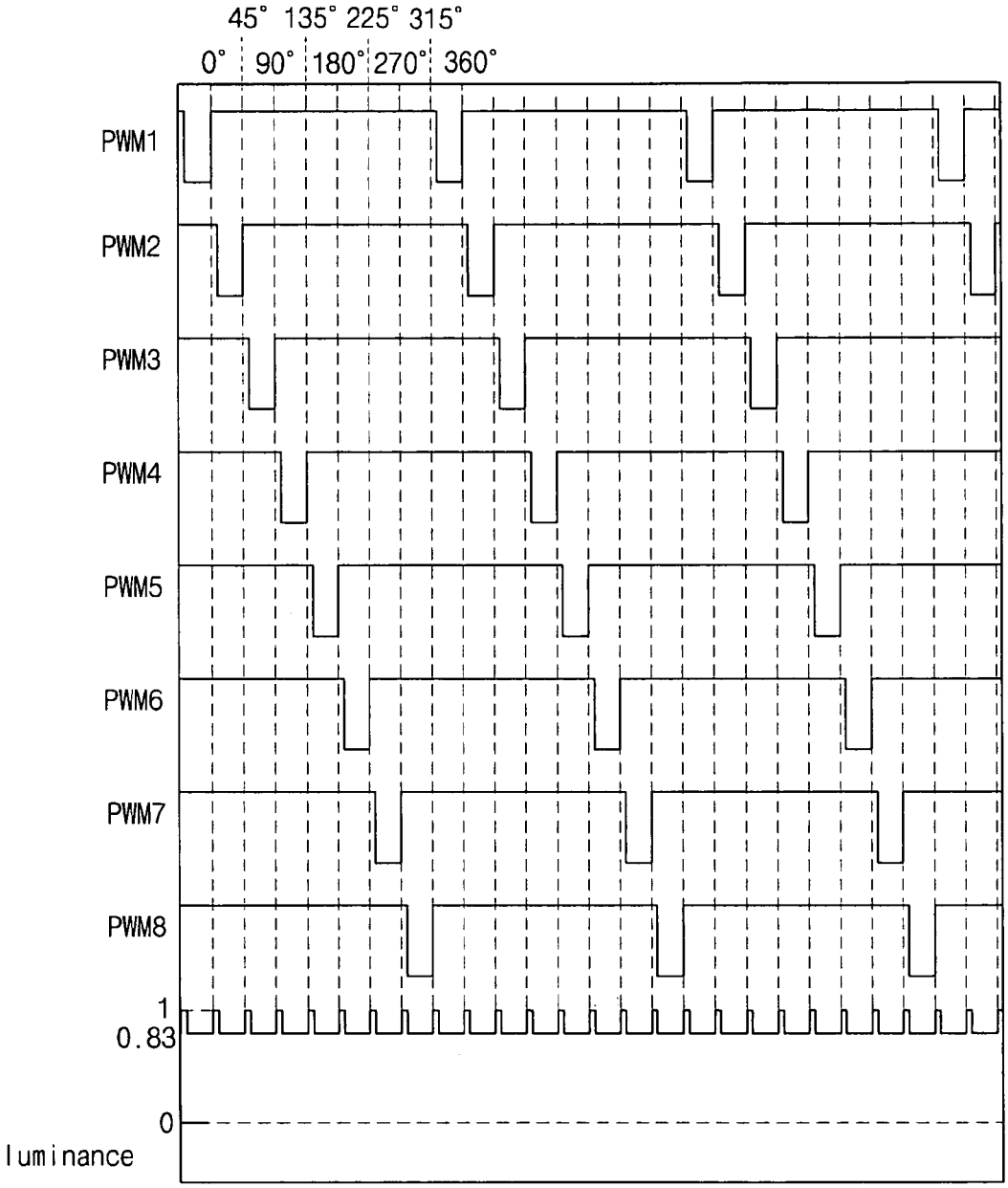
FIG. 22B shows the resulting luminance for the backlight unit shown in FIG. 18A from eight PWM signals having a phase difference of about 45° and a duty ratio of about 90%.

FIG. 22A shows the resulting luminance for a related art backlight unit from a single PWM signal having a duty ratio of about 90%. FIG. 22B shows the resulting luminance for the backlight unit shown in FIG. 18A from eight PWM signals having a phase difference of about 45° and a duty ratio of about 90%. As shown in FIG. 22A, a single zeroth PWM signal PWM0 having a duty ratio of about 90% is supplied to a related art backlight unit having first to twenty-fourth LED arrays LA1 to LA24. The single zeroth PWM signal PWM0 has a predetermined frequency and a predetermined voltage. Since the first to twenty-fourth LED arrays LA1 to LA24 are simultaneously turned ON/OFF according to the zeroth PWM signal PWM0, the luminance of the first to twenty-fourth LED arrays LA1 to LA24 has a value of 0 or 1. The luminance can be measured as an electric signal by using a photo diode. The maximum and minimum values in luminance are represented as 1 and 0, respectively, for comparison purposes.

As shown in FIG. 22B, first to eighth PWM signals PWM1 to PWM8 each having a duty ratio of about 90% are supplied to a backlight unit having first to twenty-fourth LED arrays LA1 to LA24. As a result, the first, ninth and seventeenth LED arrays LA1, LA9 and LA17 of the first group GR1 of FIG. 18A are turned ON/OFF according to the first PWM signal PWM1, and the second, tenth and eighteenth LED arrays LA2, LA10 and LA18 of the second group GR2 of FIG. 18A are turned ON/OFF according to the second PWM signal PWM2. Similarly, the third, eleventh and nineteenth LED arrays LA3, LA11 and LA19 of the third group GR3 of FIG. 18A are turned ON/OFF according to the third PWM signal PWM3, and the fourth, twelfth and twentieth LED arrays LA4, LA12 and LA20 of the fourth group GR4 of FIG. 18A are turned ON/OFF according to the fourth PWM signal PWM4. Further, the fifth, thirteenth and twenty-first LED arrays LA5, LA13 and LA21 of the fifth group GR5 of FIG. 18A are turned ON/OFF according to the fifth PWM signal PWM5, and the sixth, fourteenth and twenty-second LED arrays LA6, LA14 and LA22 of the sixth group GR6 of FIG. 18A are turned ON/OFF according to the sixth PWM signal PWM6, the seventh, fifteenth and twenty-third LED arrays LA7, LA15 and LA23 of the seventh group GR7 of FIG. 18A are turned ON/OFF according to the seventh PWM signal PWM7, and the eighth, sixteenth and twenty-fourth LED arrays LA8, LA16 and LA24 of the eighth group GR8 of FIG. 18A are turned ON/OFF according to the eighth PWM signal PWM8.

The first to eighth PWM signals PWM1 to PWM8 have the same frequency, the same voltage and the same duty ratio as the zeroth PWM signal PWM0 of FIG. 21A. In addition, neighboring two of the first to eighth PWM signals PWM1 to PWM8 have a phase difference of about 45° with each another. As a result, the second PWM signal PWM2 has a phase delayed by about 45° with respect to the first PWM signal PWM1, and the third PWM signal PWM3 has a phase delayed by about 90° with respect to the first PWM signal PWM1. Further, the fourth PWM signal PWM4 has a phase delayed by about 135° with respect to the first PWM signal PWM1, the fifth PWM signal PWM5 has a phase delayed by about 180° with respect to the first PWM signal PWM1, the sixth PWM signal PWM6 has a phase delayed by about 225° with respect to the first PWM signal PWM1, the seventh PWM signal PWM7 has a phase delayed by about 270° with respect to the first PWM signal PWM1, and the eighth PWM signal PWM8 has a phase delayed by about 315° with respect to the first PWM signal PWM1. Accordingly, the first group GR1 including the first, ninth and seventeenth LED arrays LA1, LA9 and LA17, the second group GR2 including the second, tenth and eighteenth LED arrays LA2, LA10 and LA18, the third group GR3 including the third, eleventh and nineteenth LED arrays LA3, LA11 and LA19, the fourth group GR4 including the fourth, twelfth and twentieth LED arrays LA4, LA12 and LA20, the fifth group GR5 including the fifth, thirteenth and twenty-first LED arrays LA5, LA13 and LA21, the sixth group GR6 including the sixth, fourteenth and twenty-second LED arrays LA6, LA14 and LA22, the seventh group GR7 including the seventh, fifteenth and twenty-third LED arrays LA7, LA15 and LA23, and the eighth group GR8 including the eighth, sixteenth and twenty-fourth LED arrays LA8, LA16 and LA24 are alternately turned ON/OFF.

In the instant of emitting light, since the number (i.e., 3) of emitting LED arrays of the backlight unit of FIG. 18A driven by one of the first to eighth PWM signals PWM1 to PWM8 of FIG. 22B is one eighth of the number (i.e., 24) of emitting LED arrays of a related art backlight unit driven by the zeroth PWM signal PWM0 of FIG. 22A, the instant luminance of the backlight unit of FIG. 18A driven by one of the first to eighth PWM signals PWM1 to PWM8 of FIG. 22B is substantially one eighth of the luminance of the related art backlight unit driven by the zeroth PWM signal PWM0 of FIG. 22A. During a predetermined time period, however, since the number of emission times of the backlight unit of FIG. 18A driven by the first to eighth PWM signals PWM1 to PWM8 of FIG. 22B is substantially eight times the number of emission times of the related art backlight unit driven by the zeroth PWM signal PWM0 of FIG. 22A, the total luminance of the backlight unit of FIG. 18A driven by the first to eighth PWM signals PWM1 to PWM8 of FIG. 22B is substantially the same as the total luminance of the related art backlight unit driven by the zeroth PWM signal PWM0 of FIG. 22A. In FIGS. 22A and 22B, the total luminance is calculated from the sum of areas corresponding to protruding rectangles of the luminance graph.

In the backlight unit of FIG. 18A, a plurality of LED arrays are separated into eight groups driven by eight PWM signals having phase differences shown in FIGS. 19B, 20B, 21B and 22B. As a result, deterioration in the image display quality of the liquid crystal display panel, such as a wavy noise, due to the variation in the OFF current of each TFT of the liquid crystal display panel is prevented without a reduction in total luminance.

In an LCD device according to an embodiments of the invention, a plurality of LED arrays of a backlight unit are separated into at least two groups and are driven by at least two PWM signals having different phases. Accordingly, the number of LED arrays turned ON at one time is reduced and variations in instant luminance of the backlight unit are reduced without a reduction in a total luminance. As a result, deterioration in the image display quality of the LCD device, such as a wavy noise, due to variation in an OFF current of TFT in the liquid crystal display panel is prevented.

As illustrated in the exemplary embodiments shown in FIGS. 6B, 10B, 15B and 20B, when the plurality of LED arrays of the backlight unit are separated into first to n-th groups, the at least two PWM signals include first to n-th PWM signals having a phase difference of about 360°/n and applied to the first to n-th groups, respectively, and the first to n-th PWM signals have a duty ratio of about 100/n % so that the instant luminance of the backlight unit has a uniform value at anytime. Accordingly, the deterioration in image display quality, such as a wavy noise, is prevented.

As illustrated in the exemplary embodiments shown in FIGS. 6B, 16B and 21B, when the plurality of LED arrays are separated into first to n-th groups, n is an even number, the at least two PWM signals include first to n-th PWM signals having a phase difference of about 360°/n and applied to the first to n-th groups, respectively, and the first to n-th PWM signals have a duty ratio so that the instant luminance of the backlight unit has a uniform value at any time during a time period. Accordingly, the deterioration in image display quality, such as a wavy noise, is prevented. For these embodiments, each of the first to n-th PWM signals correspond to an instant value of 1/n in comparison with an instant value of 1 of a backlight unit having a single PWM signal. Since a half (n/2) of the first to n-th PWM signals has a high level voltage at anytime, the instant luminance of the backlight unit is calculated from the equation, i.e., $(1/n+1/n+\ldots+1/n)=(1/n)*(n/2)=½=0.5$.

It will be apparent to those skilled in the art that various modifications and variations can be made in the liquid crystal display device including a backlight unit and a method of driving the liquid crystal display device shown in the above embodiments of the invention without departing from the spirit or scope of the invention. Thus, it is intended that the invention cover the modifications and variations of this invention provided they come within the scope of the appended claims and their equivalents.

What is claimed is:

1. A liquid crystal display device, comprising:

a light emitting diode array unit including at least two groups of light emitting diode arrays for emitting light, wherein each of the light emitting diode arrays includes a plurality of light emitting diodes;

a light emitting diode driving unit for supplying at least two pulse width modulation signals having different phases from each other to the at least two groups of light emitting diode arrays, respectively;

a liquid crystal display panel for displaying images using the light from the light emitting diode array unit; and a timing controller for controlling the light emitting diode driving unit and the liquid crystal display panel, wherein the plurality of light emitting diode arrays are separated into first to n-th groups, wherein n is an even number, wherein the at least two pulse width modulation signals include first to n-th pulse width modulation signals having a phase difference of about 360°/n and applied to the first to n-th groups, respectively, and wherein the first to n-th pulse width modulation signals have a duty ratio of about 50%, wherein a time period of each of the first to n-th pulse width modulation signals is composed of a former half and a latter half which have a same length as each other, and wherein the light emitting diode arrays of each of the first to n-th groups emit light during the whole former half and do not emit light during the whole latter half so that the instant luminance of the backlight unit has a constant value throughout driving of the light emitting diode arrays by the light emitting diode driving unit;

wherein the plurality of light emitting diode arrays are separated into first to eighth groups, wherein the at least two pulse width modulation signals include first to eighth pulse width modulation signals having a phase difference of about 45° and applied to the first to eighth groups, respectively;

wherein the first to eighth groups are sequentially arranged in the light emitting diode array unit such that adjacent groups are driven at the phase difference of about 45°; and wherein the light emitting diode array unit includes a plurality of first to eighth groups, the plurality of first to eighth groups sequentially arranged in the light emitting diode array unit such that each of the plurality of first through eighth groups respectively receives the first to eighth pulse width modulation signals.

2. The device according to claim 1, wherein the at least two pulse width modulation signals have a same frequency and a same voltage as each other.

3. The device according to claim 1, further comprising a phase shifter generating the at least two pulse width modulation signals.

4. The device according to claim 1, wherein n/2 of the first to n-th pulse width modulation signals has a high level voltage at anytime.

5. A method of driving a liquid crystal display device, comprising:

supplying at least two pulse width modulation signals having different phases from each other to at least two groups of light emitting diode arrays, respectively, wherein each of the light emitting diode arrays includes a plurality of light emitting diodes;

providing light from the at least two groups of light emitting diode arrays according to the at least two pulse width modulation signals into liquid crystal display panel; and displaying images on the liquid crystal display panel using the light from the at least two groups of light emitting diode arrays, wherein the plurality of light emitting diode arrays are separated into first to n-th groups, wherein n is an even number, wherein the at least two pulse width modulation signals include first to n-th pulse width modulation signals having a phase difference of about 360°/n and applied to the first to n-th groups, respectively, and wherein the first to n-th pulse width modulation signals have a duty ratio of about 50%, wherein a time period of each of the first to n-th pulse width modulation signals is composed of a former half and a latter half which have a same length as each other, and wherein the light emitting diode arrays of each of the first to n-th groups emit light during the whole former half and do not emit light during the whole latter so that the instant luminance of the backlight unit has a constant value throughout driving of the light emitting diode arrays by the light emitting diode driving unit;

wherein the plurality of light emitting diode arrays are separated into first to eighth groups, wherein the at least two pulse width modulation signals include first to eighth pulse width modulation signals having a phase difference of about 45° and applied to the first to eighth groups, respectively;

wherein the first to eighth groups are sequentially arranged in the light emitting diode array unit such that adjacent groups are driven at the phase difference of about 45°; and wherein the light emitting diode array unit includes a plurality of first to eighth groups, the plurality of first to eighth groups sequentially arranged in the light emitting diode array unit such that each of the plurality of first through eighth groups respectively receives the first to eighth pulse width modulation signals.

6. The method according to claim 5, wherein the at least two groups have a same number of light emitting diode arrays as each other.

7. The method according to claim 5, wherein the at least two pulse width modulation signals have a same frequency and a same voltage as each other.

8. The method according to claim 5, wherein n/2 of the first to n-th pulse width modulation signals has a high level voltage at anytime.

9. The device according to claim 1, wherein the instant luminance is ½ of the potential luminance of all of the first to eighth groups.

10. The method according to claim 5, wherein the instant luminance is ½ of the potential luminance of all of the first to eighth groups.

* * * * *